US009950245B2

(12) United States Patent
Yang

(10) Patent No.: US 9,950,245 B2
(45) Date of Patent: Apr. 24, 2018

(54) GREGARIOUS CARD GAME

(71) Applicant: Lee Yang, Ontario, CA (US)

(72) Inventor: Lee Yang, Ontario, CA (US)

(73) Assignee: Lee Yang, Upland, CA (US)

( * ) Notice: Subject to any disclaimer, the term of this patent is extended or adjusted under 35 U.S.C. 154(b) by 188 days.

(21) Appl. No.: 14/229,994

(22) Filed: Mar. 31, 2014

(65) Prior Publication Data

US 2015/0273315 A1 Oct. 1, 2015

(51) Int. Cl.

| | |
|---|---|
| ***A63F 1/02*** | (2006.01) |
| ***A63F 1/00*** | (2006.01) |
| ***G07F 17/32*** | (2006.01) |
| *A63F 1/04* | (2006.01) |
| *A63F 1/06* | (2006.01) |
| *A63F 1/16* | (2006.01) |

(52) U.S. Cl.

CPC ..... *A63F 1/00* (2013.01); *A63F 1/02* (2013.01); *G07F 17/3293* (2013.01); *A63F 1/067* (2013.01); *A63F 1/16* (2013.01); *A63F 2001/006* (2013.01); *A63F 2001/0408* (2013.01); *A63F 2001/0416* (2013.01); *A63F 2001/0458* (2013.01); *A63F 2001/0466* (2013.01); *A63F 2001/0475* (2013.01)

(58) Field of Classification Search

CPC ..... A63F 9/205; A63F 2001/006; A63F 1/02; A63F 2001/0408; A63F 2001/0416; A63F 2001/0458; A63F 2001/0466; A63F 2001/0475; A63F 1/067; A63F 1/16

USPC ..... 273/292, 303–308, 148 R, 309; D21/376

See application file for complete search history.

(56) References Cited

U.S. PATENT DOCUMENTS

| | | | | |
|---|---|---|---|---|
| 6,834,857 | B2 * | 12/2004 | Lee et al. | 273/292 |
| 7,360,763 | B2 * | 4/2008 | Wong | 273/274 |
| 7,389,989 | B1 * | 6/2008 | Hong | 273/274 |
| 7,988,153 | B2 * | 8/2011 | Chang | 273/304 |
| 8,366,111 | B2 * | 2/2013 | Factor | 273/292 |
| 2006/0181026 | A1 * | 8/2006 | Wong | 273/292 |

* cited by examiner

*Primary Examiner* — Benjamin Layno

(57) ABSTRACT

A new game and the methods thereof are disclosed. The game comprises utilizing new devices, rules, methods, well-defined terms, and a plurality of playing cards designed with special markings and performing alternative actions within a conditional loop to tactically and strategically form the cards on-hand as required melds/pair with bonus-earning patterns. The structure, format, rules, and playing methods of the present invention are designed to provide a great mental workout, and the purpose of the present invention is to engage people and create a friendly and gregarious environment that allows everyone to enjoy the company of others.

12 Claims, 57 Drawing Sheets

Position Suit Cards

Money Suit Cards 10-cards game:
(3 melds and 1 pair)

13-cards game:
(4 melds and 1 pair)

16-cards game:
(5 melds and 1 pair)

Position Indicator

Round Indicator

Front

Back

FIG. 4

| Categories | Bonus | Point(s) | Level to count | Rank to play |
|---|---|---|---|---|
| Lucky bonuses | Season<br>Fruit<br>Money<br>Player-position<br>Prevailing-round<br>Dealer<br>Successive<br>Bingo<br>Quad-done<br>Quad-rob<br>Last-card | 1 | All levels | All ranks |
| Tactics bonuses | All-by-myself | 1 | Middle/High | All ranks |
| | Only-one-concealed | 1 | Middle/High | All ranks |
| | Specific-marking | 1 | Middle/High | All ranks |
| | All-from-others | 2 | Middle/High | All ranks |
| | 3CI | 2 | Middle/High | All ranks |
| | Specific-card | 2 | Middle/High | All ranks |
| | 4CI | 6 | Middle/High | 13-cards/16-cards game |
| | Change-once | 6 | Middle/High | All ranks |
| | 5CI | 8 | Middle/High | 16-cards game |
| | Without-change | 8 | Middle/High | All ranks |
| Suit-pattern bonuses | Double-straight | 2 | Middle/High | All ranks |
| | Small-money | 4 | Middle/High | All ranks |
| | Small-position | 4 | Middle/High | All ranks |
| | Almost-flush | 4 | Middle/High | All ranks |
| | Four-seasons | 4 | Middle/High | All ranks |
| | Four-fruits | 4 | Middle/High | All ranks |
| | Good-money | 6 | Middle/High | All ranks |
| | Good-position | 6 | Middle/High | All ranks |
| | Straight-9-flush | 6 | Middle/High | All ranks |
| | Triple-straight | 6 | Middle/High | All ranks |
| | Flush | 8 | Middle/High | All ranks |
| | Big-money | 8 | Middle/High | 13-cards/16-cards game |
| | Big-position | 8 | Middle/High | 13-cards/16-cards game |
| | Quadruple-straight | 8 | Middle/High | 13-cards/16-cards game |
| Hand-pattern bonuses | Shape-straight | 2 | High | All ranks |
| | All-different | 2 | High | All ranks |
| | Without-one-nine | 2 | High | All ranks |
| | Identical-only | 4 | High | All ranks |
| | Almost-one-or-nine | 4 | High | All ranks |
| | Two-double-straight | 4 | High | 13-cards/16-cards game |
| | Three-three | 6 | High | All ranks |
| | Bonus-rob | 6 & game over | High | All ranks |
| | One-or-nine | 8 | High | All ranks |
| | 4QI | 8 & game over | High | 13-cards/16-cards game |
| | No-neighbor | 8 & game over | High | All ranks |
| | 8-bonus-cards | 8 & game over | High | All ranks |
| | 7-pairs | 8 & game over | High | 13-cards/16-cards game |

melds in Display Zone

None concealed in-hand cards card drawn or taken-in to accomplish a complete hand melds in Display Zone concealed in-hand cards card taken-in to accomplish a complete hand melds in Display Zone concealed in-hand card card drawn or taken-in to accomplish a complete hand melds in Display Zone None concealed in-hand cards card drawn or taken-in to accomplish a complete hand melds in Display Zone None concealed in-hand cards card drawn or taken-in to accomplish a complete hand 10-cards game:

13-cards game:

16-cards game:

10-cards game:

13-cards game:

16-cards game:

10-cards game:

13-cards game:

16-cards game:

10-cards game

N/A 13-cards game 16-cards game 10-cards game

N/A 13-cards game 16-cards game 10-cards game

N/A 13-cards game 16-cards game 10-cards game

N/A 13-cards game 16-cards game melds in Display Zone concealed in-hand cards card drawn or taken-in to declare a win 10-cards game

N/A 13-cards game 16-cards game

Notes:

1. PI is the abbreviation for Position Indicator.
2. RI is the abbreviation for Round Indicator.

Procedure of Playing the Game:

Note:
"——" line used to show matters happened regularly in a play
"-·-·" line used to show matters not happened regularly in a play
"—··" line used to show matters causing a tie

GREGARIOUS CARD GAME

FIELD OF THE INVENTION

The embodiments of the present invention relates to card games, and more specifically to a card game for four players using a specialized deck of cards, and method of playing the game that encourages players to exercise their brain by strategizing against their opponents while socializing with in an non-electronic manner.

BACKGROUND OF THE INVENTION

Existing medications for dementia patients currently cannot cure the disease, the deterioration of the human brain, but rather only delay the deterioration. As such, the prevention of dementia becomes more important since there is no cure. Per scientific literature, people who stay mentally and socially active may be able to prevent dementia or at least slow down the onset of dementia. Regularly exercising by mental stimulations and socializing with others are key to strengthen our brains.

To regularly strengthen our mental stimulation, we need to challenge and engage our brains by working on multiple tasks or having actions of describing, analyzing, communicating, interacting, and organizing. Then, we can keep learning something new, practicing memorization, practicing 5 Ws (Who, What, Where, When, and Why), and capturing visual details to keep our neurons firing. To regularly strengthen our social life, we, as highly social creatures, need to connect to others and talk to each other in order to keep memory and cognition better. So, we should spend time, have fun, and enjoy something together with people on a regular basis.

According to the literatures of dementia research institutes, regularly playing brain games with people may be one of the best ways to regularly strengthen our mental stimulation and social life to make our brains exercise well and be stronger. However, most of the brain games in modern society are solely designed to individually exercise memory on pictures, pairs match, crossword, or numbers.

The present invention has been made in view of the forgoing, and, therefore, it is the main object of the present invention to provide an interesting brain teasers and strategy game that needs people play together in order to strengthen players' mental stimulation and social life.

BRIEF SUMMARY OF THE INVENTION

In addition to having fun and enjoying playing game, the present invention provides players to work on multiple tasks and exercise their brains by describing and analyzing the cards revealed and displayed on the playing table, by communicating and interacting with the players during the game play, and by taking different tactics/strategies and organizing the cards on-hand to form melds/pair with bonus-earning patterns.

The present invention is a game with conditionally looping steps, which are simple and easy to learn, and, to make the play easier, the playing cards and devices are depicted with universal symbols and well-grouped with functions. In the game, the alternative actions choosing by players creates interaction and communication among players, and the players' mental activities of describing and analyzing the cards revealed and displayed are actually trying to capture visual details, which may keep players' neurons firing. Moreover, the interesting variety of the bonus-earning patterns and tactics, which may be co-existed, can also make the players actively work on multiple tasks and exercise their brains. In summary, the game is fun, challenging, and social, and because the present invention can make the players stay mentally and socially active, it can be one of the best tools to lead a brain-healthy lifestyle and to prevent dementia symptoms and slow down the progress of deterioration.

BRIEF DESCRIPTION OF THE DRAWINGS

The embodiments set forth in the figures are intended to be illustrative and for explanatory purposes, are not necessarily drawn to scale, may be varied and/or colored in a various ways, are not meant to limit the scope of the invention, and may have further alterations, modifications, and/or additions within the scope and spirit of the present invention.

Furthermore, the section of the Detailed Description of the Invention provides more apparent and complete understanding of the features of the drawings.

(FIG. 1A-1 is an enlargement).

(FIG. 1B-1 is an enlargement).

(FIG. 1C-1 is an enlargement).

(FIG. 1D-1 is an enlargement).

(FIG. 1E-1 is an enlargement)

FIG. 4 illustrates the Bonus Table containing all kinds of bonus with information of point(s), level to count, and rank to play.

FIG. 4H illustrates the example of the 4CI bonus when a complete hand is accomplished in 13-cards game.

DETAILED DESCRIPTION OF THE INVENTION

In the following detailed description of the invention, the embodiments herein are disclosed and illustrated by the accompanying drawings. The drawings are intended to be illustrative and for explanatory purposes, especially the drawings relating to the cards, which are not necessarily drawn to scale and may be varied and/or colored in various ways. The embodiments of the invention illustrated in the detailed description below are not meant to limit the scope of the invention, any further alterations, modifications, and/or additions of the subject matters presented herein are to be considered within the scope of the present invention.

I. Structure of the Game

The present invention is a new card game, and its purpose is to engage people and create a friendly and gregarious environment that allows everyone to enjoy the company of others. The game is comprised of rounds. A round is comprised of plays and ends at the time that all players have, in turns, completed their dealer positions. A play starts at the time dealer shuffles cards and ends at the time a win is successfully declared or there is a tie. To facilitate the game, rounds are named and played in the order of East round, South round, West round, and North round, or in the order of £ (Pound) round, $ (US dollar) round € (Euro dollar) round, and ¥ (Japanese Yen) round. Based on the length of time they want to play, players predetermine how many rounds they will play, and it is not ruled that players have to at least play four rounds or a multiple of four. For example, if players determine to play two rounds, they may play in the order of East round and South round, or in the order of £ round and $ round. When the South round or $ round is over, it is the end of the game.

Figure 7:
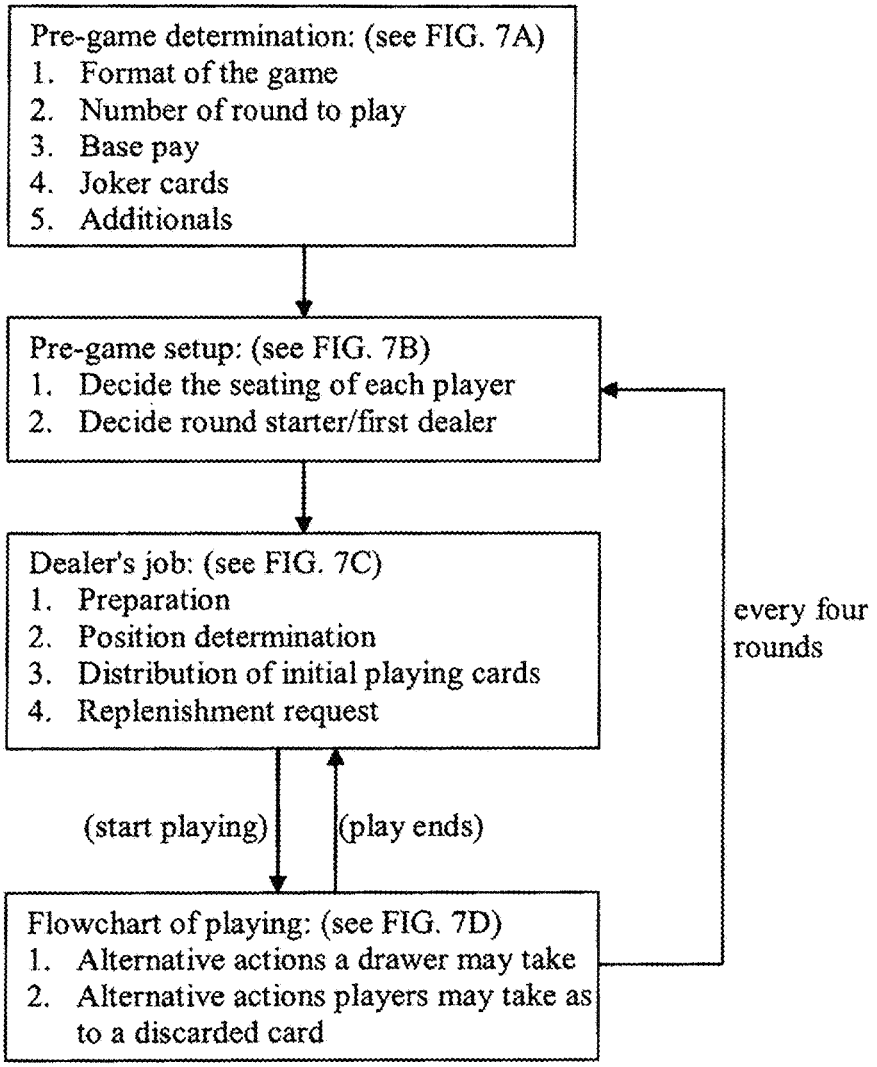
FIG. 7 illustrates the general procedure of playing the game.
Figure 7A:
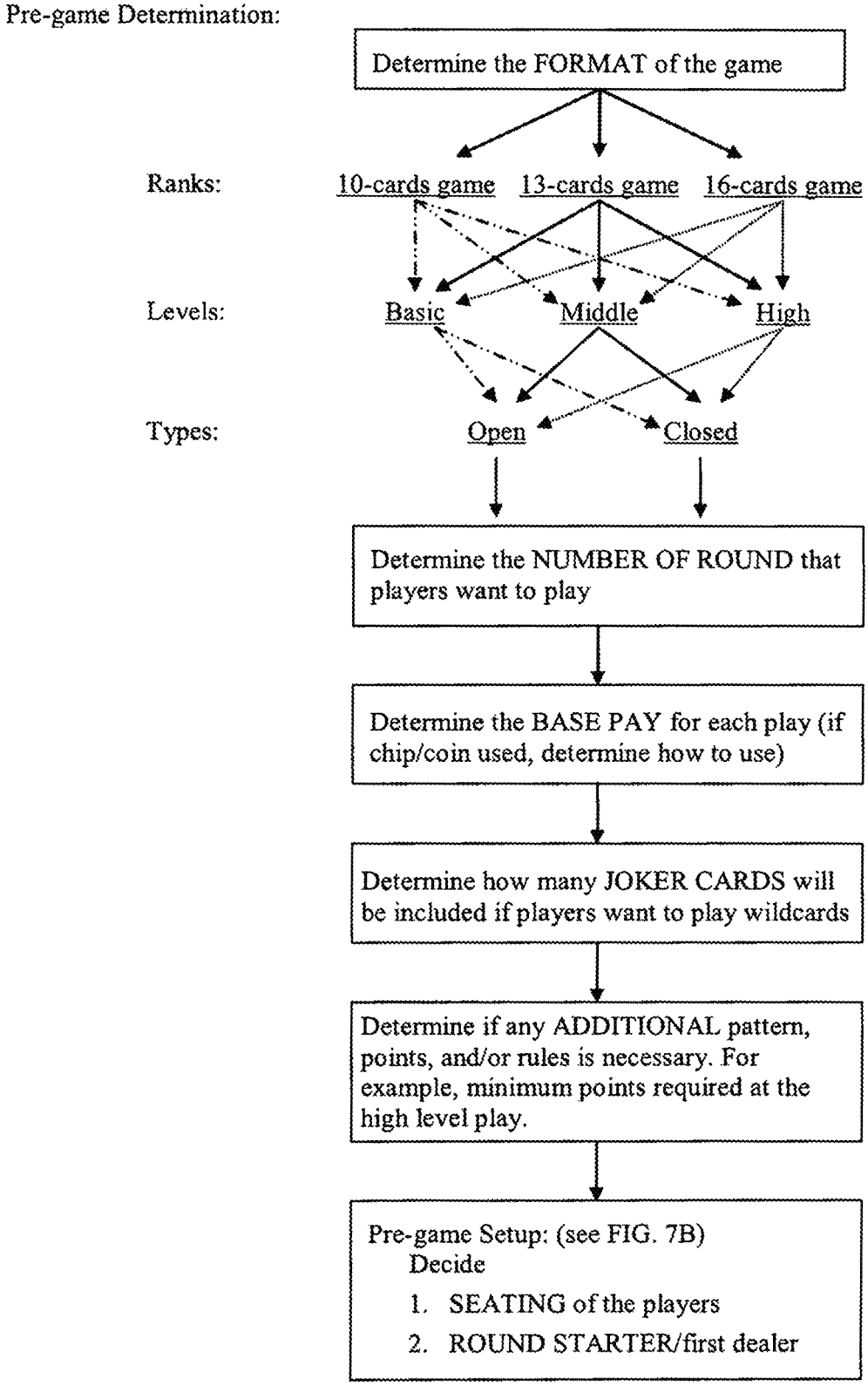
FIG. 7A illustrates the procedure of the pre-game determination.
Figure 7B:
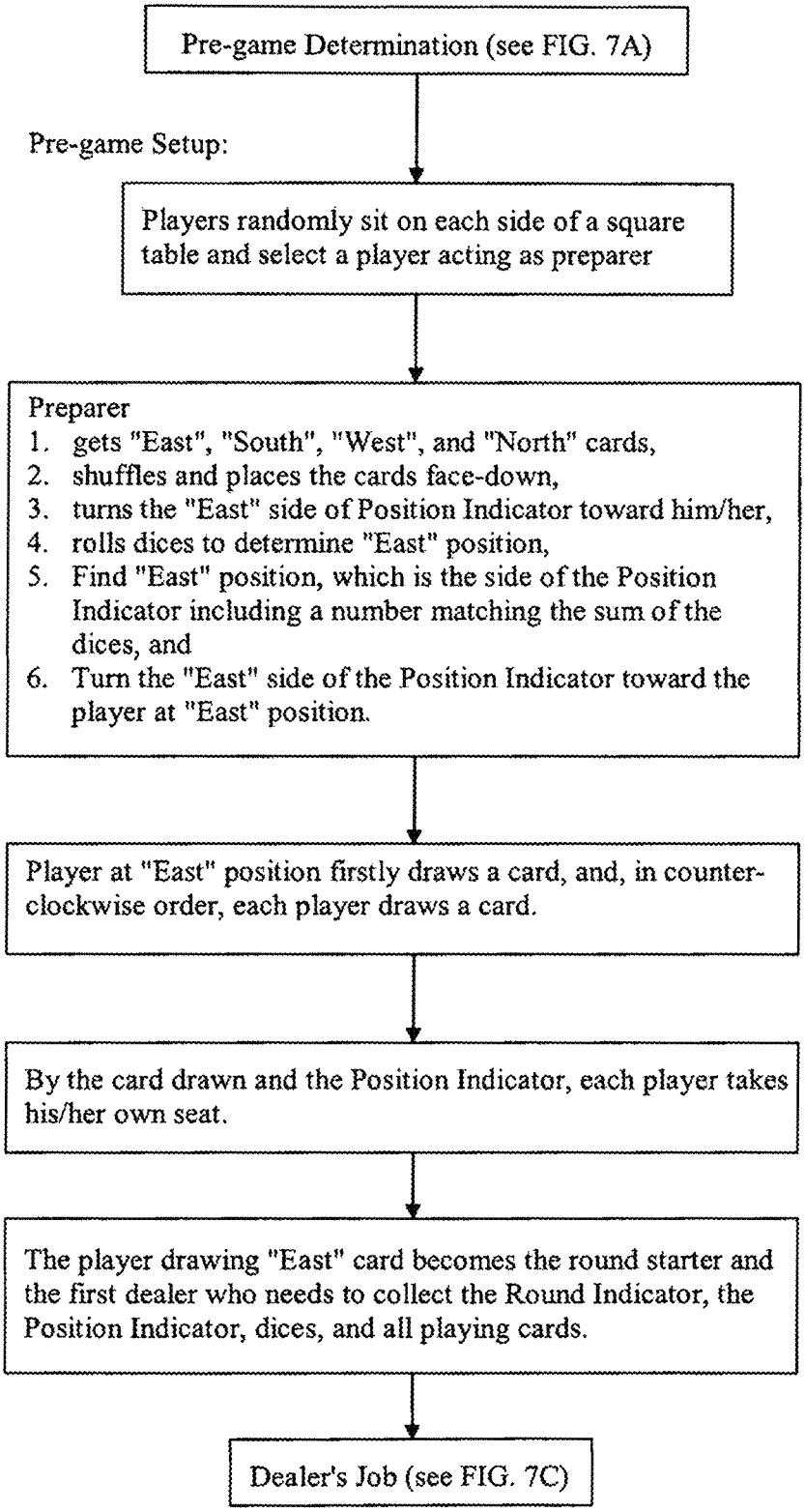
FIG. 7B illustrates the procedure of the pre-game setup.
Figure 7C:
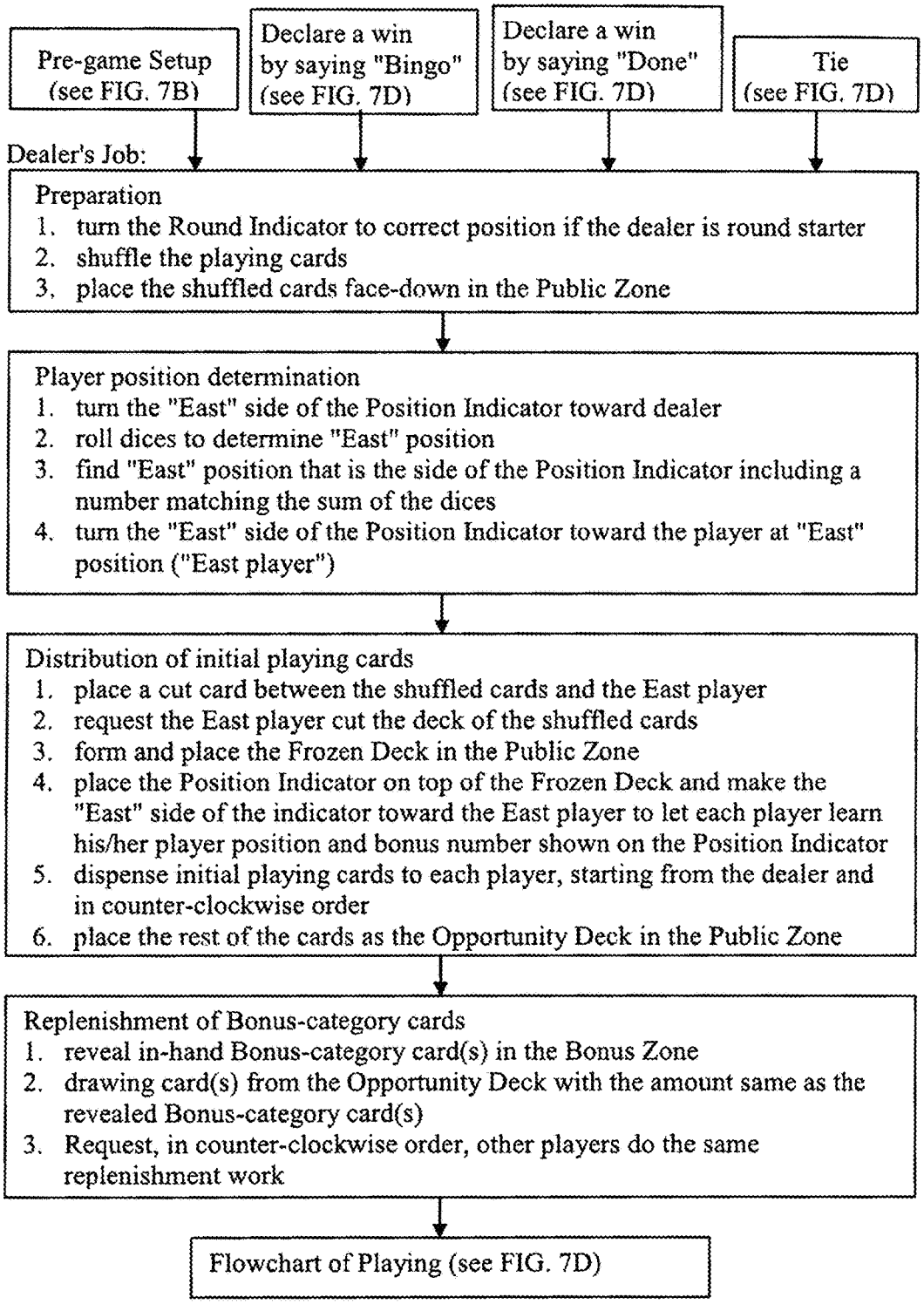
FIG. 7C illustrates the dealer's job before a play starts.
Figure 7D:
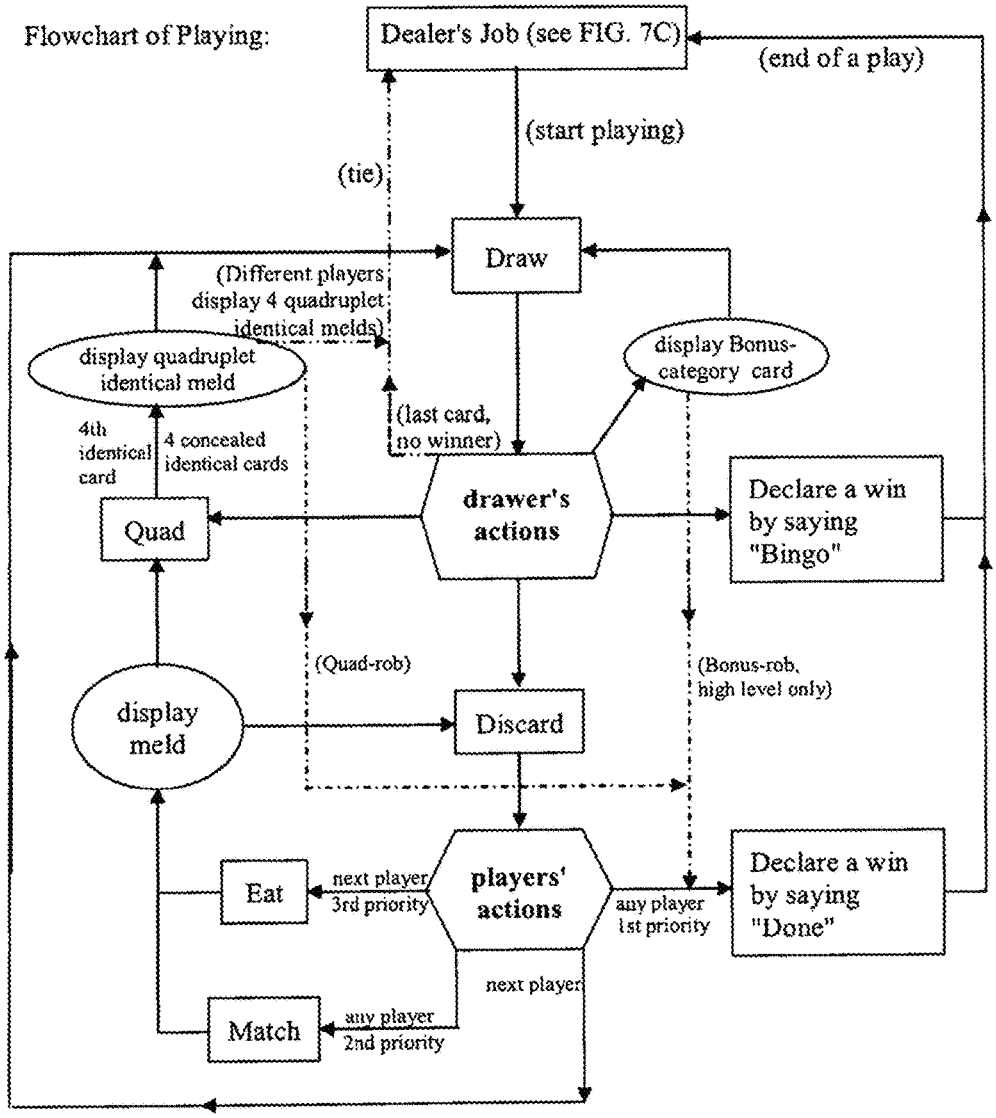
FIG. 7D illustrates the flow of a play with alternative actions.

The game needs four players sitting on each side of a square table as four different positions (East, South, West, and North) to play together by performing alternative actions within a conditional loop (see FIG. 7D). In the game, players change their seating every four rounds if the number of rounds they determine to play is a multiple of four. Moreover, to make the game interesting, each player's position in nominal is continually changed and determined by the sum of dices rolled by dealer in the beginning of each play. Before the game starts, players determine the seating of each player, and the player who sits on the East position becomes round starter and the first dealer. A dealer position is end when any other player wins the play, and the dealer gives the devices for performing dealer's job to the next player, the player to the right, who becomes the dealer of the next play. However, if a dealer wins or a play is tied, the dealer successively keeps the dealer position and acts as a successive dealer of the next play. It is called Successive 1 when dealer first time becomes a successive dealer of the next play, Successive 2 when dealer second time becomes a successive dealer of the next play, Successive 3 . . . and so forth.

Figure 2:
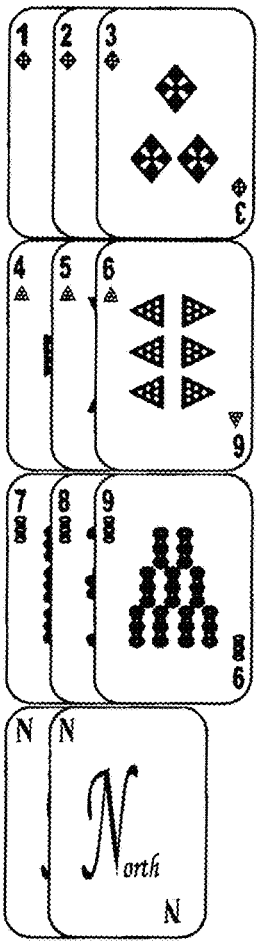
FIG. 2 illustrates examples of a complete hand.
Figure 2:
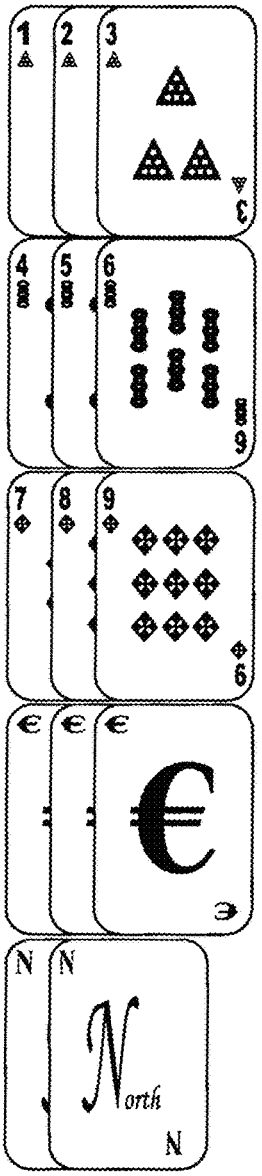
Figure 2:
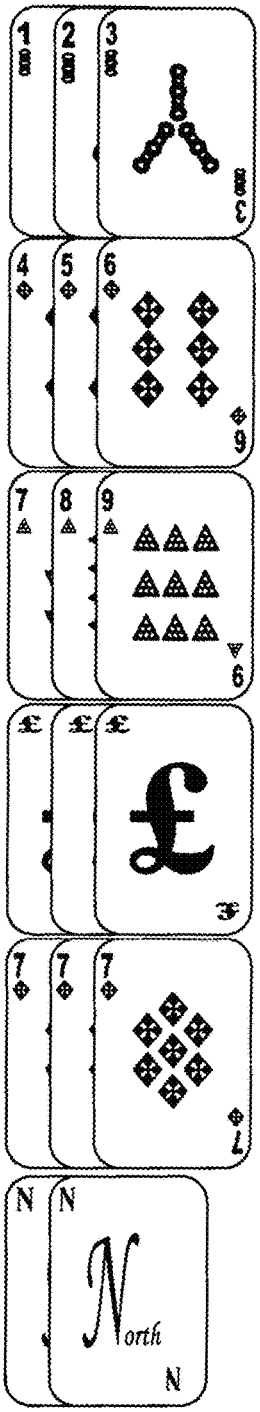
Figure 2A:
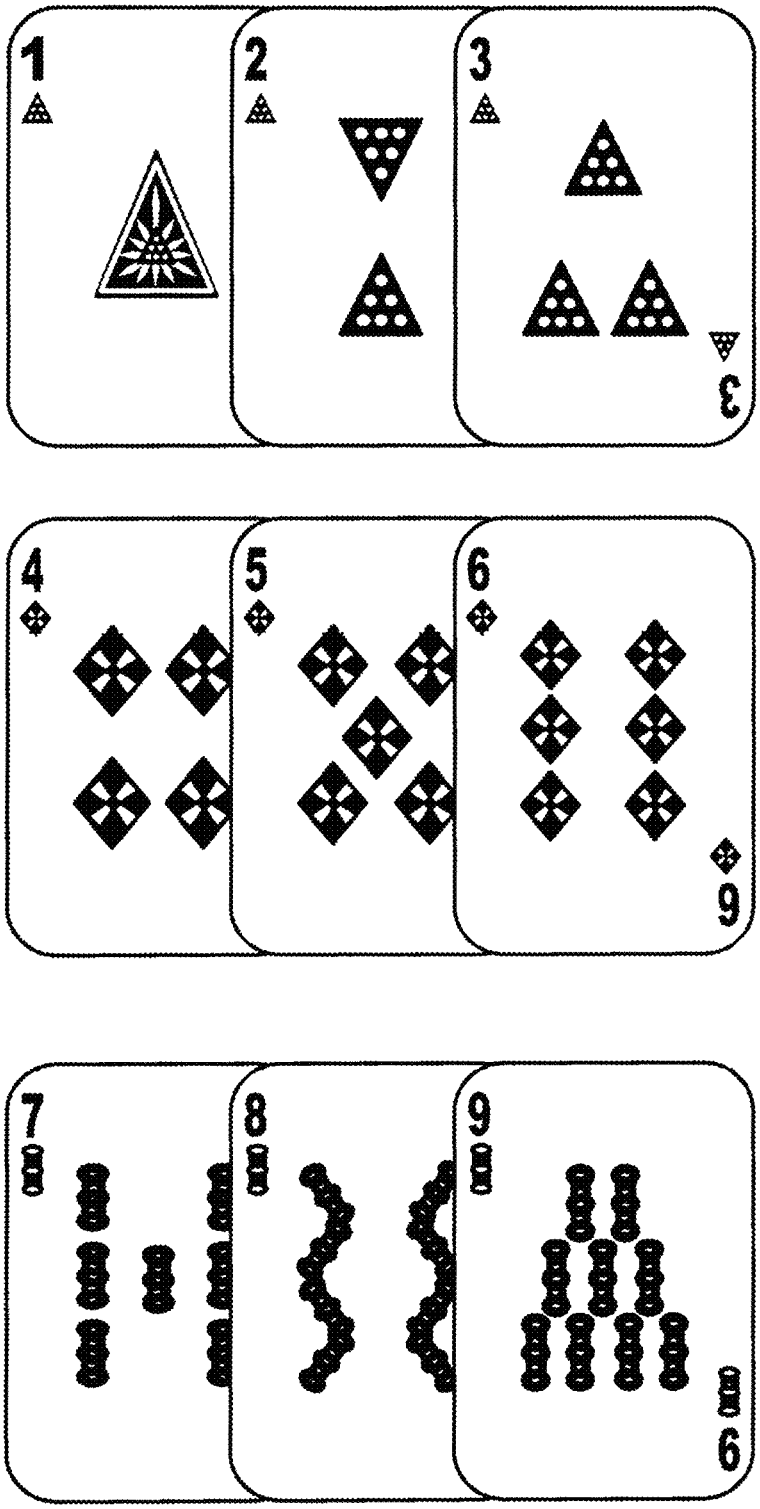
FIG. 2A illustrates three examples of straight meld.
Figure 2B:
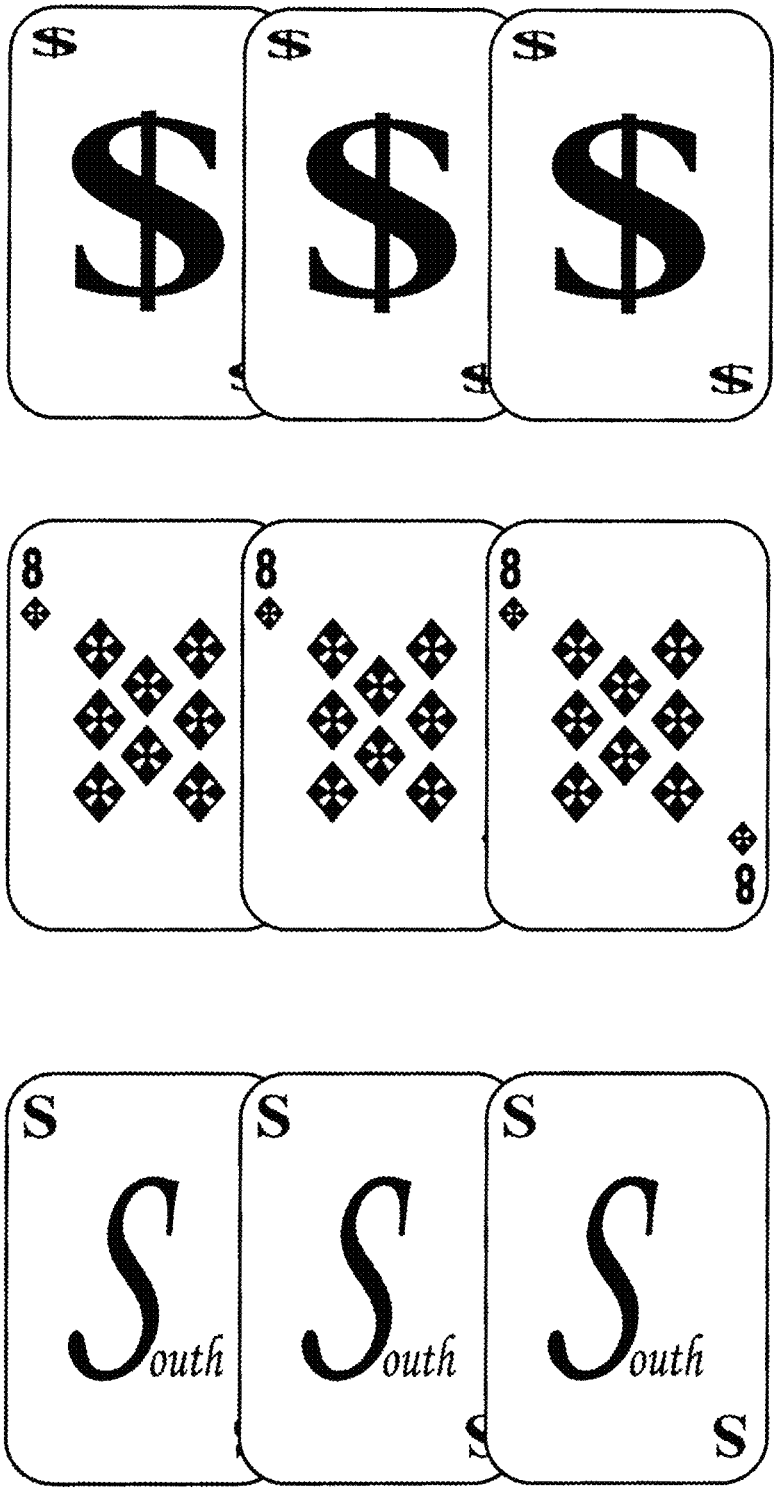
FIG. 2B illustrates three examples of triplet identical meld.
Figure 2C:
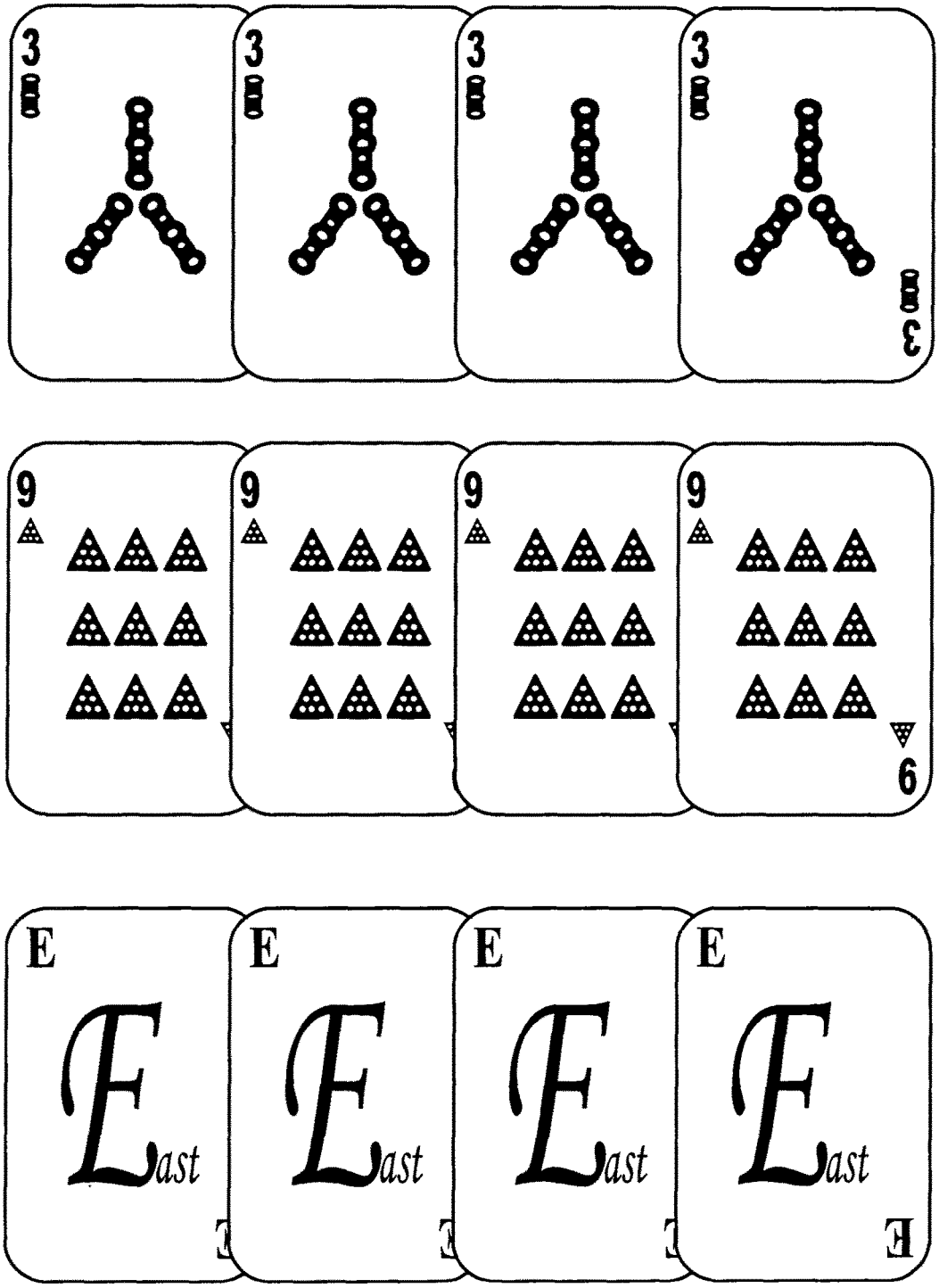
FIG. 2C illustrates three examples of quadruplet identical meld.
Figure 2D:
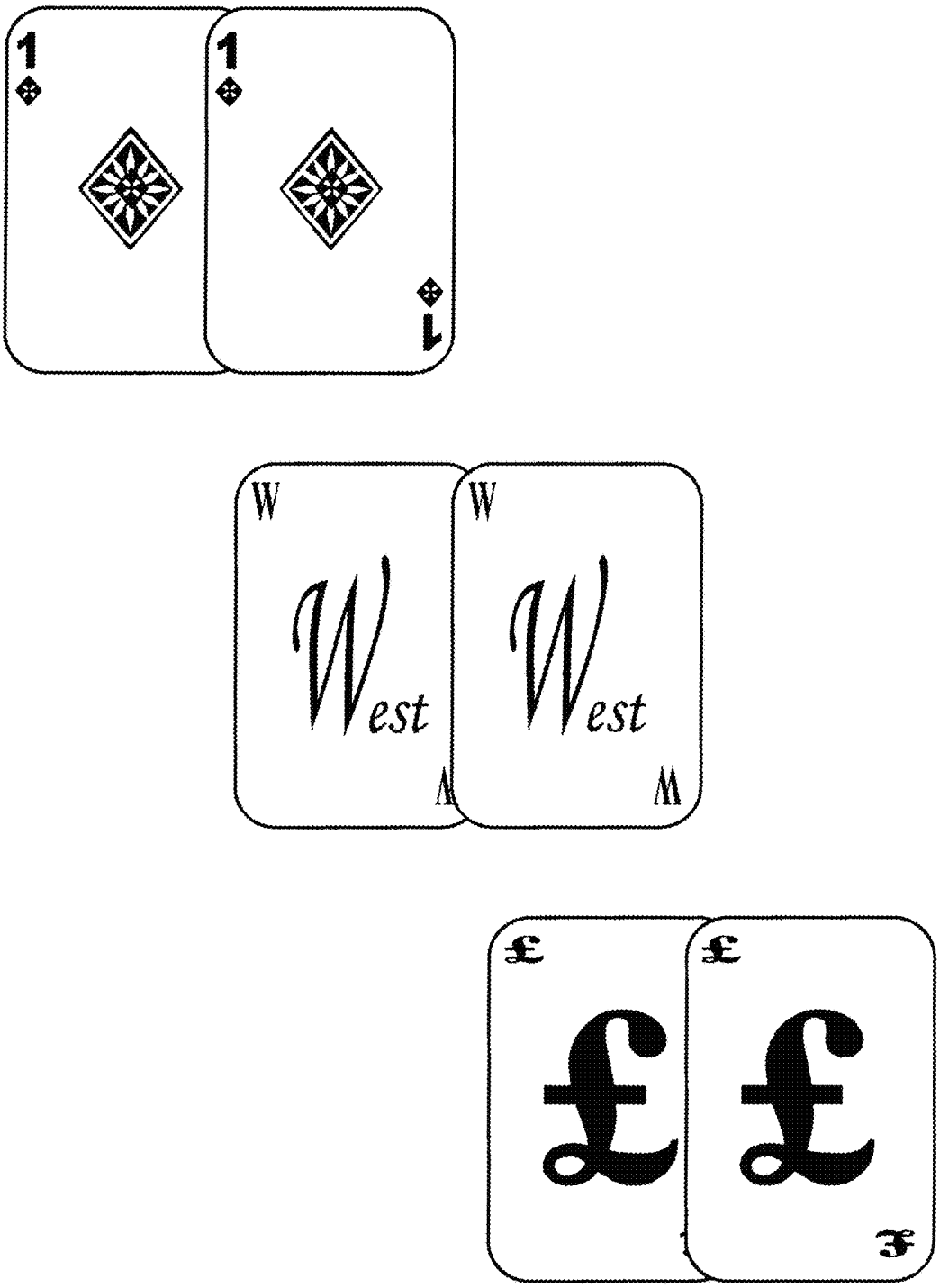
FIG. 2D illustrates three examples of pair.
Figure 3:
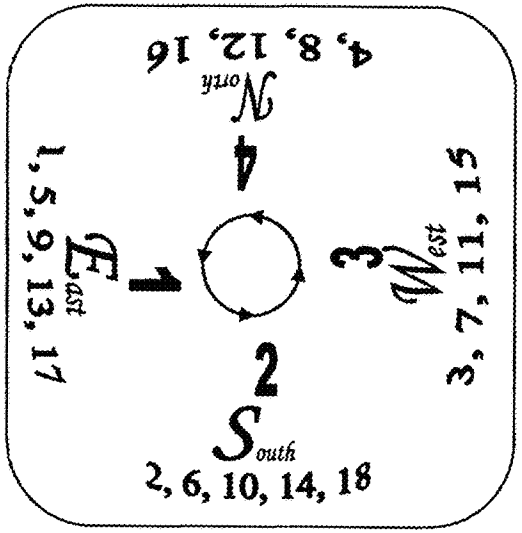
FIG. 3 illustrates the Position Indicator and the front and back of the Round Indicator.
Figure 3:
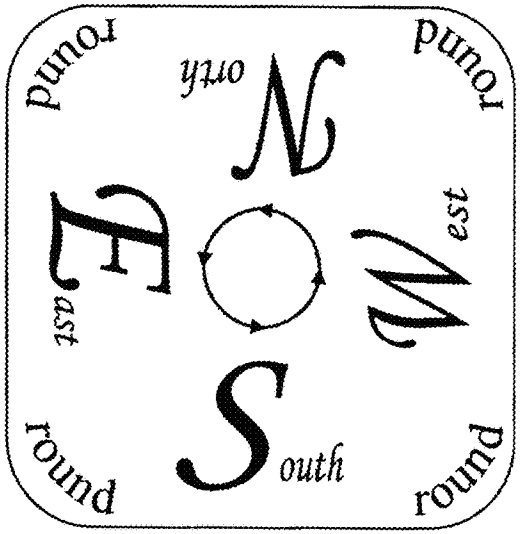
Figure 3:
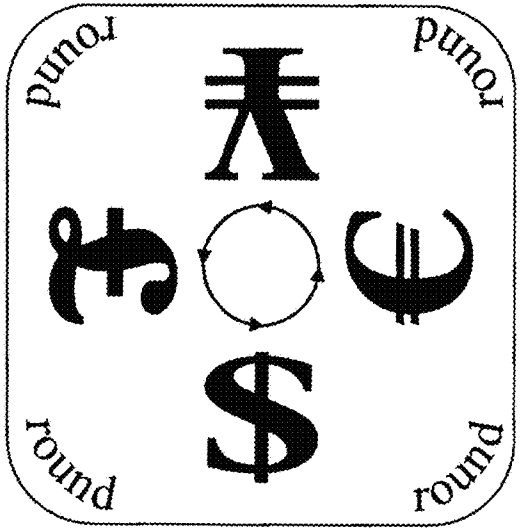

The goal of the game is to declare a win in each play, and the requirements to declare a win in different playing levels are described below in the section of Part III. Format of the Game. However, it is basic that, to declare a win, a player needs to accomplish a complete hand (see FIG. 2) or, sometimes, to accomplish specific patterns of on-hand cards. On-hand cards include maneuverable in-hand cards and unchangeable displayed cards belong to a player during a play. In-hand cards are the concealed cards that each player holds to freely form melds/pair in various ways. Displayed cards are the fixed and unchangeable cards placed in specific display areas of a playing table. A complete hand is accomplished when the required melds and a pair are successfully formed by adding one more card to on-hand cards. A meld is a set of three matching cards of a suit, sometimes four cards when a quadruplet identical meld is formed. A meld can be a straight meld or an identical meld. Straight meld is three cards of a suit formed in sequences of ascending (see FIG. 2A). Identical meld is a set of cards with identical marking, and it can be triplet identical meld formed by three cards (see FIG. 2B) or quadruplet identical meld formed by four cards (see FIG. 2C). A pair is defined as any two cards with identical marking (see FIG. 2D).

Winner of each play is entitled to receive payoff, and loser of each play is obligated to give payout. Unless it is tied, payoff/payout should be done whenever a play is over. When a player draws a card and declares a win, he/she should say "Bingo" and get payoff from all other three players. When a player takes in a card from other player and declares a win, he/she should say "Done" and get payoff only from the player who discards or displays the card. The pay calculation is based on the base pay plus bonus earned in the play. Base pay is the minimum charge of points for each play, and it is predetermined by players. Bonus is the point(s) added to the base pay to calculate payoff/payout, and it can be earned by having some matters luckily happened, particular approaches to accomplish a complete hand, special patterns of a suit, and special patterns of on-hand cards. Example of pay calculation: if a player who is dealer declares a "Bingo" win with 3 points bonus and the predetermined base pay is 10 points, the payout of each of the other three players is 13 points (=10 points base pay+3 points bonus), and the winner's payoff is 39 points (=13 points×3 players). As to the method of receiving payoff/making payout, it could be done by a record of score-keeping of the points winner receives and loser pays. However, an easier way of doing payoff/payout in each play is by chips or coins, which the point value of each chip/coin and the number of issuance predetermined. At the end of the game, by counting chips or coins on hand, each player calculate his/her balance of points to determine the winner(s) and loser(s) of the game.

II. Cards and Devices Contained in the Game

The game set contains a 148 specialized card set (see FIGS. 1 to 1E), three regular six-sided dice, Round Indicator, and Position Indicator.

Round Indicator is a square card with the front depicting East, South, West, and North rounds, and the back depicting £ (Pound), $ (US dollar), € (Euro dollar), and ¥ (Japanese Yen) rounds. Both the front and the back contain a symbol of circle with arrows, which indicates the order that players take turns to act as a dealer. The indicator is a tool for counting the number of rounds played and for denoting prevailing round position. In the game, players may either use one side or both sides of the indicator. For example, if the number of rounds that players determine to play is eight, players may play two times in the order of East round, South round, West round, and North round, or play in the order of East round, South round, West round, North round, £ round, $ round, € round, and ¥ round. Round starter is the first dealer to start a round and, therefore, in charge of holding the indicator. When a round is over and the round starter becomes dealer again, he/she should turn the proper side of the indicator toward his/her position to denote prevailing round position.

Position Indicator is a square card containing four kinds of information on one side, and they are (1) numbers for determining East position: each side of the indicator includes a series of numbers that are used to match the sum of dices. The sum of dices determines which player position is East; (2) player position in a play: each side of the indicator denotes a position for the player facing the side; (3) bonus number for player position: each side of the indicator denotes a bonus number for the player facing the side; and (4) the order of dispensing/drawing cards, which is the symbol of circle with arrows. In summary, because of the information included, the Position Indicator can be used to determine the seating of the players and the round starter, to help each player in learning his/her player position and bonus number in each play, and to facilitate the determination of the order of dispensing card in the beginning of each play and drawing cards during a play.

Figure 6:
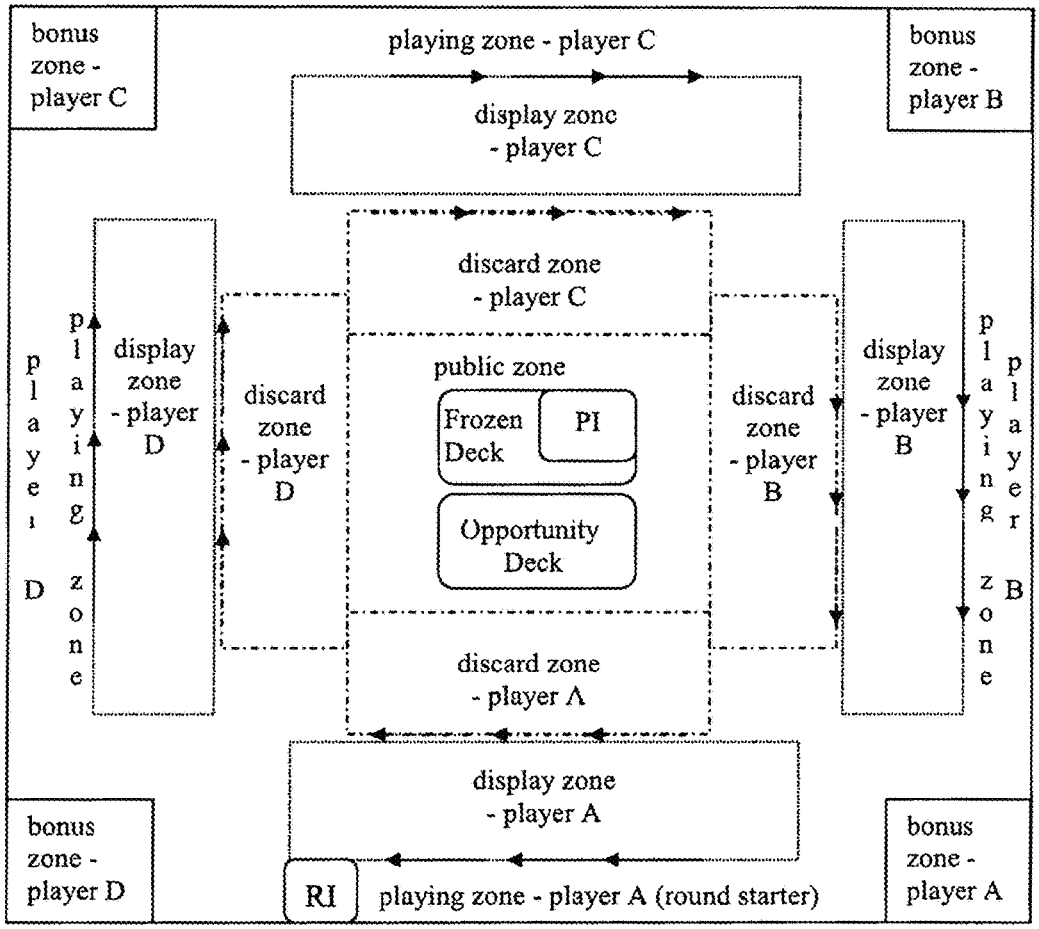
FIG. 6 illustrates the Playing Zones, the Bonus Zones, the Public Zone, the Discard Zones, and the Display Zones of a playing table.
Figure 6A:
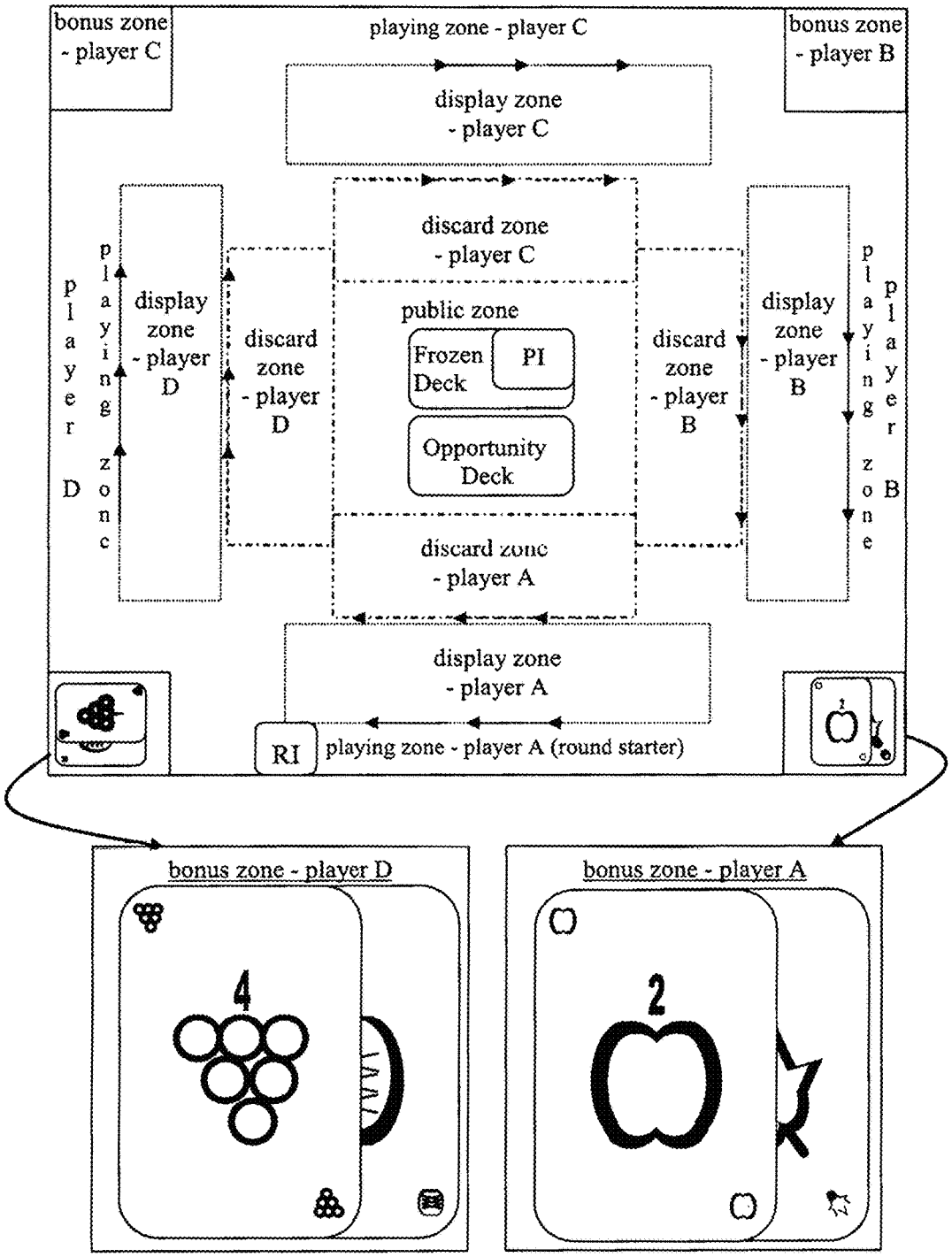
FIG. 6A illustrates the method of displaying Bonus-category cards.
Figure 6B:
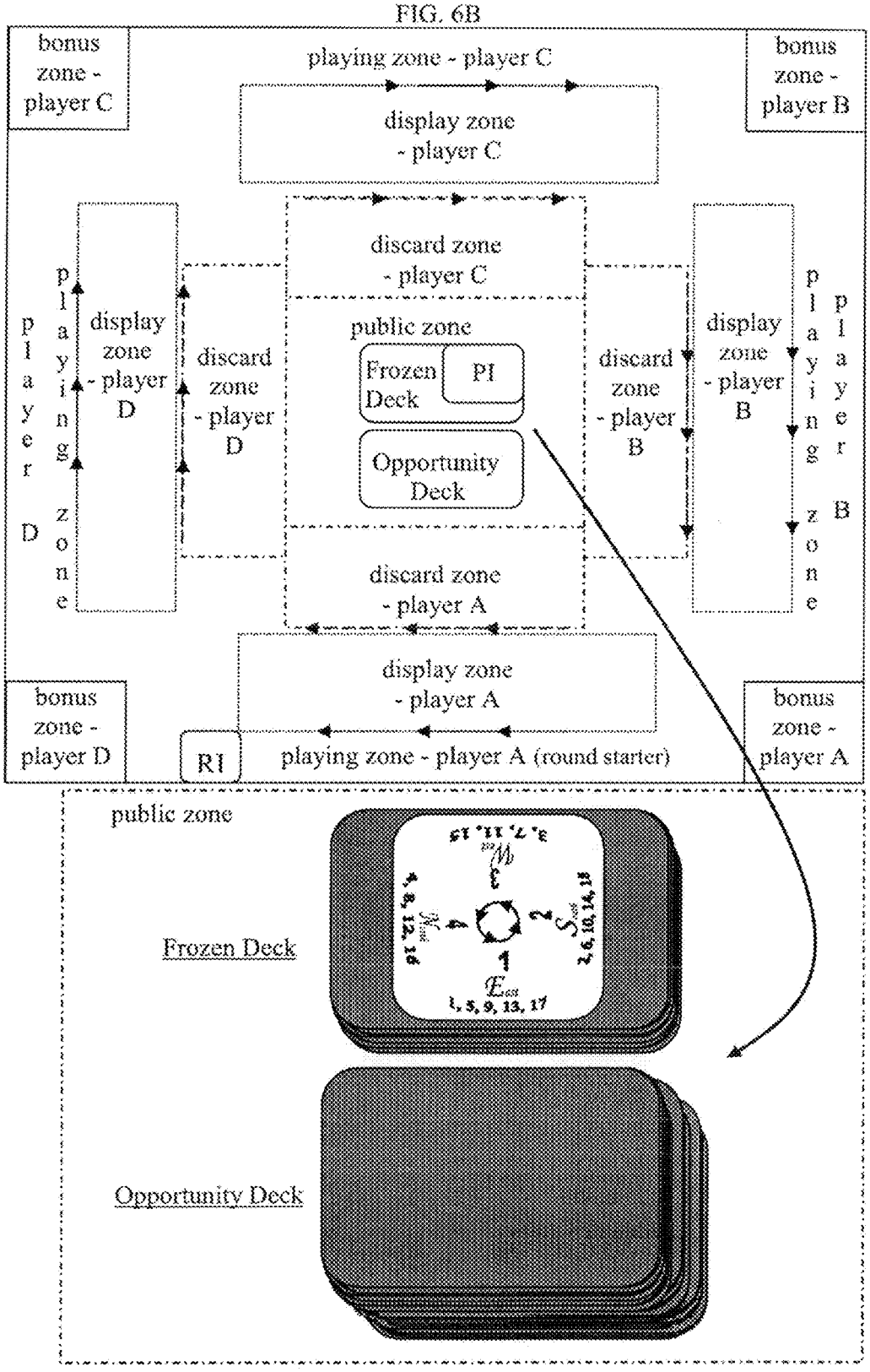
FIG. 6B illustrates the placement of the Opportunity Deck, the Frozen Deck, and the Position Indicator in the Public Zone.
Figure 6C:
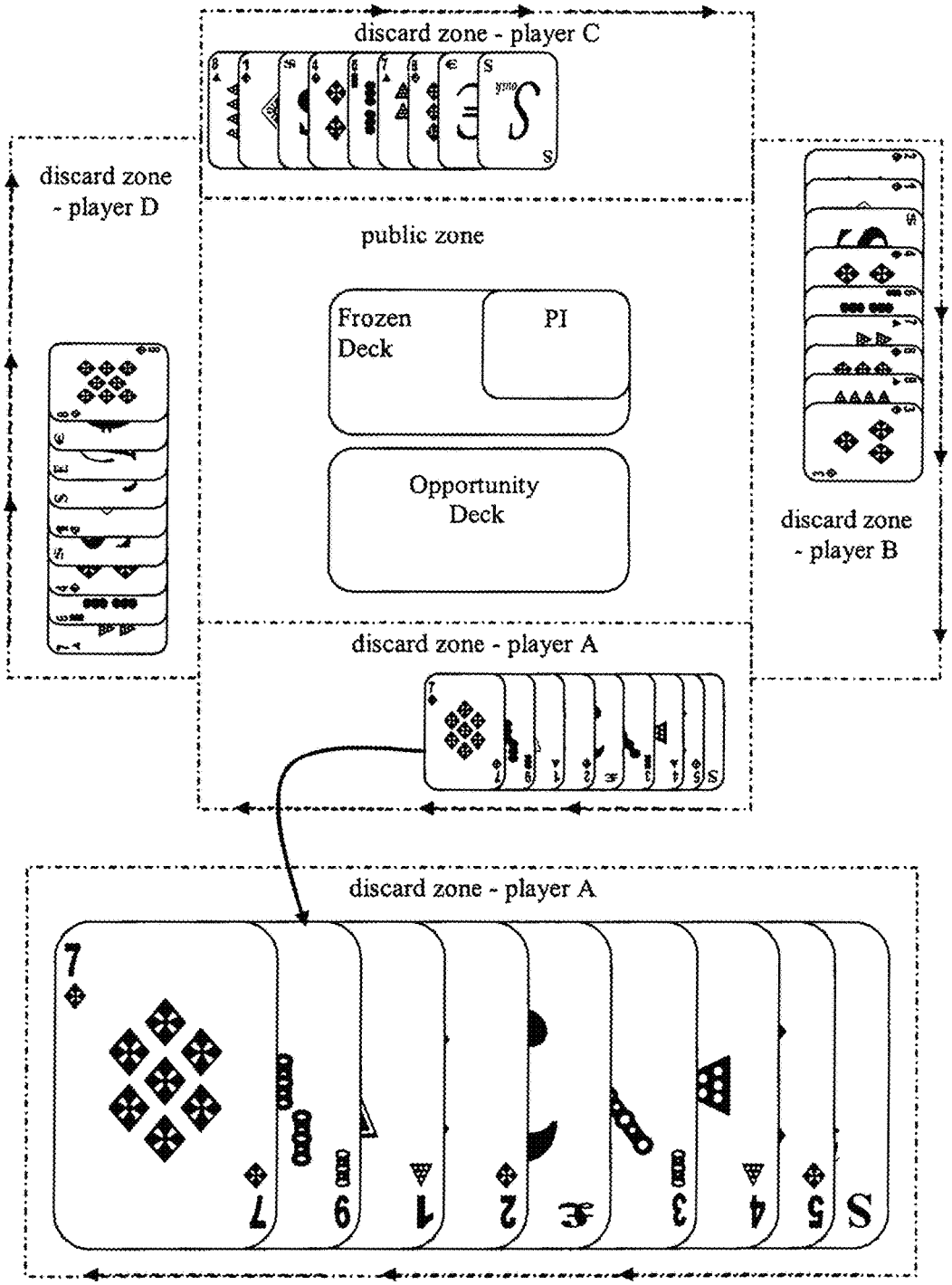
FIG. 6C illustrates the method of displaying discarded cards.
Figure 6D:
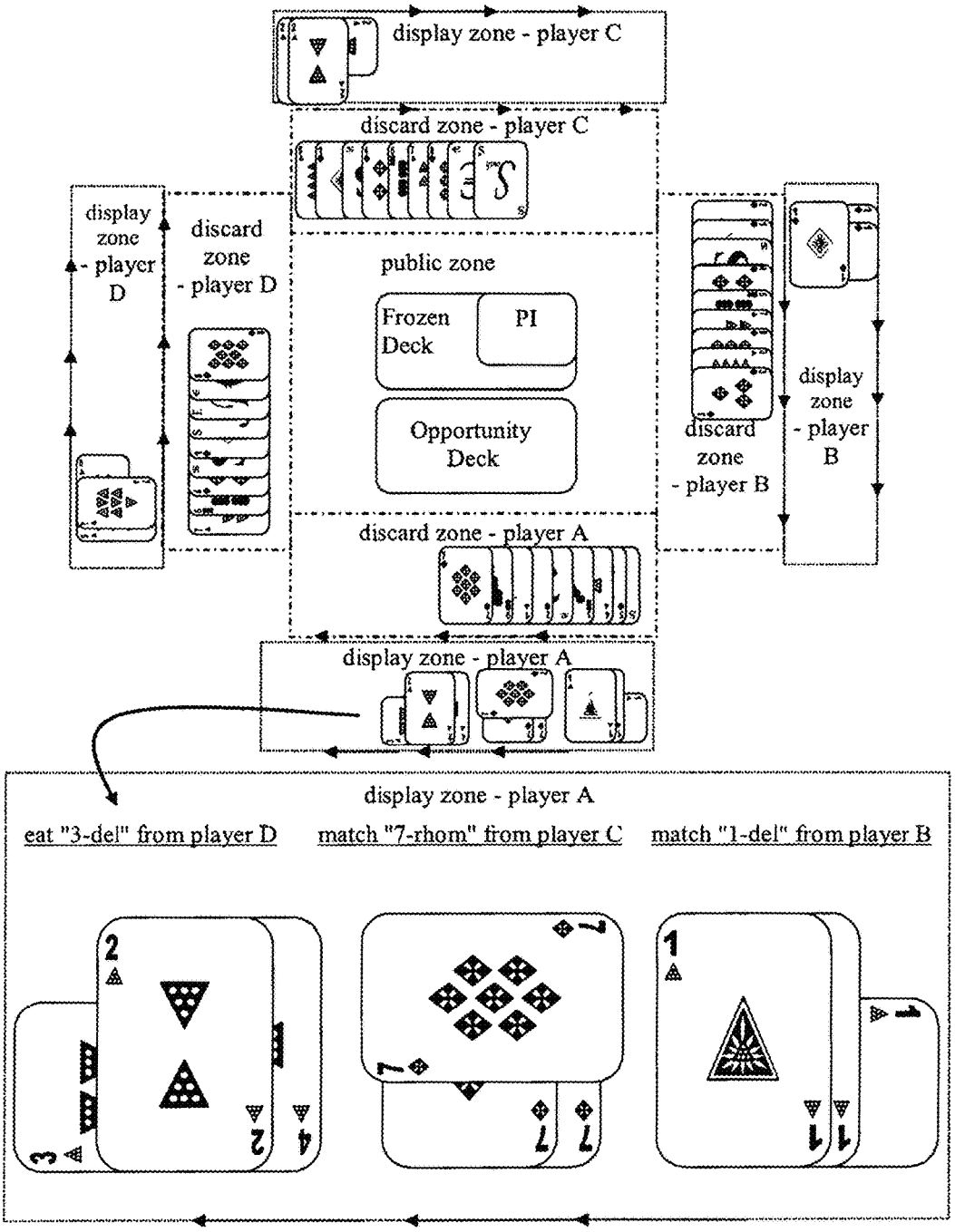
FIG. 6D illustrates the methods of displaying melds in the Display Zone.
Figure 6E:
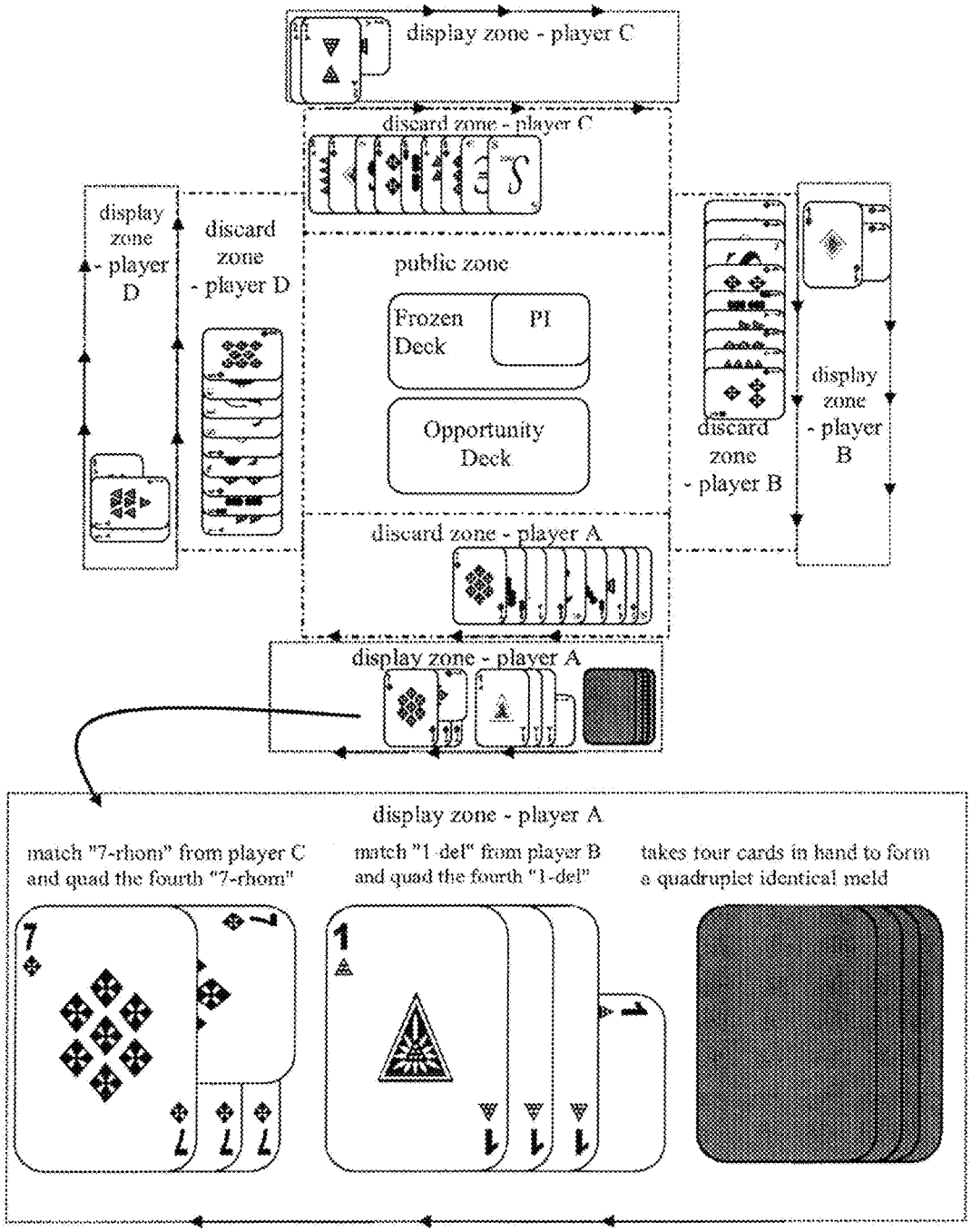
FIG. 6E illustrates the methods of displaying cards when a player performs quad actions.

The method of operating the Position Indicator comprises the steps of making the "East" side of the indicator toward whoever rolls dices, rolling dices to determine "East" position, finding "East" position that is the side of the indicator including a number same as the sum of the dices, and turning the "East" side of the indicator toward the player at "East" position. In each play, the indicator is operated by dealer who is also in charge of placing the indicator at correct position and on top of the Frozen Deck (see FIG. 6B), which is a deck of cards not used in a play and placed face-down in the center of a playing table, to keep the cards inactive and untouchable.

Figure 1A:
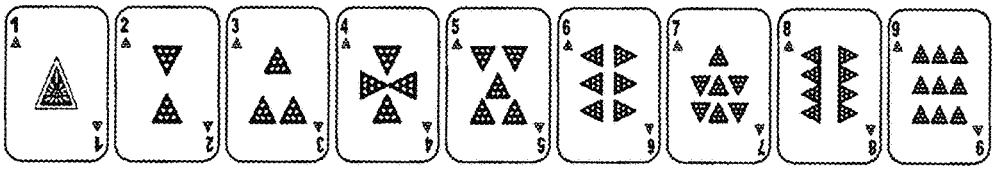
FIG. 1A illustrates Delta suit containing cards rank one through nine by depicting delta symbols and numbers
Figure 1B:
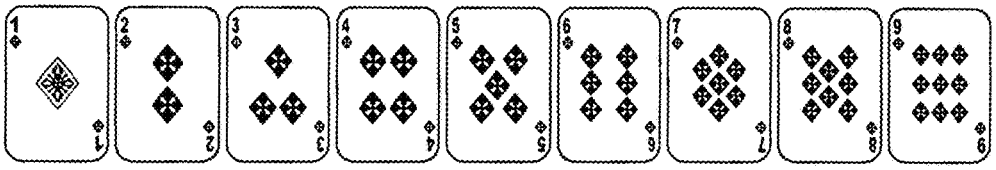
FIG. 1B illustrates Diamond suit containing cards rank one through nine by depicting rhombus symbols and numbers
Figure 1C:
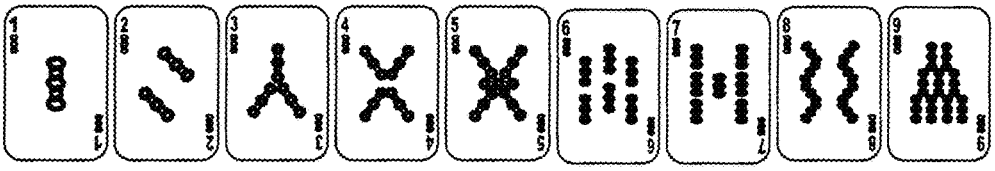
FIG. 1C illustrates Stick suit containing cards rank one through nine by depicting stick symbols and numbers

The game components consist of cards having markings on one side. Based on the markings, the 148 cards for regular game comprise seven suits, which are classified into Shape, Character, and Bonus categories as shown in FIG. 1. Shape category contains the cards identified by the number of suit symbols, which are divided into three suits—Delta suit with delta ("del") symbols as shown in FIG. 1A, Diamond suit with rhombus ("rhom") symbols as shown in FIG. 1B, and Stick suit with stick ("rod") symbols as shown in FIG. 1C. Each suit contains cards rank one through nine by depicting its suit symbols, and, with the numeric value feature, this category cards can be used to form straight meld, which cannot be formed by other category cards. Because each rank has four identical cards, each suit contains 36 cards, and the total number of cards in Shape category is 108 (=36 Delta-suit cards+36 Stick-suit cards+36 Diamond-suit cards). In the game, players combine the rank and the symbol as the names for the cards of this category. For examples, "three-rhom" for the card with three rhombus symbols, "two-del" for the card with two delta symbols, and "six-rod" for the card with six stick symbols.

Figure 1D:
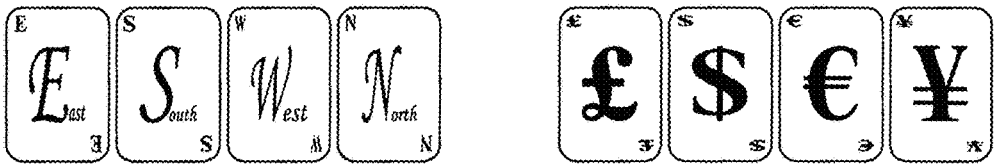
FIG. 1D illustrates Character-category cards, which include Position-suit cards with word characters and Money-suit cards with currency signs

Character category contains the cards identified by the character features, and there are Position suit with word characters and Money suit with currency signs as shown in FIG. 1D. Position suit contains cards featuring player positions, that is, East, South, West, and North, and because each position has four identical cards, Position suit contains 16 cards. Money suit contains cards featuring four kinds of currency, that is, Pound, US dollar, Euro dollar, and Japanese Yen by depicting the currency signs, £, $, € , and ¥, respectively. Because each kind of currency has four identical cards, Money suit contains 16 cards. The total number of cards in Character category is 32 (=16 Position-suit cards+16 Money-suit cards). In the game, players use the characters to name the cards of this category. For examples, "east" is the name for the card with "East" marking, and "Pound" is the name for the card with "£" currency sign. When a player forms an identical meld with this category cards, he/she may earn a point of bonus if the meld is formed by the same character as his/her player position in the play or as the position of prevailing round, which is the round that players are playing.

Figure 1E:
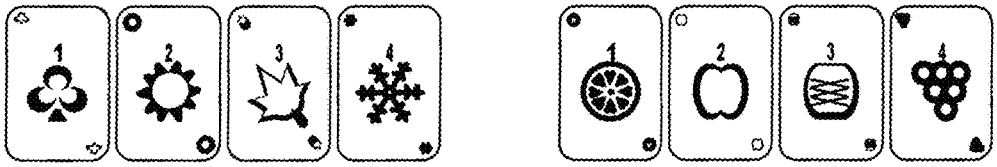
FIG. 1E illustrates Bonus-category cards, which include Season-suit cards with symbols representing four different seasons and Fruit-suit cards with symbols representing four different kinds of fruits.
Figures 1, 1A:
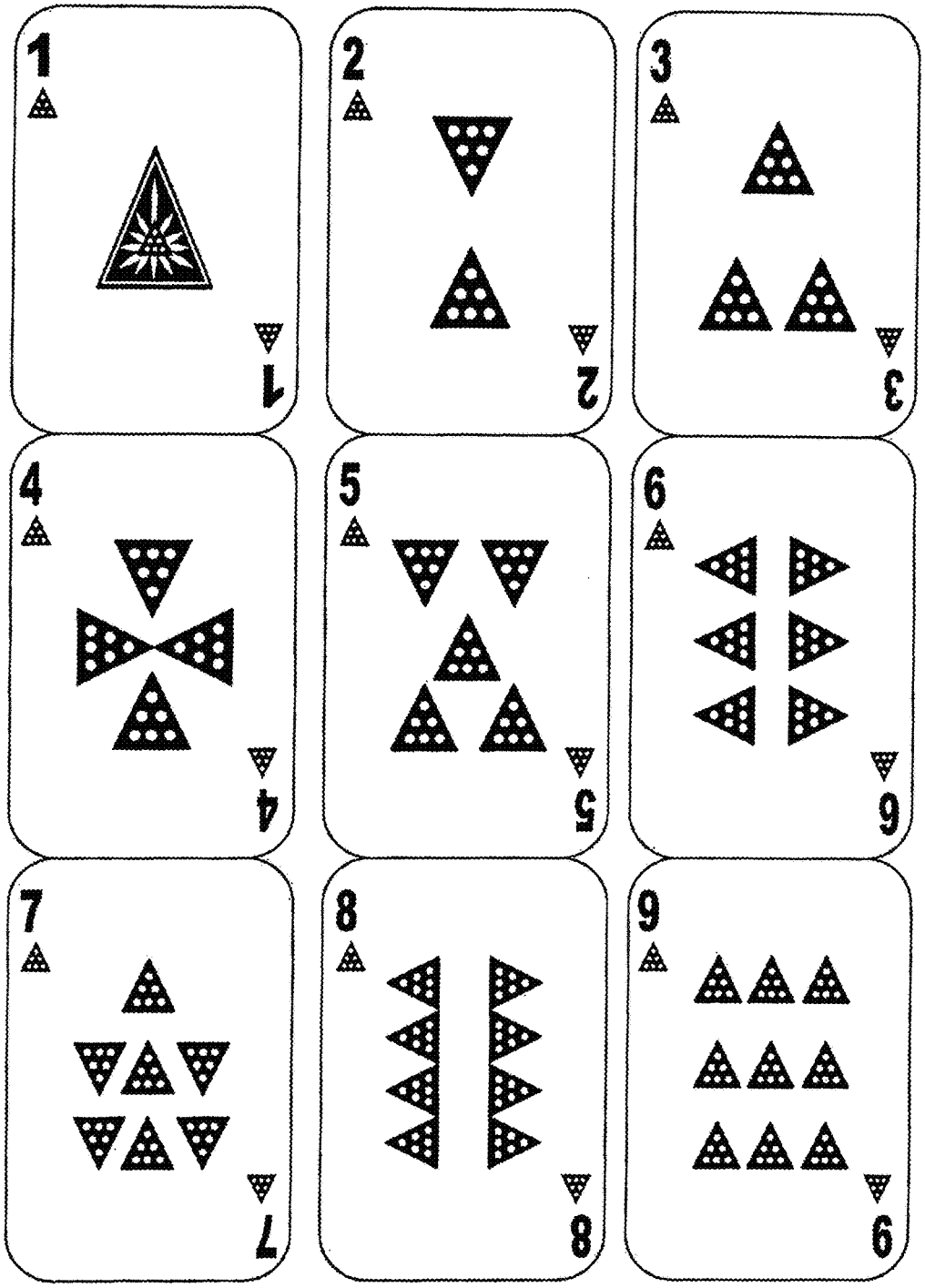
FIG. 1 illustrates all markings of the cards for regular play comprising seven suits, which are classified into Shape, Character, and Bonus categories.
Figures 1, 1D:
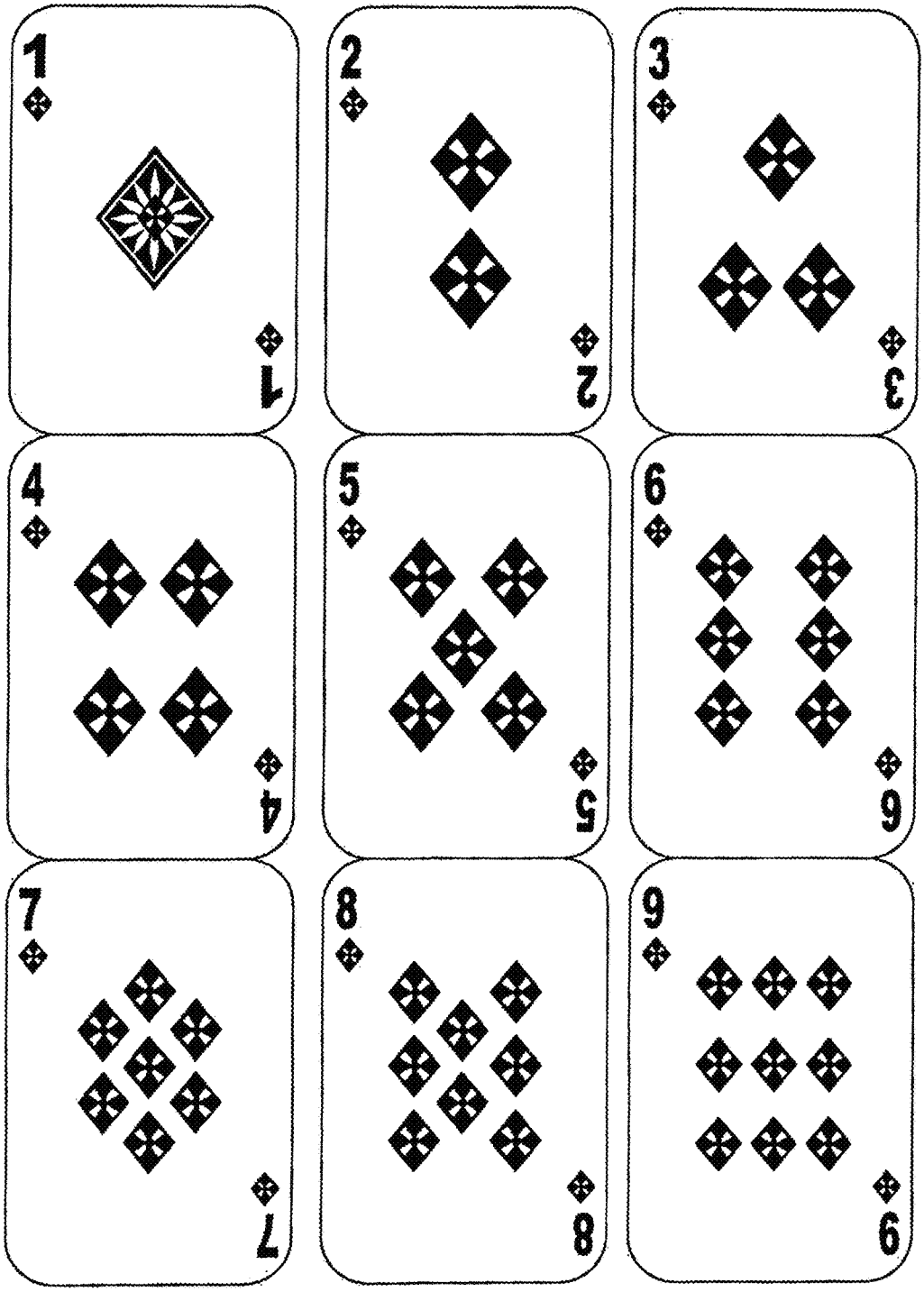
Figures 1, 1C:
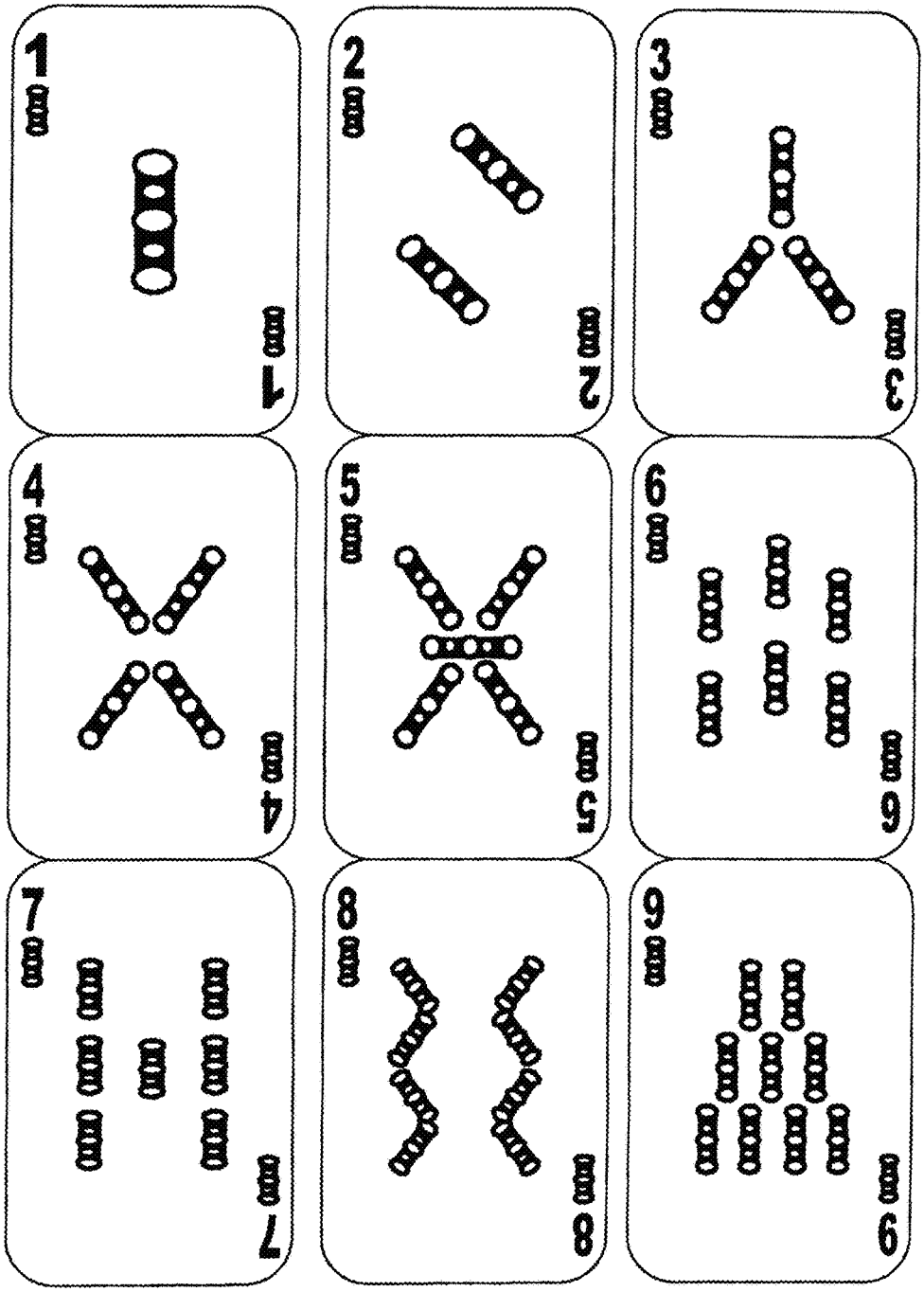
Figure 1D:
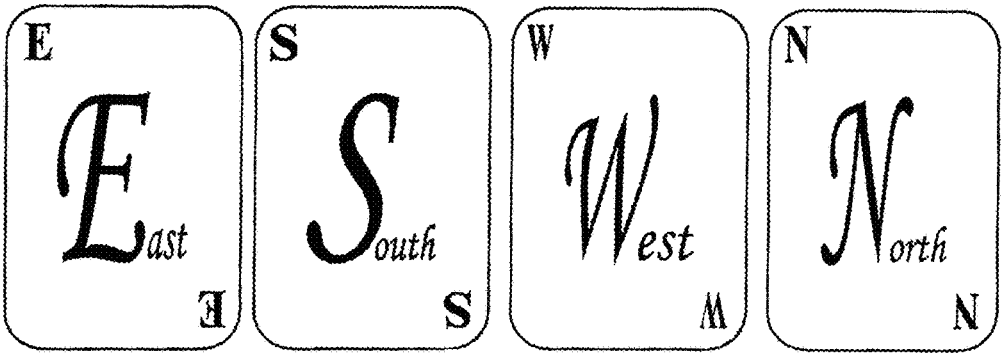
Figure 1:
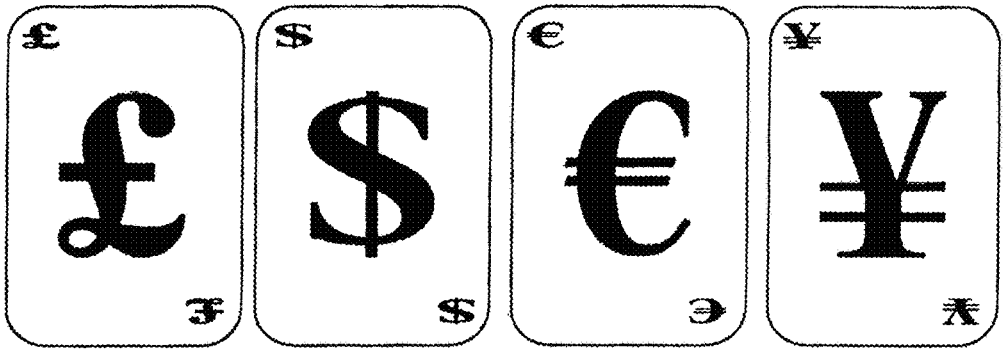
Figures 1, 1E:
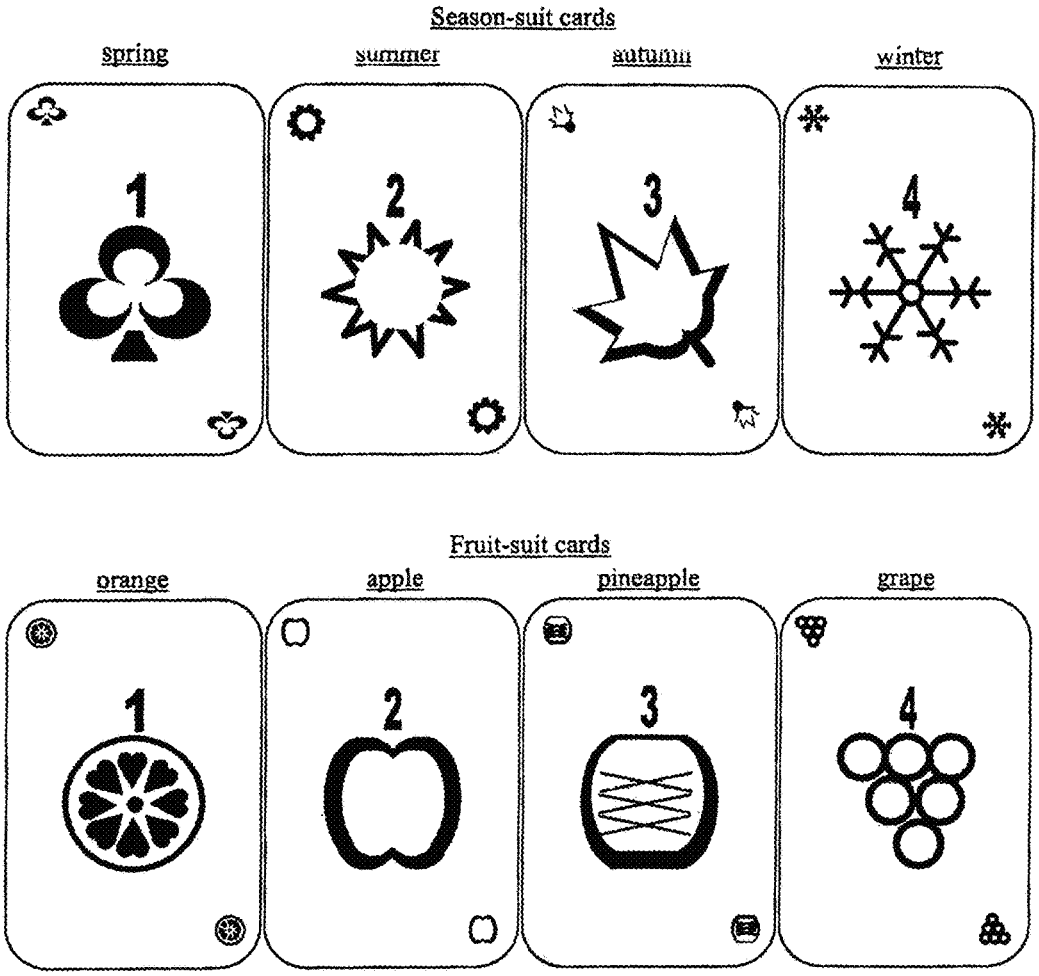
Figure 1F:
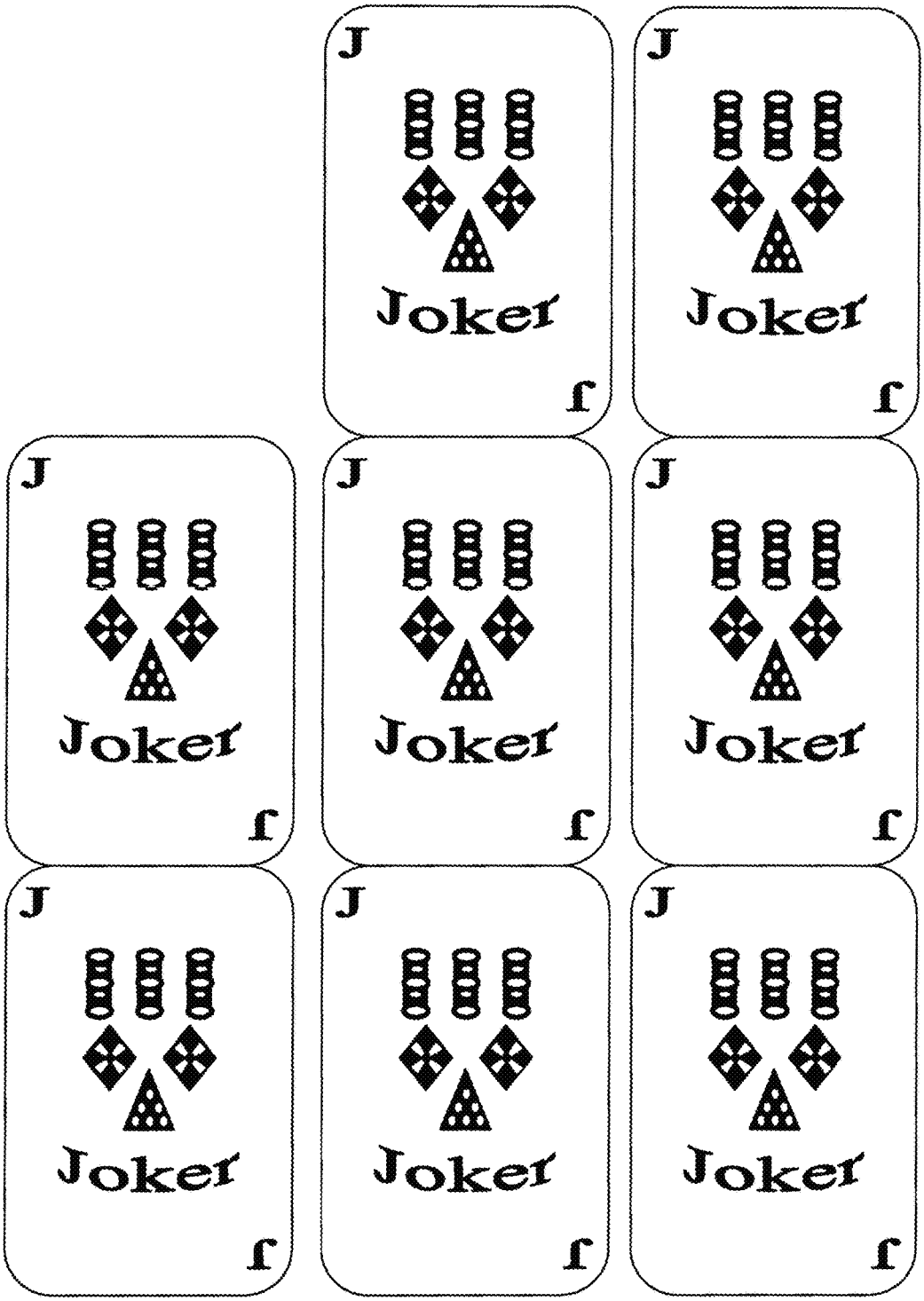
FIG. 1F illustrates eight joker cards.

Bonus category contains cards identified by the symbols representing seasons and fruits as shown in FIG. 1E. Season suit contains four cards representing four different seasons: (1) spring, (2) summer, (3) autumn, and (4) winter. Each season is assigned a number to match bonus number for player position shown on the Position Indicator. Fruit suit contains four cards representing four different fruits: (1) orange, (2) apple, (3) pineapple, and (4) grape. Each fruit is assigned a number to match bonus number for player position shown on the Position Indicator. The total number of cards in Bonus category is 8 (=4 Season-suit cards+4 Fruit-suit cards). When a player holds a Season-suit or Fruit-suit card denoting a number matching his/her bonus number for player position shown on the Position Indicator, the card earns one point of bonus. In the game, players name this category cards by the symbols standing for. For examples, "Autumn" is the name for the card with maple leaf symbol, and "Orange" is the name for the card with orange symbol. This category cards cannot be discarded or used to form meld or pair, and when a player draws a Bonus-category card, he/she should reveal the card in the specific display area of a playing table and replenish a card from the Opportunity Deck (see FIG. 6B), which is a deck of cards placed face-down in the center of a playing table to let players draw during a play.

The Bonus Table as shown in FIG. 4 is a table containing the information relating to each kind of bonus, and the information includes the categories of bonuses, the names of bonuses, the point(s) associated with bonuses, the level(s) each bonus can be counted in, and the rank(s) each bonus can be played with. The bonuses played in the game are defined below in the section of III. Format of the Game and illustrated by the accompanying drawings.

III. Format of the Game

Based on the difficulty level of forming the required melds, the amount of payoff/payout, and the skills needed, the game can be at players' choice to play at different ranks, types, and levels as shown in FIG. 7A. Ranks mean the difficulty levels caused by the number of cards that dealer initially dispenses to each player in the beginning of each play. The game can play in three different ranks, which are 10-cards game, 13-cards game, or 16-cards game. 10-cards game is easier to accomplish a complete hand than 13-cards game or 16-cards game because fewer cards a player has on hand, fewer melds a player needs to form. The differences of the ranks are (1) the number of cards dispensed by dealer in the beginning of each play: Dealer dispenses each player ten cards in 10-cards game, thirteen cards in 13-cards game, and sixteen cards in 16-cards game; and (2) the number of melds and pair required to accomplish a complete hand: 10-cards game requires three melds and a pair, 13-cards game requires four melds and a pair, and 16-cards game requires five melds and a pair.

There are two types of the game, open and closed, and it is determined by the limitation of the amount of payoff/payout in the game. In the open game, the amount of payoff/payout is unlimited. Winner of each play can always receive payoff, and loser in each play must give payout to winner. In the closed game, the amount of payoff/payout is limited. That is, players predetermined a total of points evenly distributed to players, so each player's maximum loss is ¼ of the total points. Loser of a play is obligated to give payout until a maximum loss is reached. When a player reaches maximum loss and becomes a loser in a play, he/she does not give payout. Therefore, because of maximum loss limitation, winner of a play may not receive payoff, or may receive partial of the payoff. Whenever there are three players reaching maximum loss, a player has got the total points predetermined, and the game is over.

Bonus Values:

(1) "Season" bonus, which happens when a Season-suit card with a number matches a player's bonus number for player position (2) "Fruit" bonus, which happens when a Fruit-suit card with a number matches a player's bonus number for player position (3) "Money" bonus, which happens when an identical meld is formed by Money-suit cards (4) "Player-position" bonus, which happens when an identical meld is formed by Position-suit cards with the same character as a player's player position in a play (5) "Prevailing-round" bonus, which happens when an identical meld is formed by Character-category cards with the same character as the position of prevailing round (6) "Dealer" bonus, which happens when dealer position is involved. Winner adds one point in payoff calculation, and loser adds one point in payout calculation (7) "Successive" bonus, which happens when dealer successively keeps dealer position because of winning a play or tie in the last play. Dealer position may be successively kept as many times as possible. After being successive, a dealer could be either winner or loser in the next play, and both winner and loser need to count the Successive bonus. For example, if a dealer declares a win at Successive 3, he/she gets four points of bonus (1 point for Dealer bonus+3 points for Successive 3 bonus) in addition to the other bonuses and base pay. However, when the dealer discards a card, which is used by another player to declare a win, the dealer pays four points of bonus in addition to the other bonuses and base pay.

(8) "Bingo" bonus (see FIG. 7D), which happens when the card added in to declare a win is drawn by the winner, not taken from other players (9) "Quad-done" bonus, which happens when winner draws a card and declares a win because of a "quad" action (see FIG. 7D) that a player forms cards as a quadruplet identical meld and draws a card from the Opportunity Deck

(10) "Quad-rob" bonus, which happens when winner declares a win by performing a "quad rob" action (see FIG. 7D). Quad rob action means that winner declares a win by robbing another player's card, which is added to a revealed triplet identical meld to form a quadruplet identical meld.

(11) "Last-card" bonus, which happens when the card that winner draws and declares a win is the last card left in the Opportunity Deck.

Figure 4A:
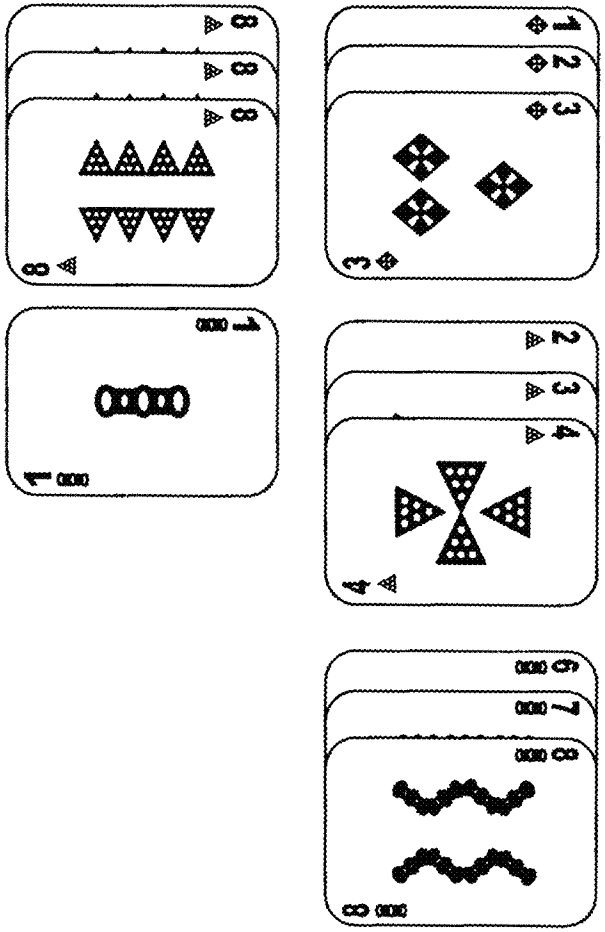
FIG. 4A illustrates the example of All-by-myself bonus in a complete hand.
Figure 4A:
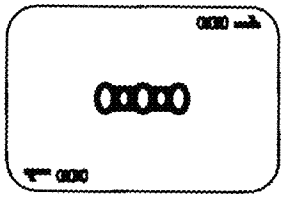

Tactics Bonuses:

(1) "All-by-myself" bonus, which happens when winner did not take in any card from other players before declaring a win. This tactic earns one point. Example is shown in FIG. 4A.

Figure 4B:
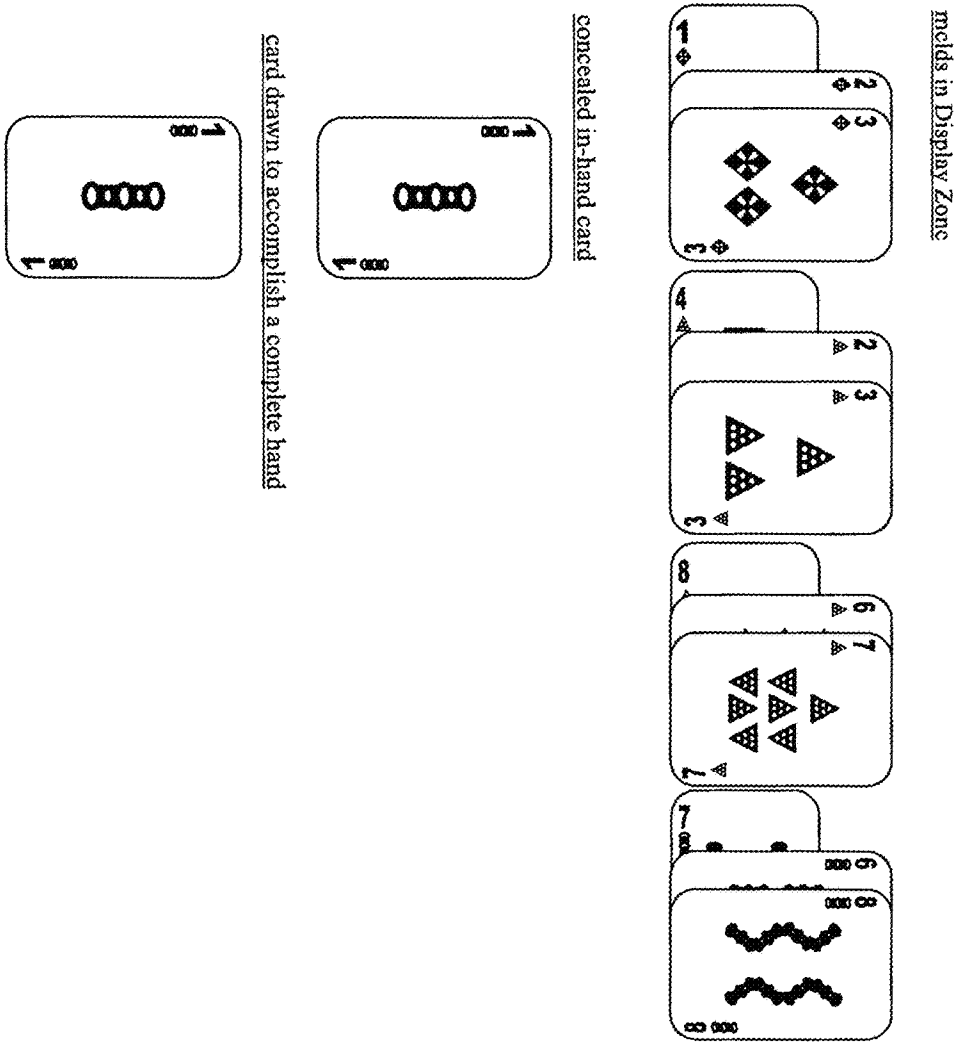
FIG. 4B illustrates the example of the Only-one-concealed bonus when a complete hand is accomplished by drawing a card in 13-cards game.
Figure 4C:
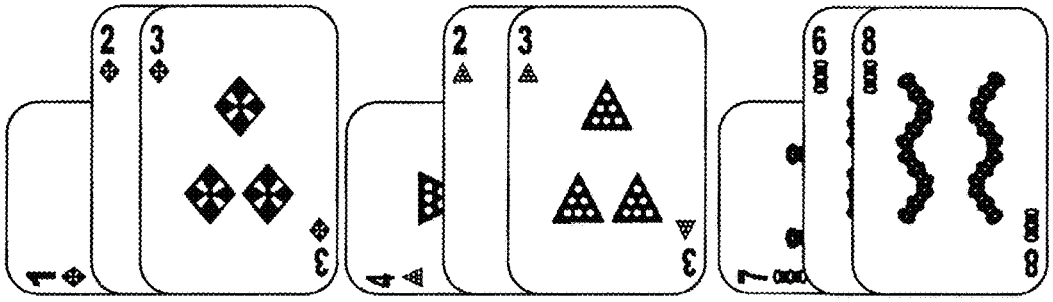
FIG. 4C illustrates the example of the Only-one-concealed bonus when a complete hand is accomplished by taking-in a card.
Figure 4C:
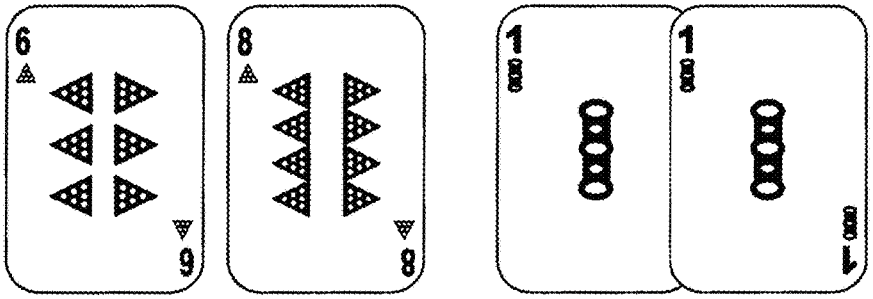
Figure 4C:
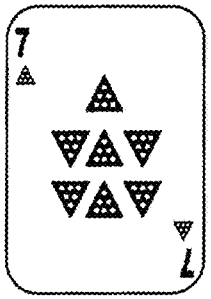

(2) "Only-one-concealed" bonus, which happens when winner accomplishes a complete hand, there is only one meld or pair is concealed, and all other melds or pair are formed by taking in the cards discarded by other players. This tactic earns one point. Examples are shown in FIGS. 4B and 4C.

Figure 4D:
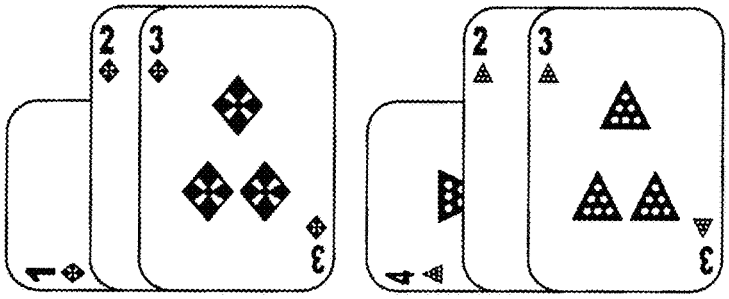
FIG. 4D illustrates the example of the Specific-marking bonus when a complete hand is accomplished in 13-cards game.
Figure 4D:
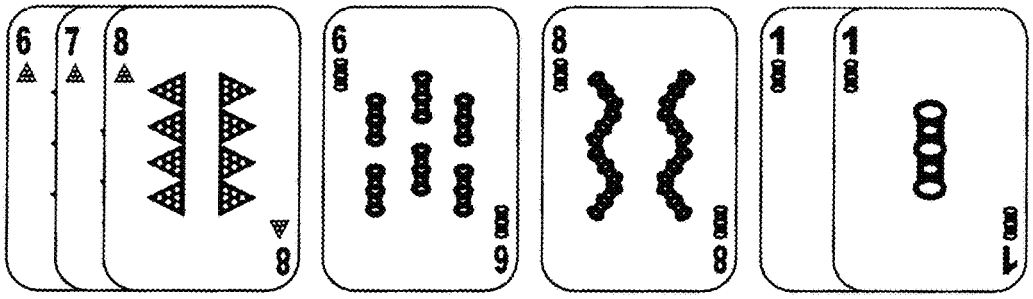
Figure 4D:
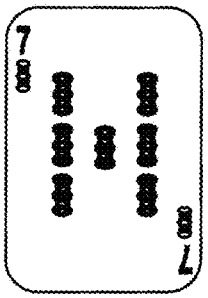

(3) "Specific-marking" bonus, which happens when there is no card can be added in to accomplish a complete hand except the cards with specific marking. This tactic earns one point. Example is shown in FIG. 4D.

Figure 4E:
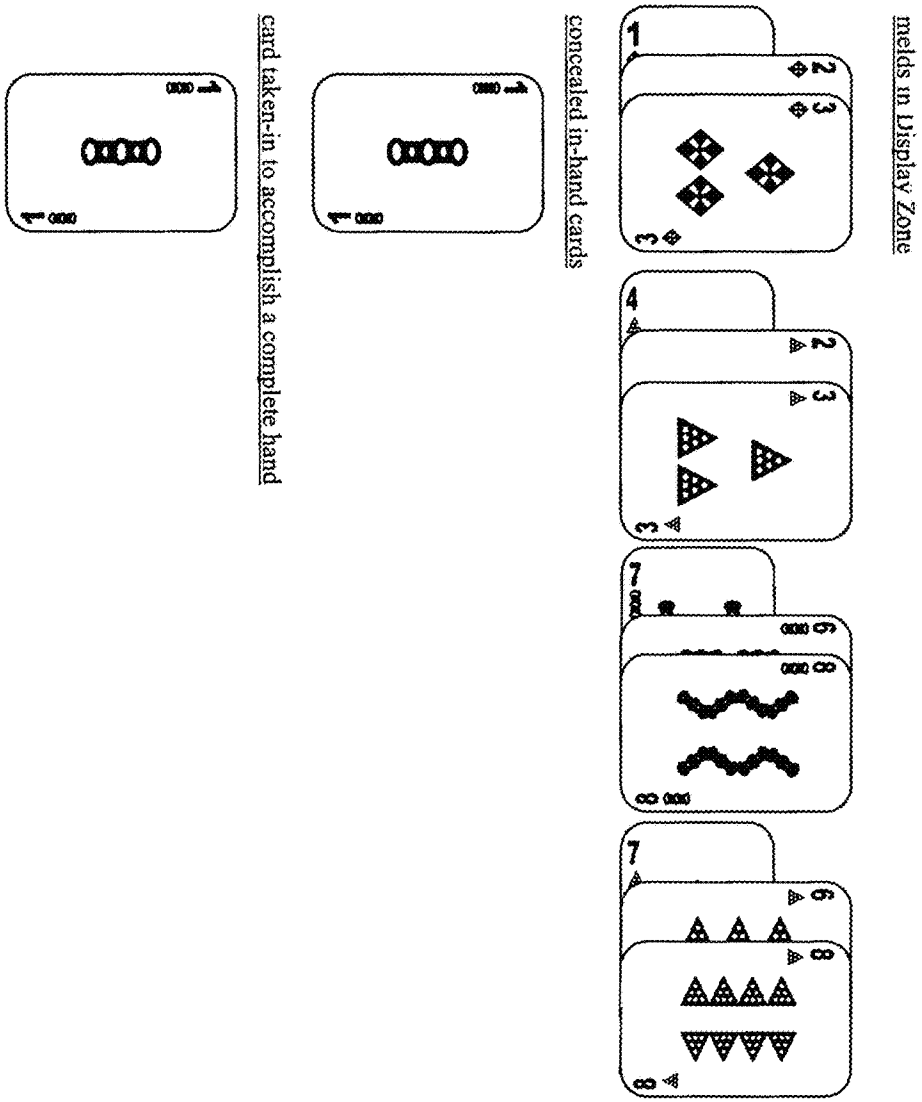
FIG. 4E illustrates the example of the All-from-others bonus when a complete hand is accomplished by taking-in a card in 13-cards game.

(4) "All-from-others" bonus, which happens when all melds and a pair are formed by taking-in the cards discarded or displayed by other players. The bonus does not happen at the time winner declares a win by saying "Bingo". This tactic earns two points. Example is shown in FIG. 4E.

Figure 4F:
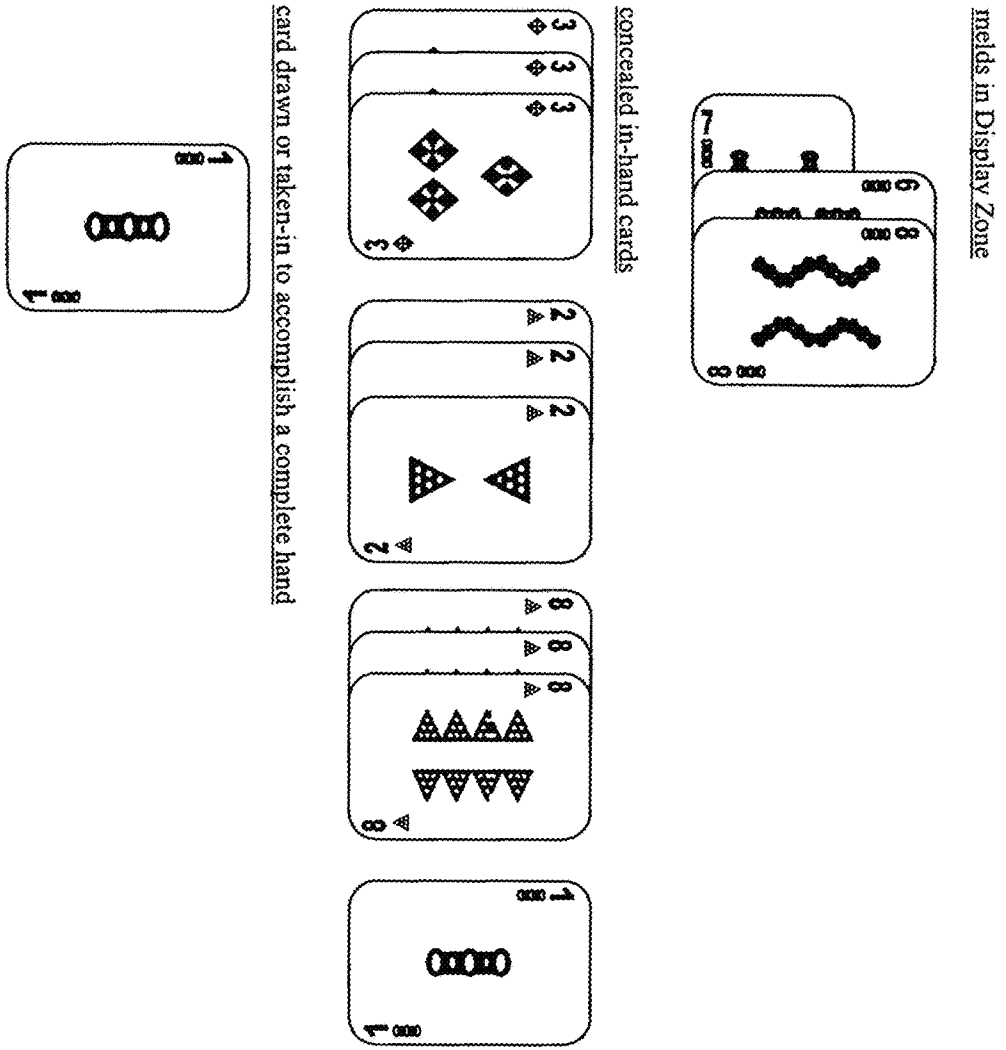
FIG. 4F illustrates the example of the 3CI bonus when a complete hand is accomplished in 13-cards game.

(5) "3CI" bonus, which happens when three concealed identical melds are included in a complete hand. This tactic earns two points. Example is shown in FIG. 4F.

Figure 4G:
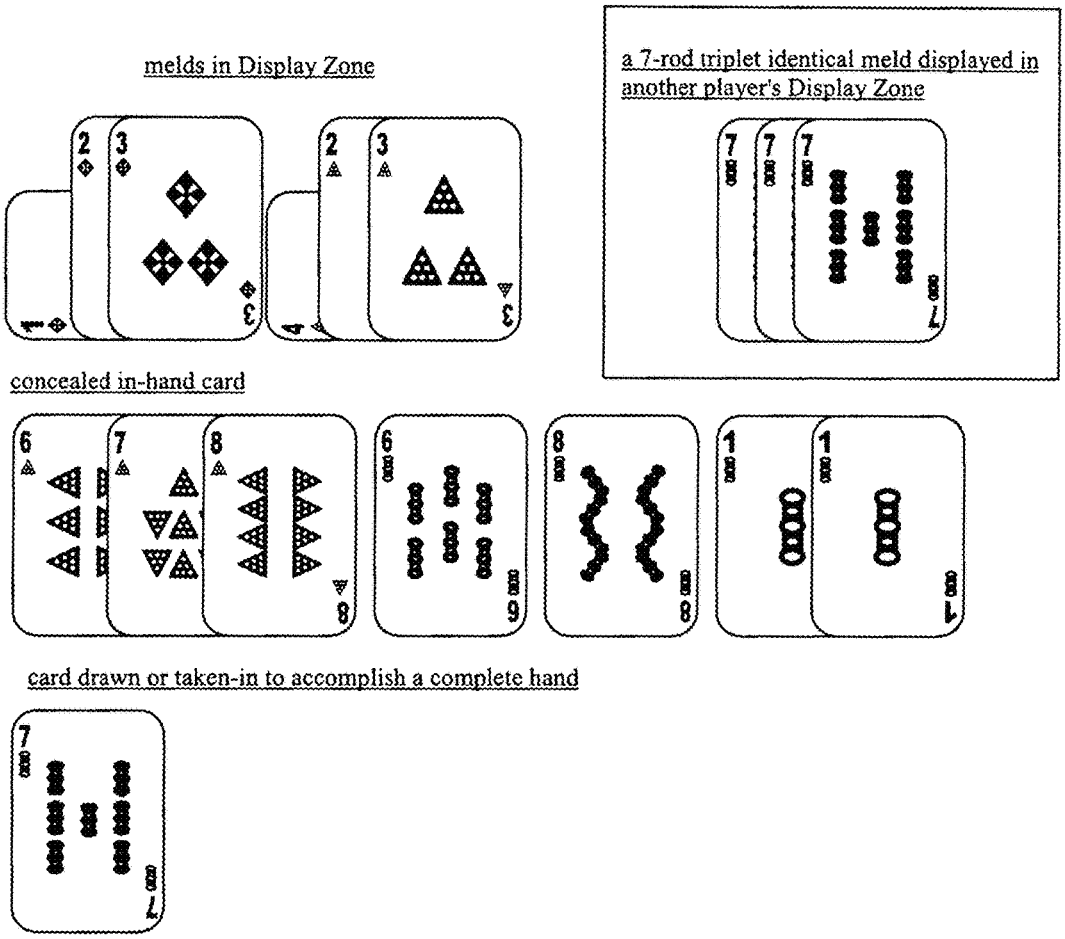
FIG. 4G illustrates the example of the Specific-card bonus when a complete hand is accomplished in 13-cards game.

(6) "Specific-card" bonus, which happens when all other cards that can be added in to accomplish a complete hand are revealed and displayed on the playing table except the card that winner uses to accomplish a complete hand. This tactic earns two points. Example is shown in FIG. 4G.

(7) "4CI" bonus (not for 10-cards game), which happens when four concealed identical melds are included in a complete hand. This tactic earns six points. Example is shown in FIG. 4H.

(8) "Change-once" bonus, which happens when a player, who does not reveal any meld after first drawing and discarding a card, places in-hand cards face-down on the table and announces no more changing of the cards. This tactic earns six points.

Figure 4I:
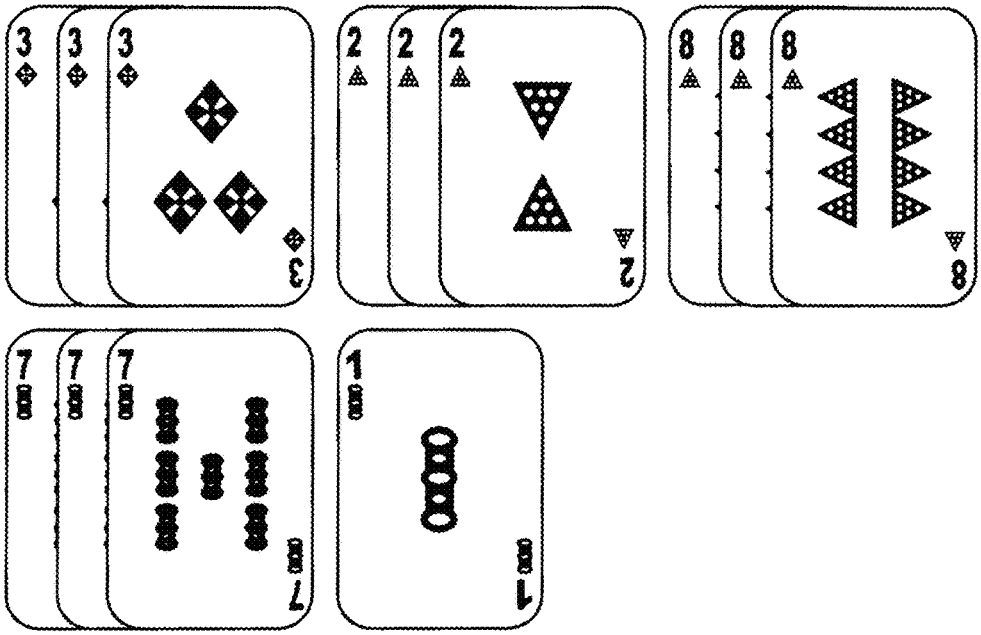
FIG. 4I illustrates the example of the 5CI bonus when a complete hand is accomplished in 16-cards game.
Figure 4I:
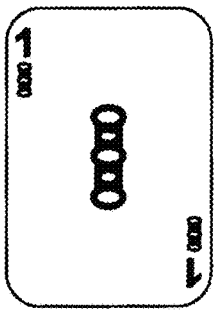
Figure 4I:
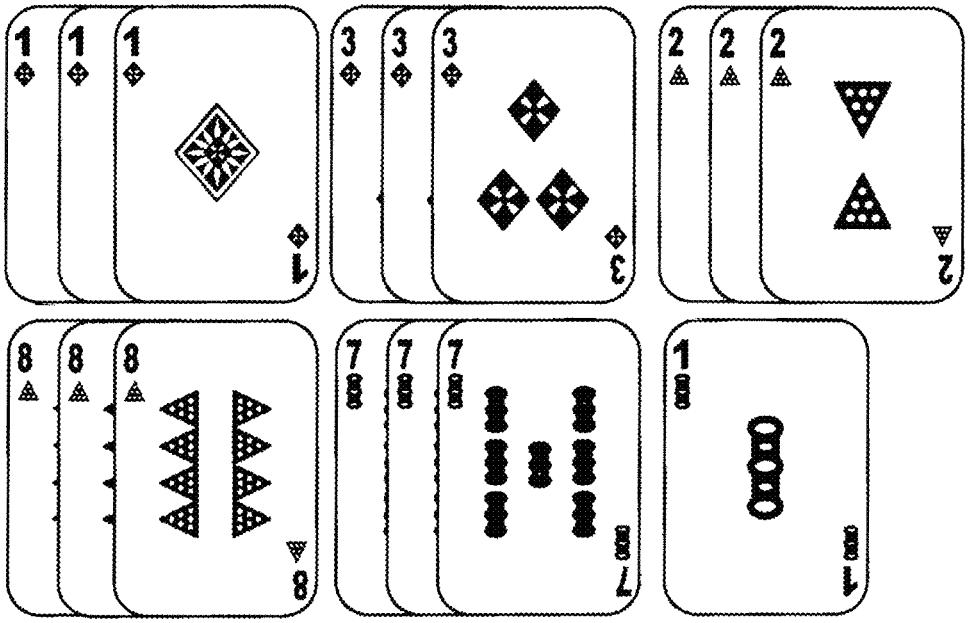
Figure 4I:
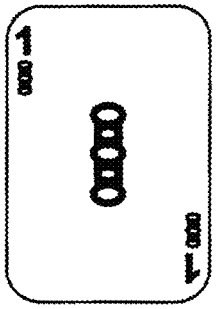

(9) "5CI" bonus (for 16-cards game only), which happens when five concealed identical melds are included in a complete hand. This tactic earns eight points. Example is shown in FIG. 4I.

(10) "Without-change" bonus, which happens when a player, who has not had any action.

Figure 5A:
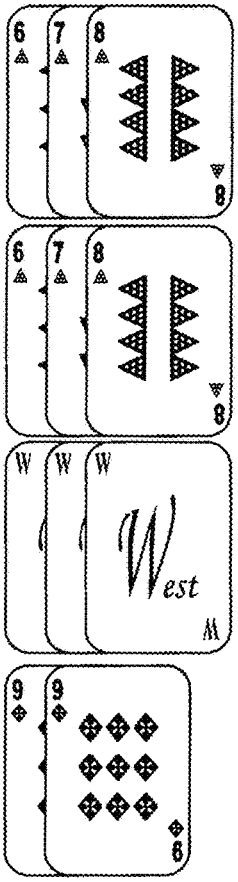
FIG. 5A illustrates the examples of the Double-straight bonus in a complete hand.
Figure 5A:
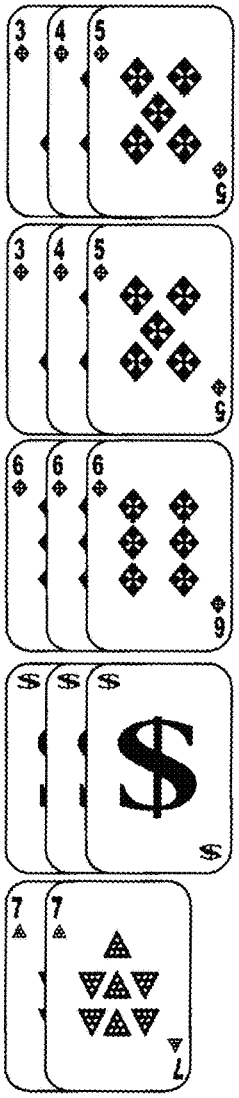
Figure 5A:
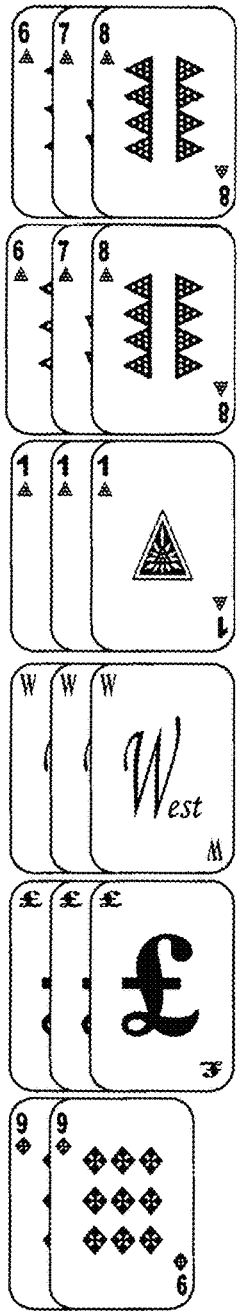

Suit-Pattern Bonuses:

(1) "Double-straight" bonus, which happens when two straight melds with same markings are included in a complete hand. This pattern earns two points. Examples are shown in FIG. 5A.

Figure 5B:
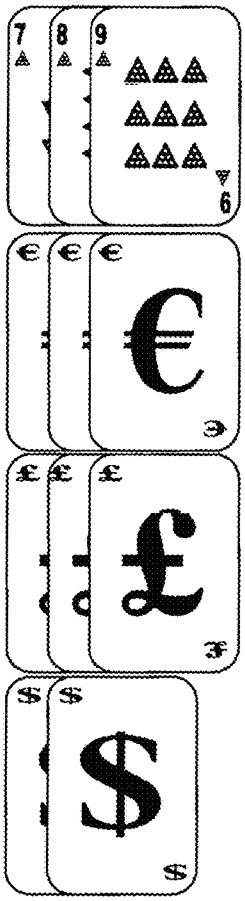
FIG. 5B illustrates the examples of the Small-money bonus in a complete hand.
Figure 5B:
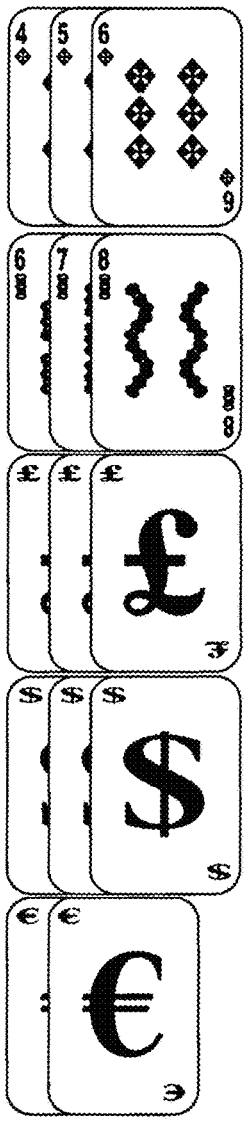
Figure 5B:
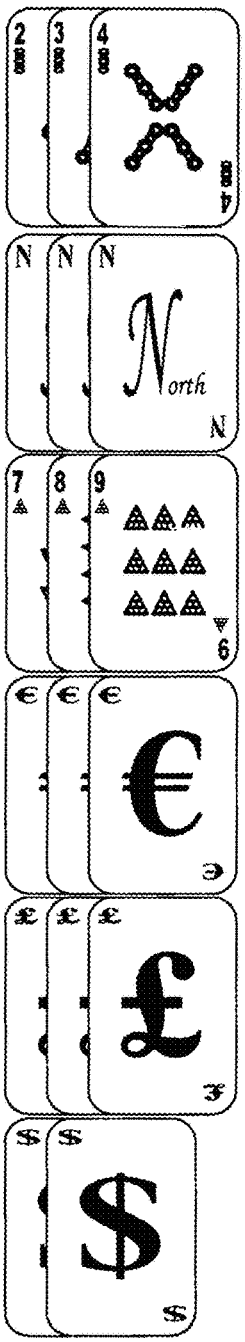

(2) "Small-money" bonus, which happens when two identical melds of Money-suit cards and a pair of Money-suit cards are included in a complete hand. This pattern earns four points. Examples are shown in FIG. 5B.

Figure 5C:
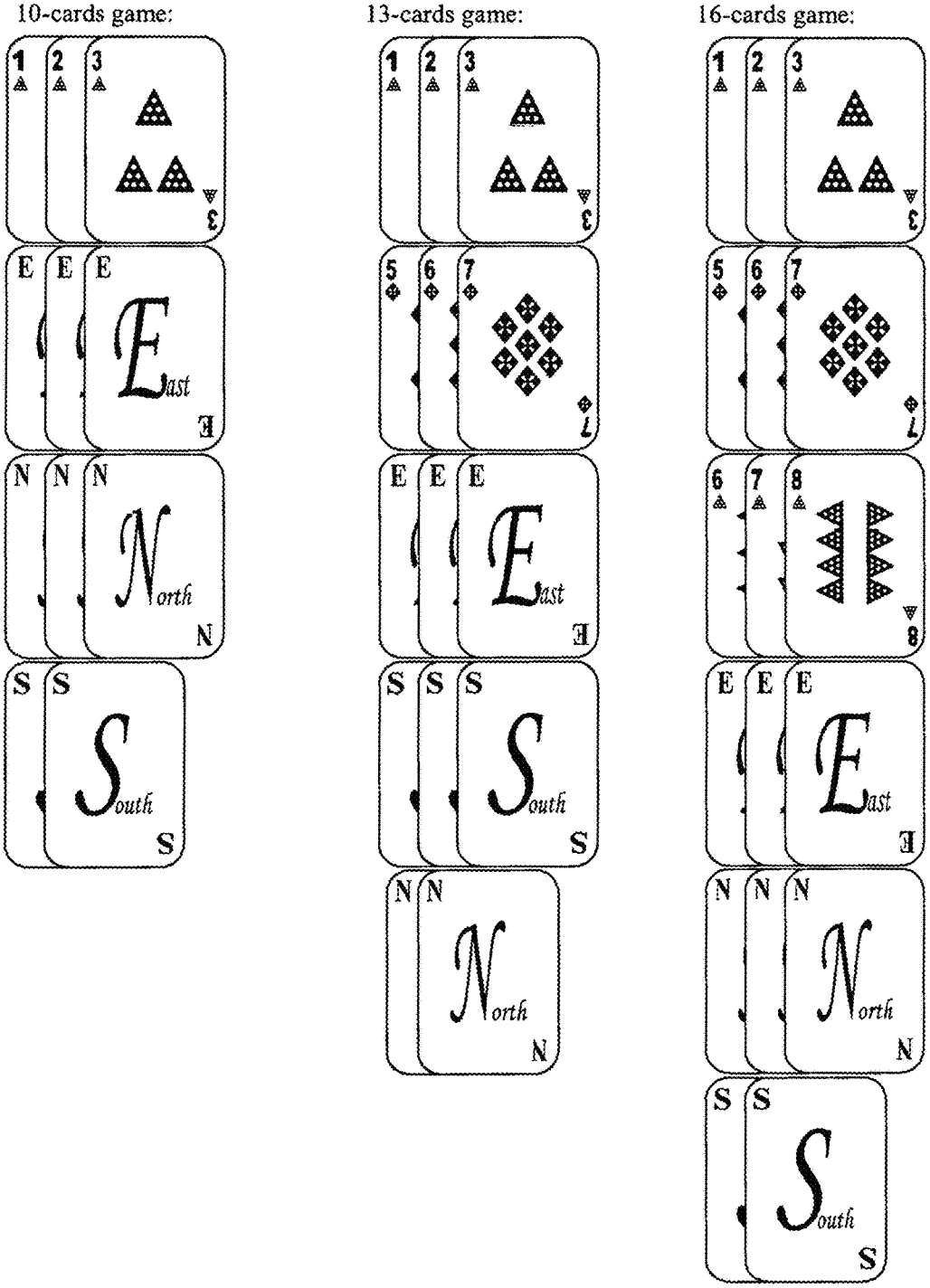
FIG. 5C illustrates the examples of the Small-position bonus in a complete hand.

(3) "Small-position" bonus, which happens when two identical melds of Position-suit cards and a pair of Position-suit cards are included in a complete hand. This pattern earns four points. Examples are shown in FIG. 5C.

Figure 5D:
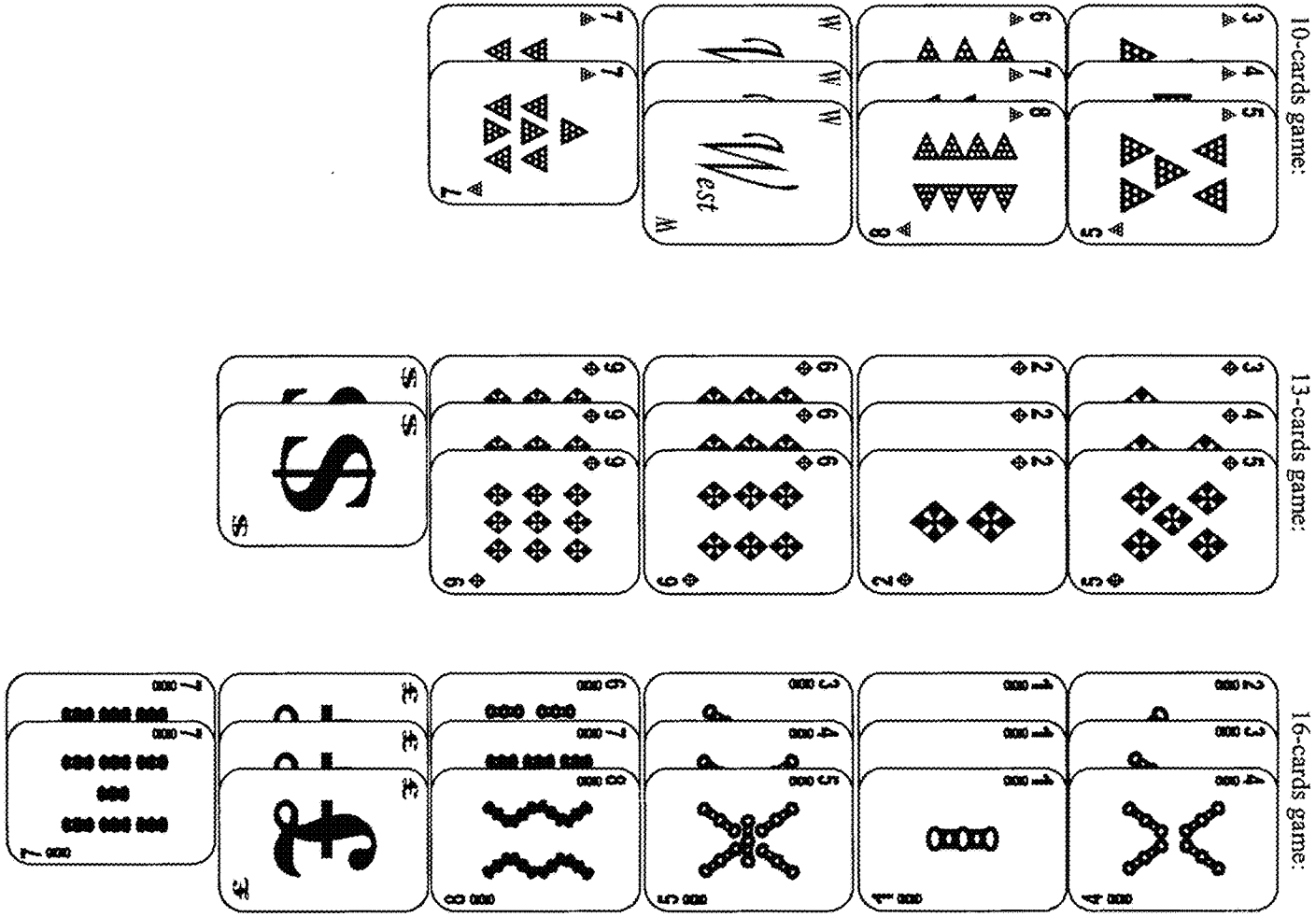
FIG. 5D illustrates the examples of the Almost-flush bonus in a complete hand.

(4) "Almost-flush" bonus, which happens when one meld or pair is formed by Character-category cards and all other cards in a complete hand are in the same suit of the Shape category. This pattern earns four points. Examples are shown in FIG. 5D.

(5) "Four-seasons" bonus, which happens when a player holds all four Season-suit cards. This pattern earns four points.

(6) "Four-fruits" bonus, which happens when a player holds all four Fruit-suit cards. This pattern earns four points.

Figure 5E:
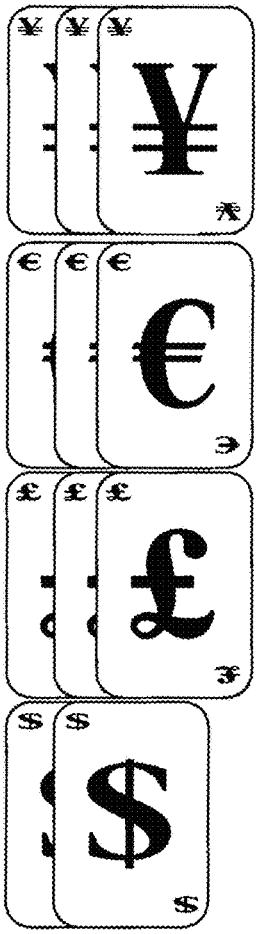
FIG. 5E illustrates the examples of the Good-money bonus in a complete hand.
Figure 5E:
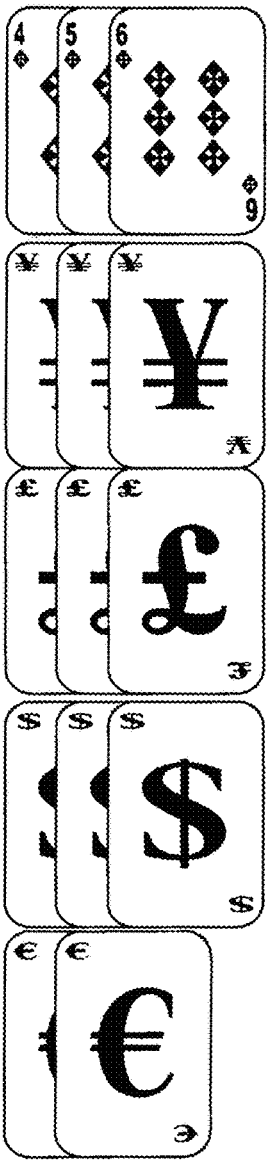
Figure 5E:
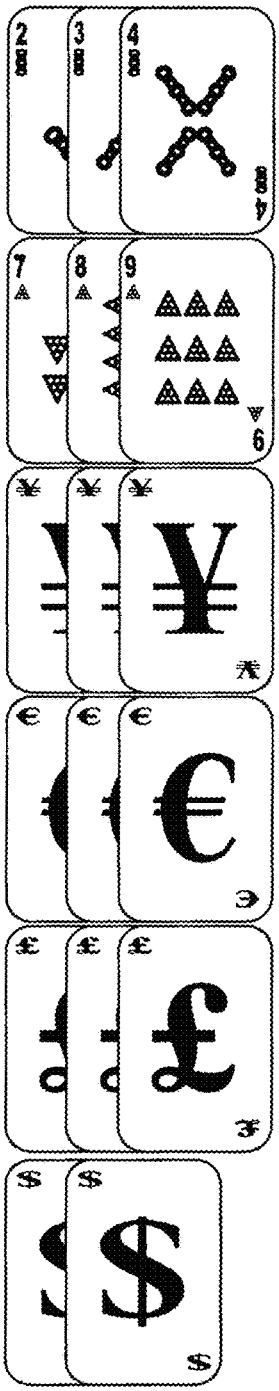

(7) "Good-money" bonus, which happens when three identical melds of Money-suit cards and a pair of Money-suit cards are included in a complete hand. This pattern earns six points. Examples are shown in FIG. 5E.

Figure 5F:
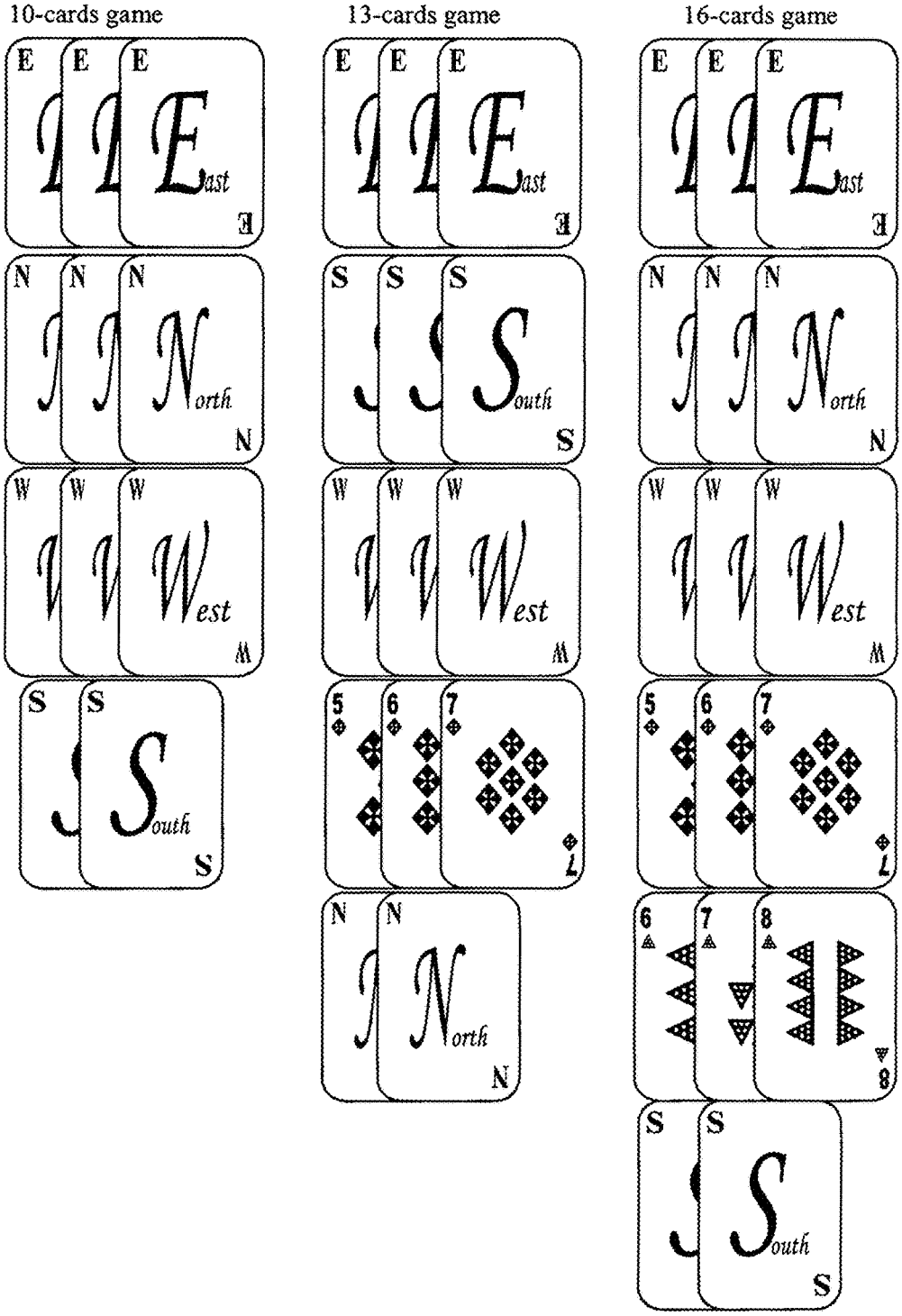
FIG. 5F illustrates the examples of the Good-position bonus in a complete hand.

(8) "Good-position" bonus, which happens when three identical melds of Position-suit cards and a pair of Position-suit cards are included in a complete hand. This pattern earns six points. Examples are shown in FIG. 5F.

Figure 5G:
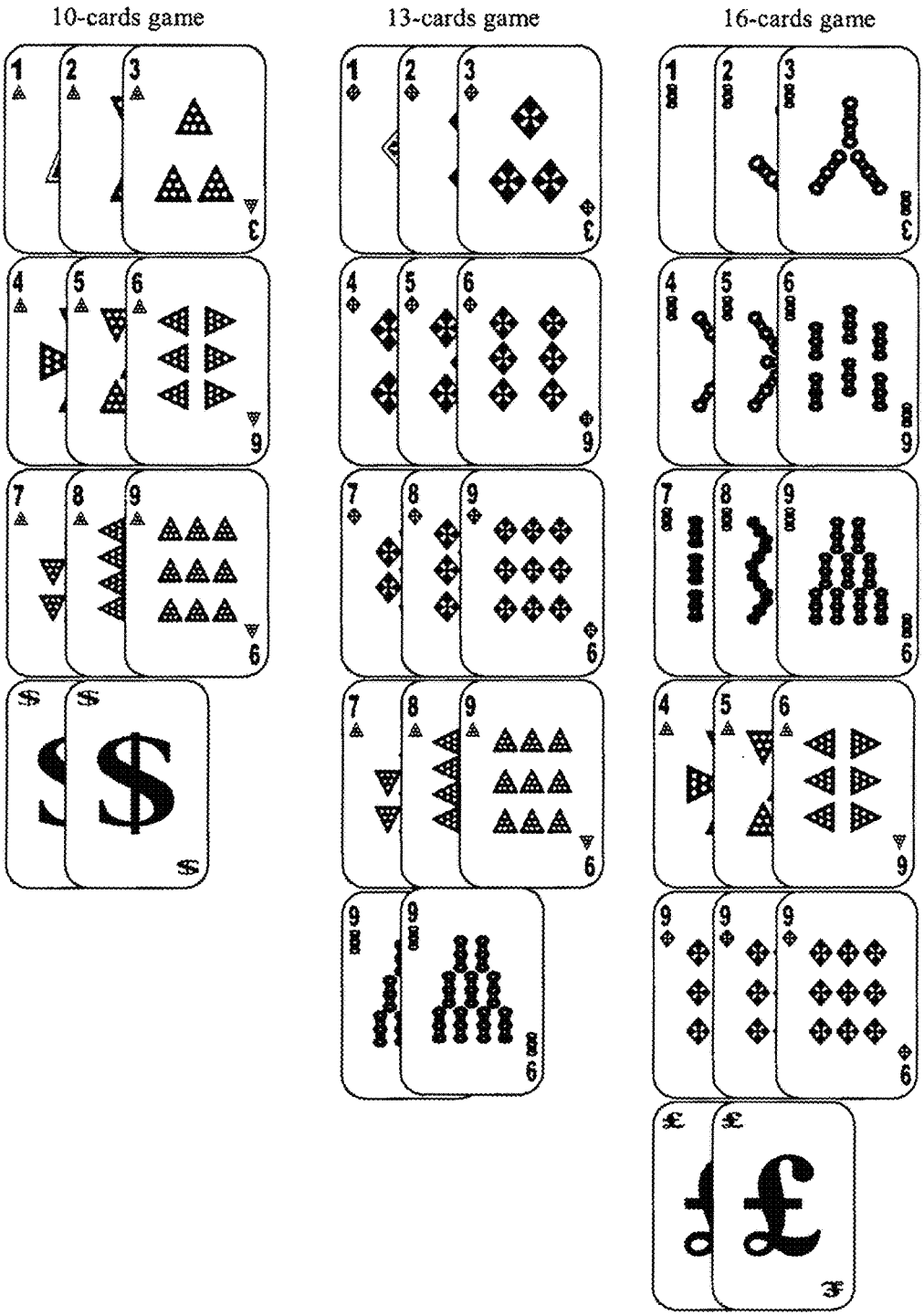
FIG. 5G illustrates the examples of the Straight-9-flush bonus in a complete hand.

(9) "Straight-9-flush" bonus, which happens when three straight melds formed by cards rank one through nine of a suit are included in a complete hand. This pattern earns six points. Examples are shown in FIG. 5G.

Figure 5H:
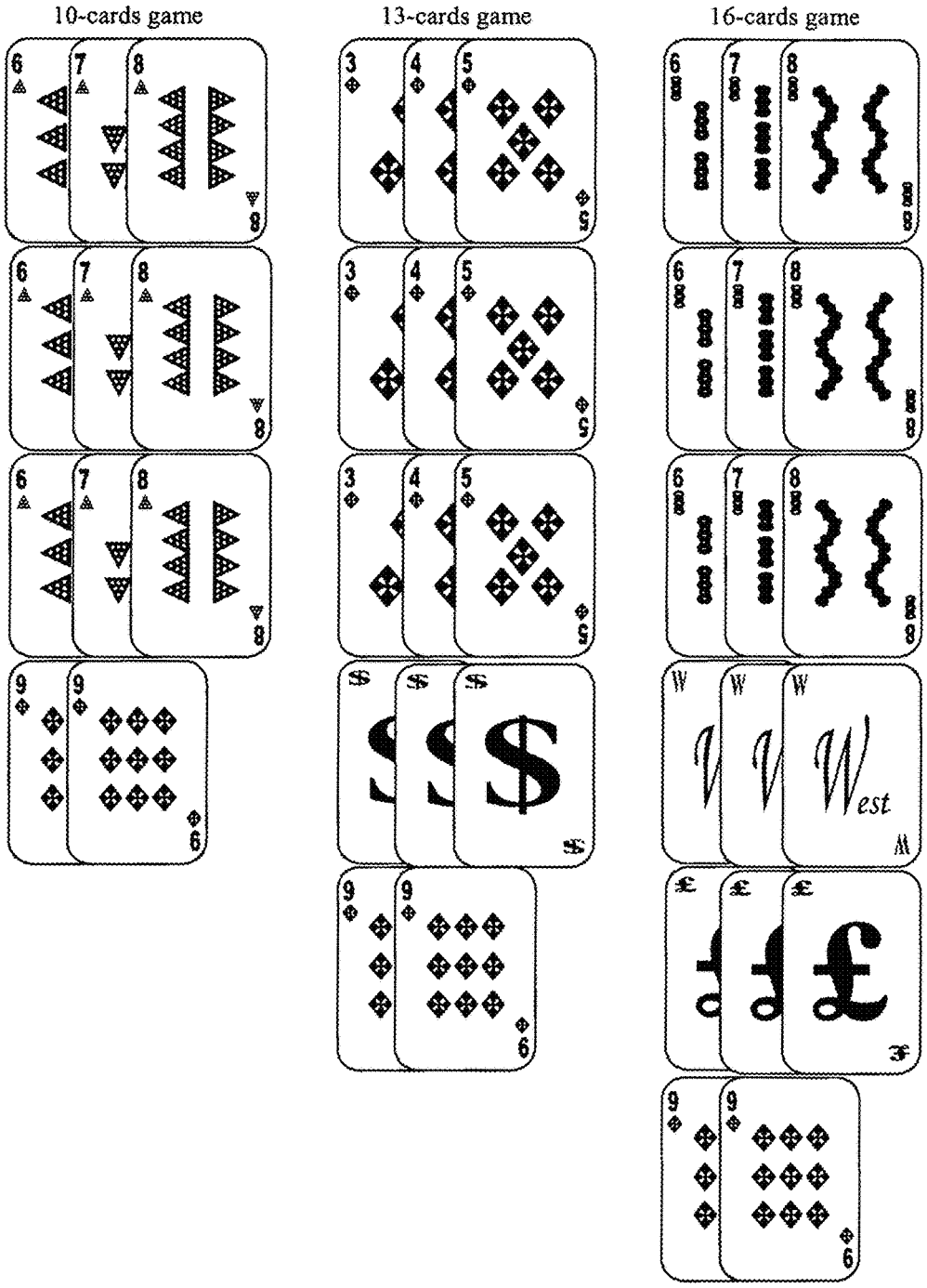
FIG. 5H illustrates the examples of the Triple-straight bonus in a complete hand.

(10) "Triple-straight" bonus, which happens when three straight melds with same markings are included in a complete hand. This pattern earns six points. Examples are shown in FIG. 5H.

Figure 5I:
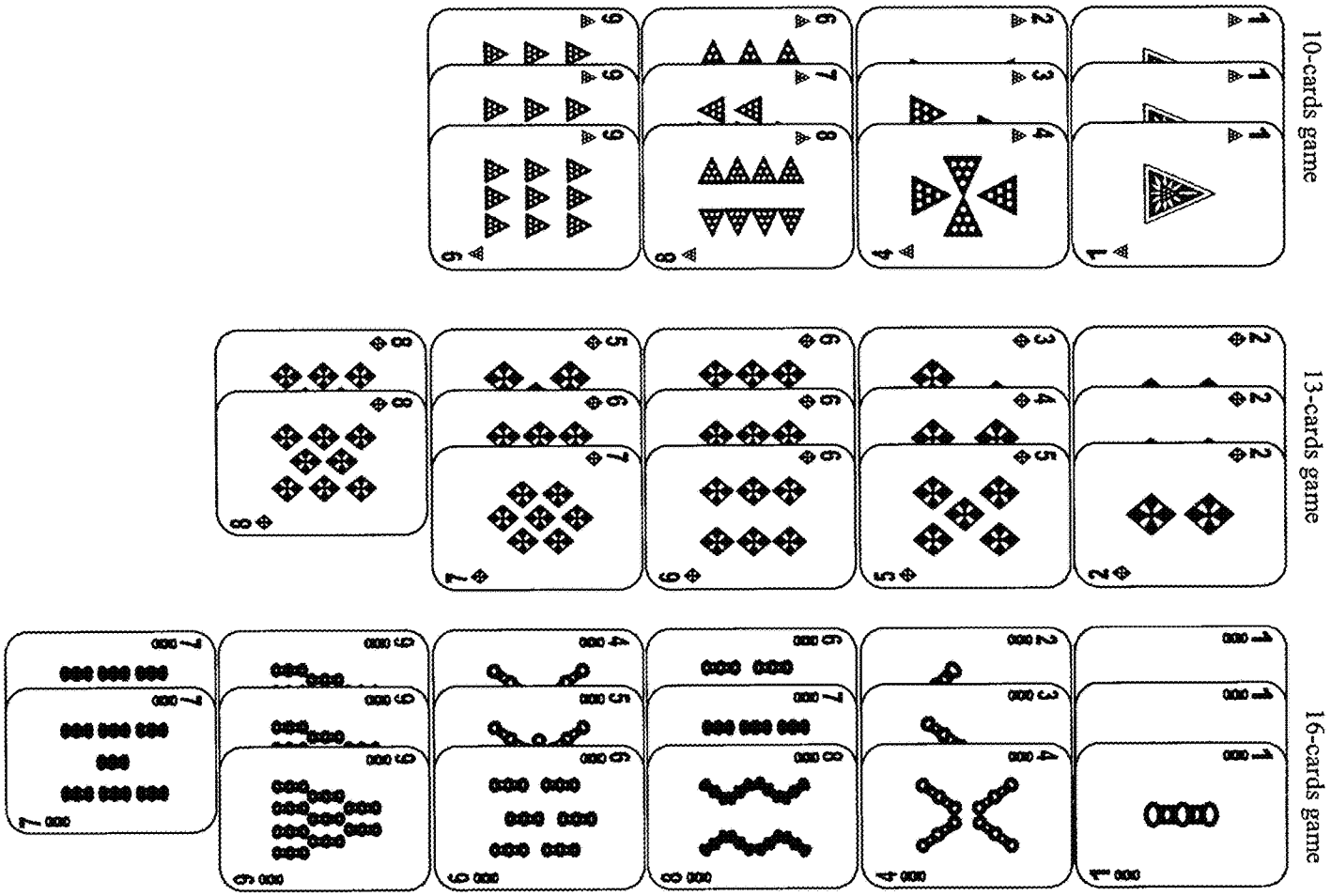
FIG. 5I illustrates the examples of the Flush bonus in a complete hand.

(11) "Flush" bonus, which happens when all cards in a complete hand are in the same suit of the Shape category. This pattern earns eight points. Examples are shown in FIG. 5I.

Figure 5J:
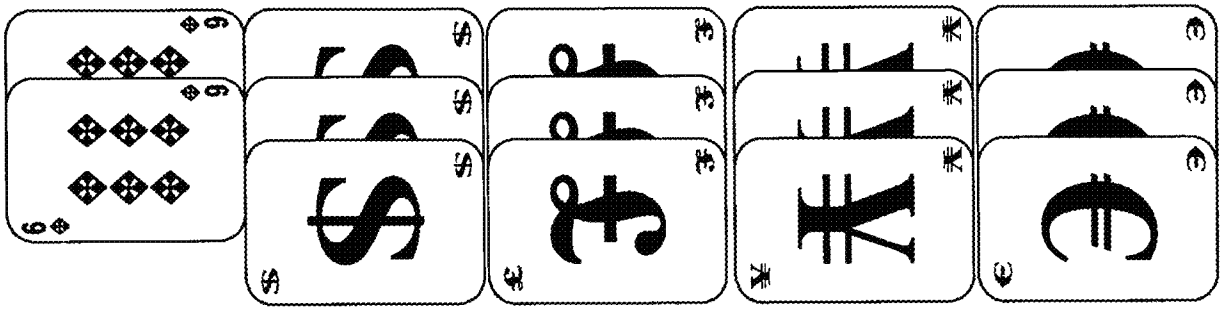
FIG. 5J illustrates the examples of the Big-money bonus in a complete hand.
Figure 5J:
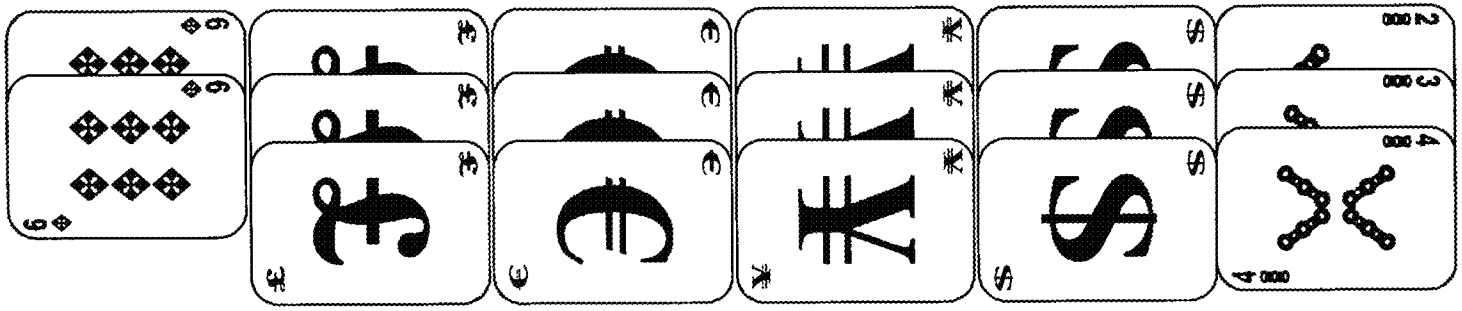

(12) "Big-money" bonus (not for 10-cards game), which happens when four identical melds of Money-suit cards are included in a complete hand. This pattern earns eight points. Examples are shown in FIG. 5J.

Figure 5K:
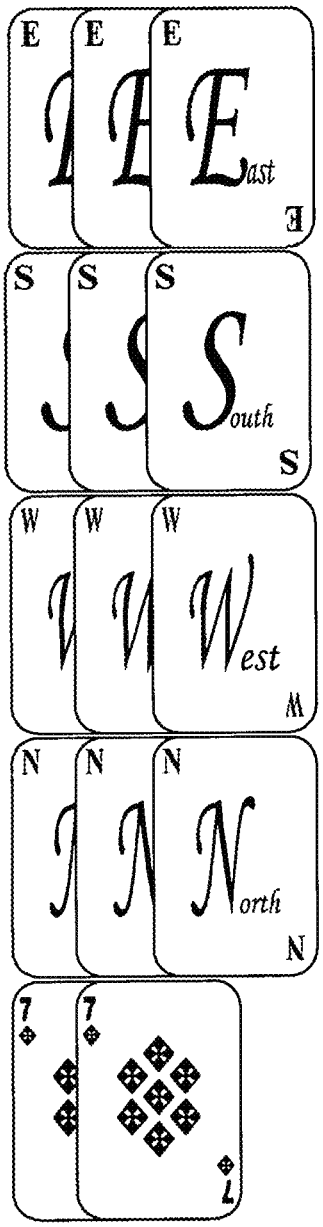
FIG. 5K illustrates the examples of the Big-position bonus in a complete hand.
Figure 5K:
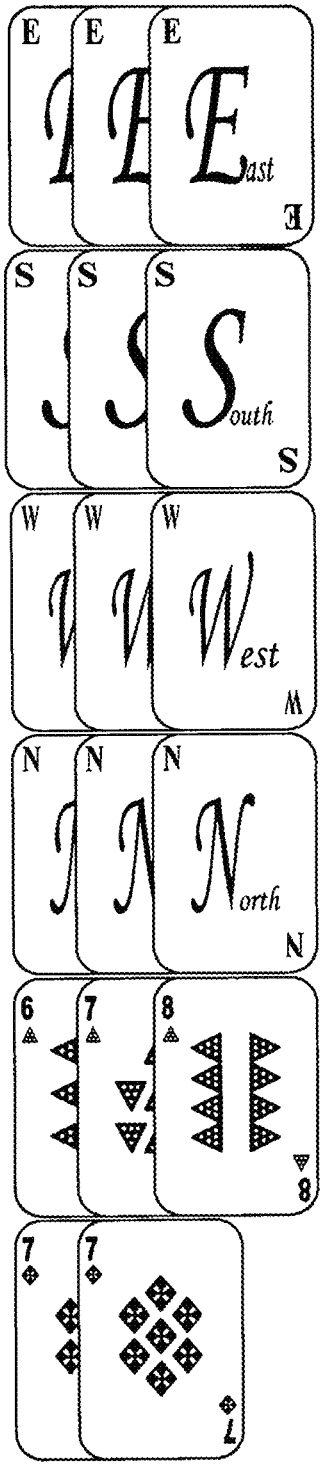

(13) "Big-position" bonus (not for 10-cards game), which happens when four identical melds of Position-suit cards are included in a complete hand. This pattern earns eight points. Examples are shown in FIG. 5K.

Figure 5L:
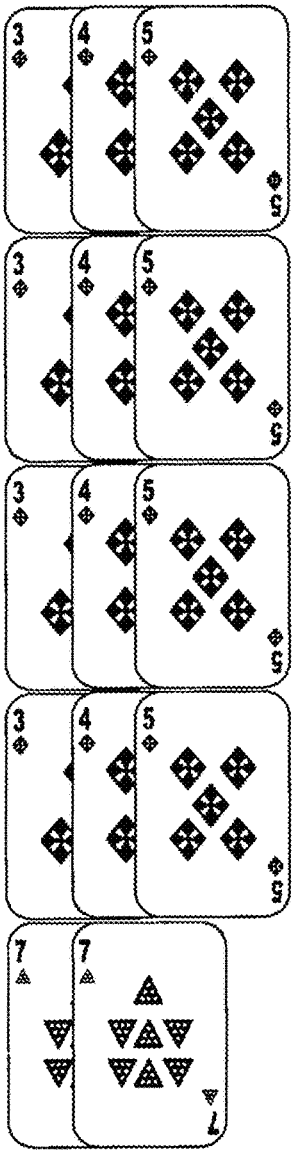
FIG. 5L illustrates the examples of the Quadruple-straight bonus in a complete hand.
Figure 5L:
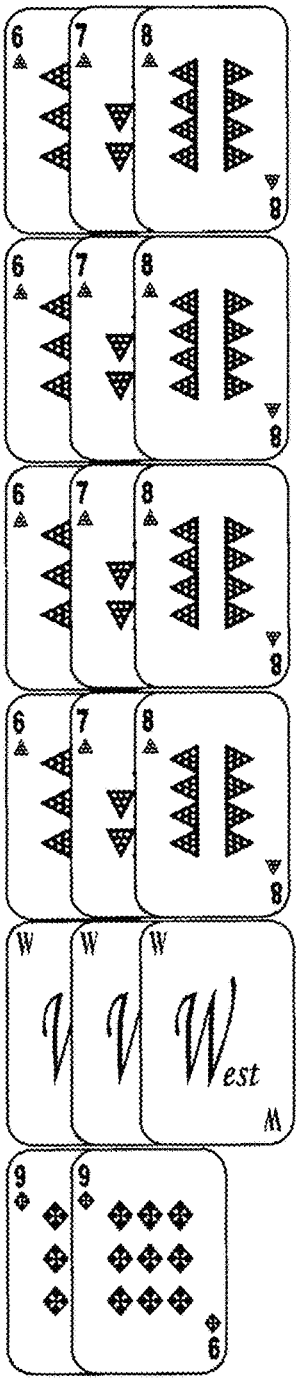

(14) "Quadruple-straight" bonus (not for 10-cards game), which happens when four straight melds with same markings are included in a complete hand. This pattern earns eight points. Examples are shown in FIG. 5L.

Figure 5M:
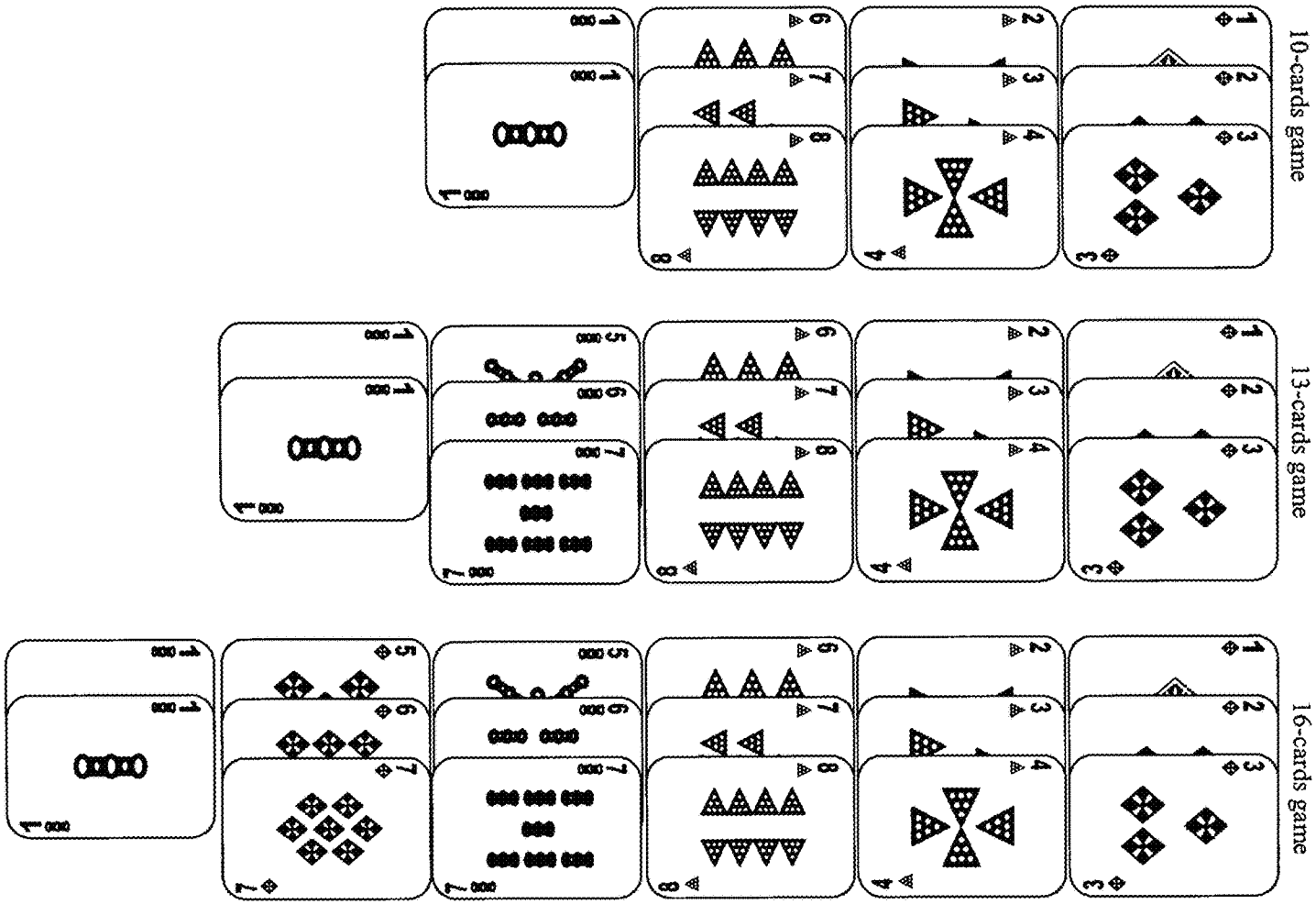
FIG. 5M illustrates the examples of the Shape-straight bonus in a complete hand.

Hand-Pattern Bonuses:

(1) "Shape-straight" bonus, which happens when a complete hand includes Shape-category cards only, and all melds are straight, not identical. This pattern earns two points. Examples are shown in FIG. 5M.

Figure 5N:
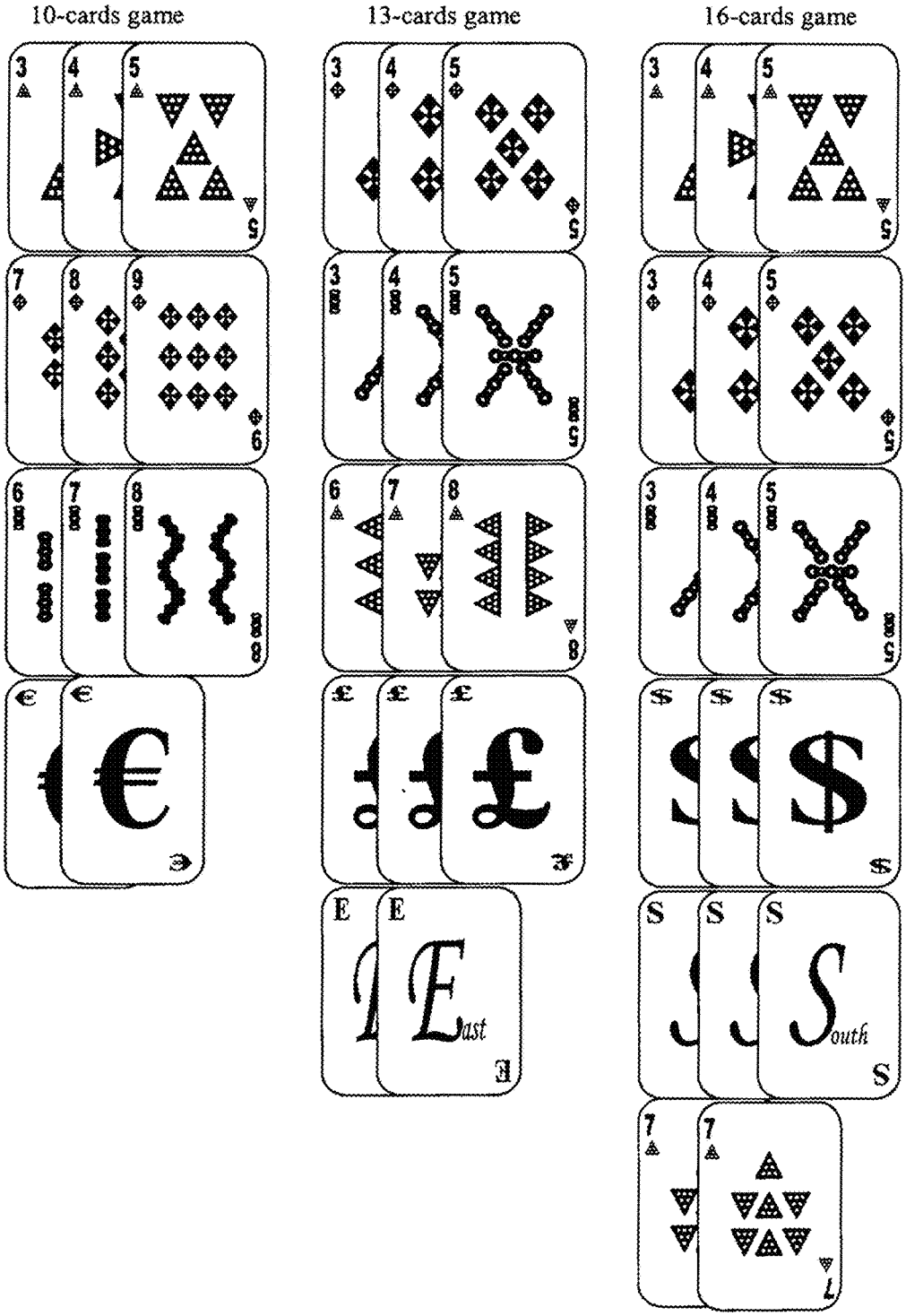
FIG. 5N illustrates the examples of the All-different bonus in a complete hand.

(2) "All-different" bonus, which happens when each of melds and pair in a complete hand is formed by the cards in different suit. However, for 16-cards game, a pair and a meld can be in the same suit. This pattern earns two points. Examples are shown in FIG. 5N.

Figure 5O:
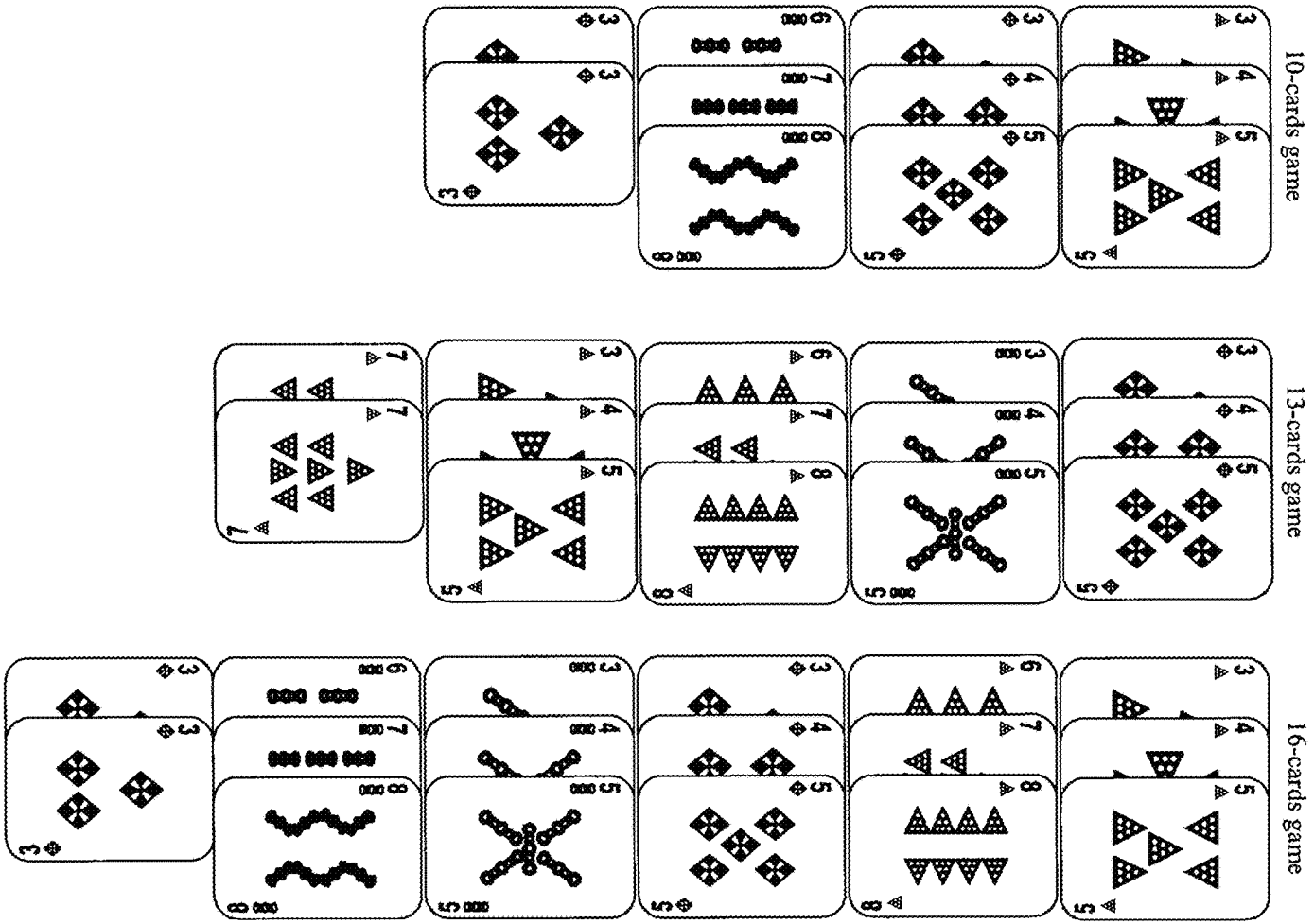
FIG. 5O illustrates the examples of the Without-one-nine bonus in a complete hand.

(3) "Without-one-nine" bonus, which happens when all melds and a pair in a complete hand are formed by Shape-category cards and there is no rank one or rank nine card. This pattern earns two points. Examples are shown in FIG. 5O.

Figure 5P:
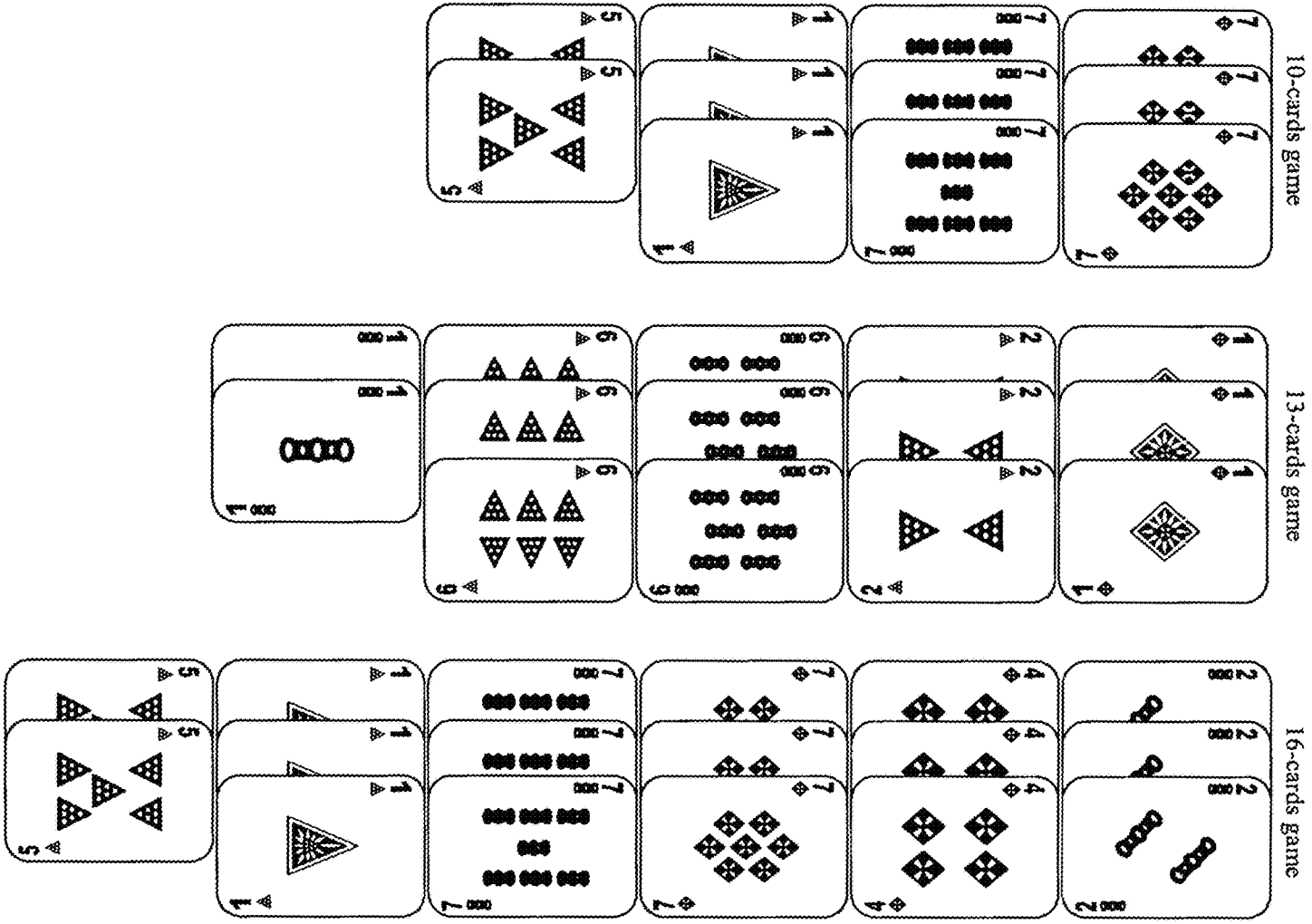
FIG. 5P illustrates the examples of the Identical-only bonus in a complete hand.

(4) "Identical-only" bonus, which happens when all melds in a complete hand are identical melds. This pattern earns four points. Examples are shown in FIG. 5P.

Figure 5Q:
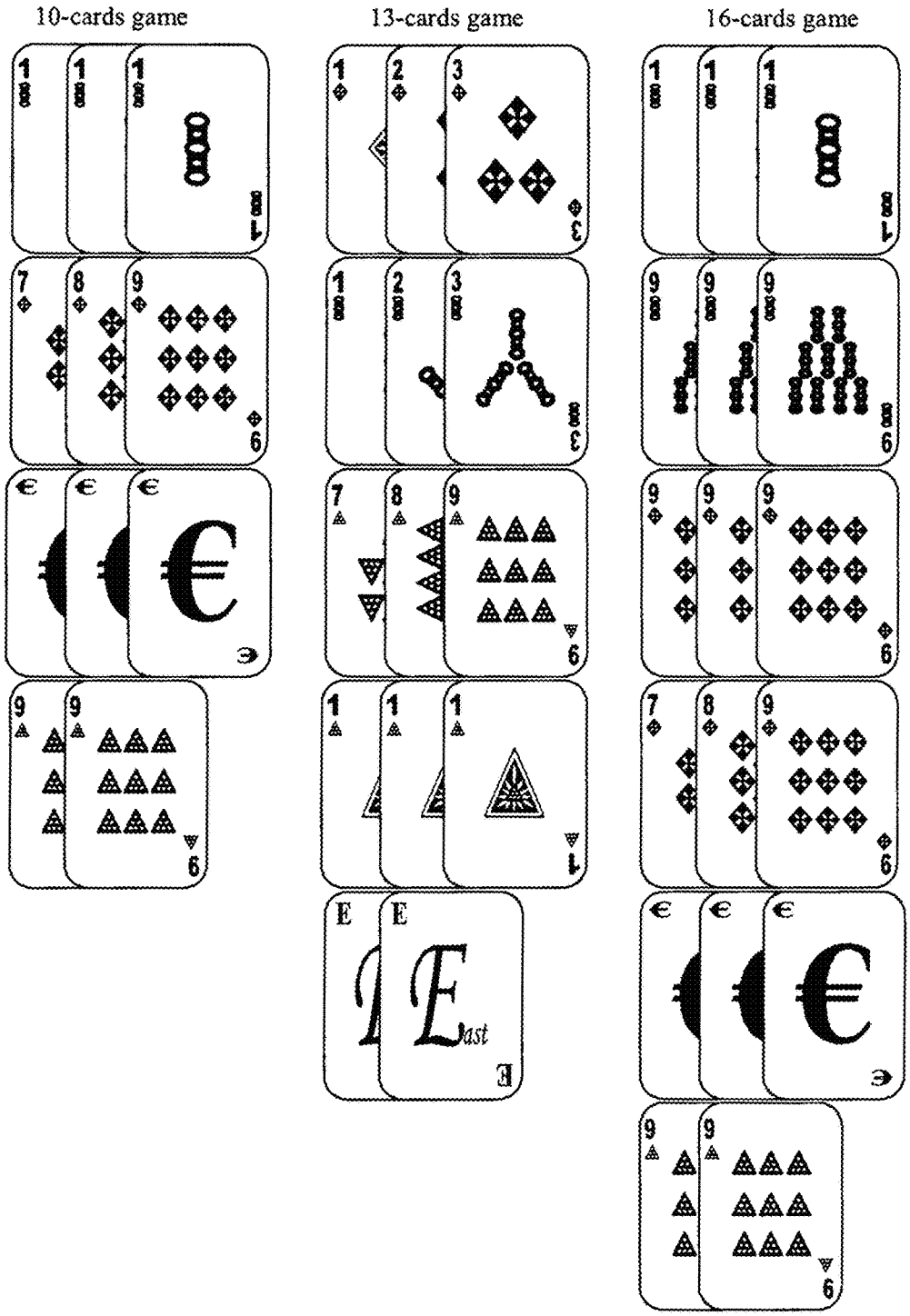
FIG. 5Q illustrates the examples of the Almost-one-nine bonus in a complete hand.

(5) "Almost-one-or-nine" bonus, which happens when one meld or pair is formed by Character-category cards and all other melds/pair include either rank one or rank nine cards of Shape-category. This pattern earns four points. Examples are shown in FIG. 5Q.

Figure 5R:
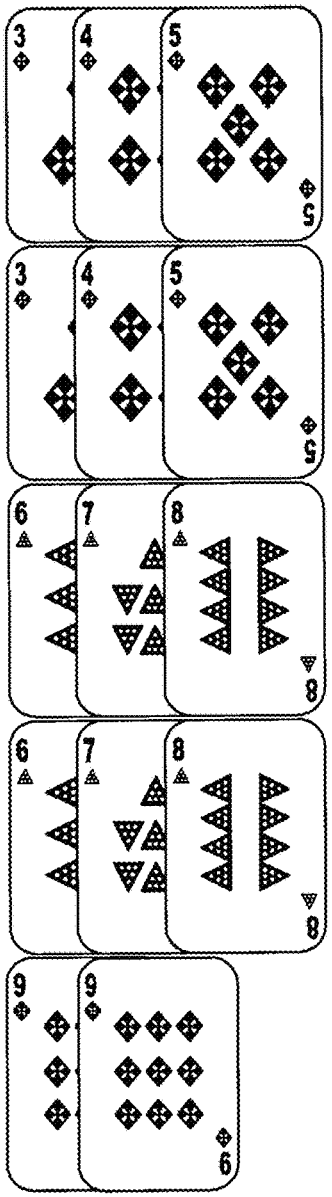
FIG. 5R illustrates the examples of the Two-double-straight bonus in a complete hand.
Figure 5R:
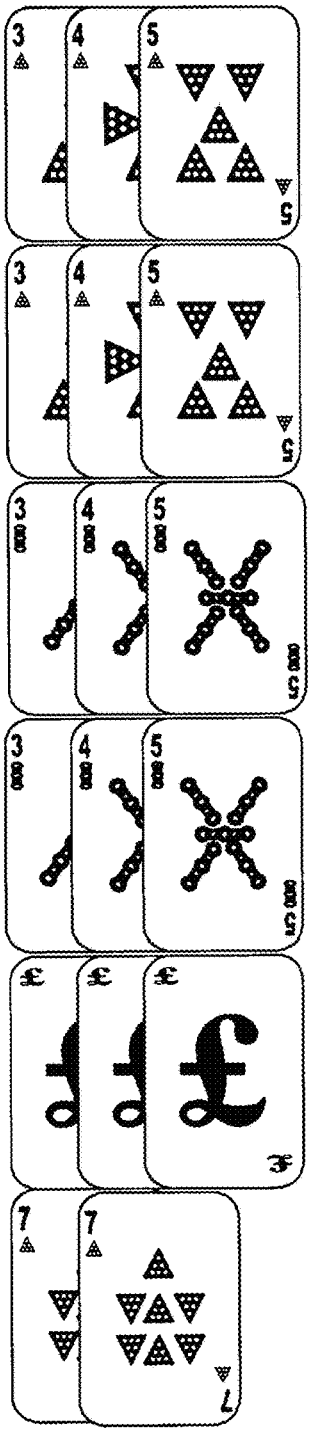

(6) "Two-double-straight" bonus (not for 10-cards game), which happens when two sets of two straight melds with same markings are included in a complete hand. This pattern earns four points. Examples are shown in FIG. 5R.

Figure 5S:
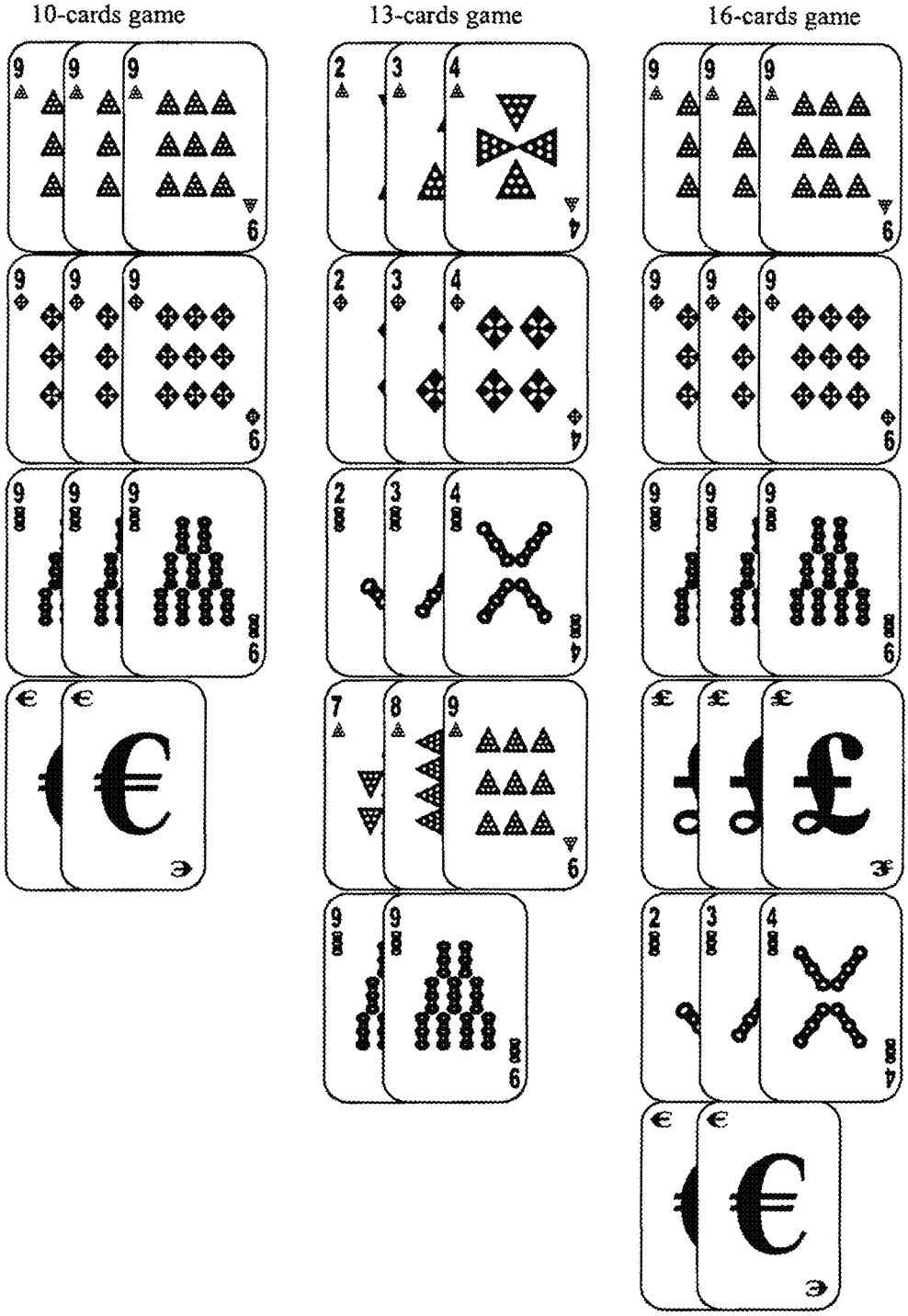
FIG. 5S illustrates the examples of the Three-three bonus in a complete hand.

(7) "Three-three" bonus, which happens when three straight melds or three identical melds are formed with same rank(s) but different suits in Shape-category. This pattern earns six points. Examples are shown in FIG. 5S.

(8) "Bonus-rob" bonus (see FIG. 7D), which happens when a player holding seven Bonus-category cards robs the last Bonus-category card revealed by another player. When the bonus is made, the play is over. This pattern earns six points.

Figure 5T:
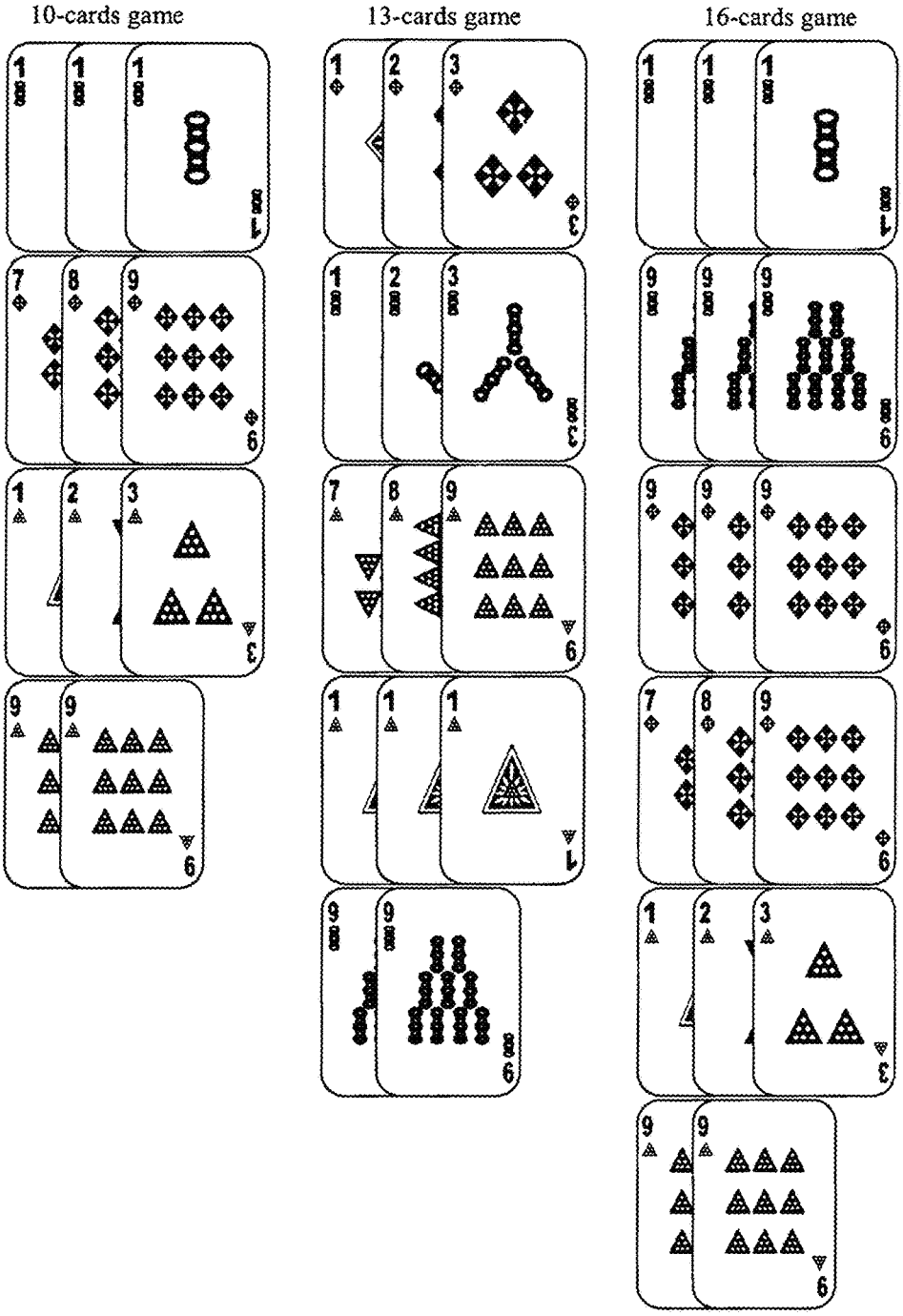
FIG. 5T illustrates the examples of the One-or-nine bonus in a complete hand.
Figure 5U:
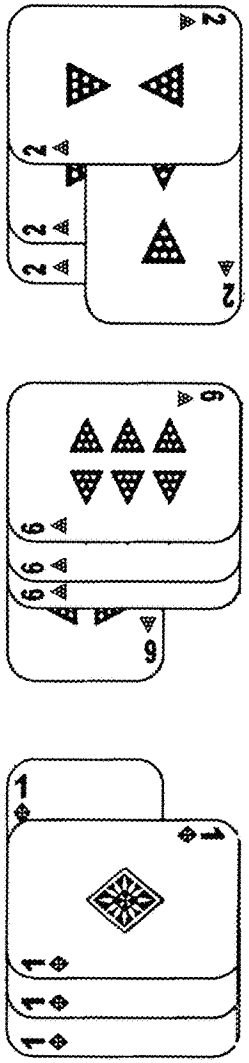
FIG. 5U illustrates the example of the 4QI bonus player may base on to declare a win in 13-cards game.
Figure 5U:
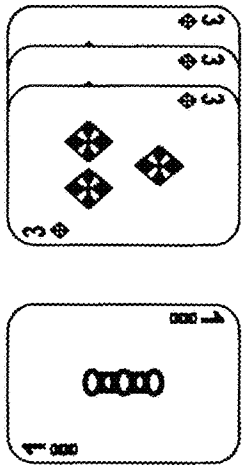
Figure 5U:
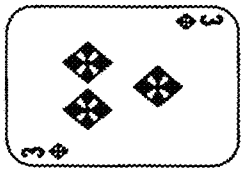

(9) "One-or-nine" bonus, which happens when all melds and pair include either rank one or rank nine cards of Shape-category. This pattern earns eight points. Examples are shown in FIG. 5T. (10) "4QI" bonus (not for 10-cards game), which happens when four quadruplet identical melds are included in a player's on-hand cards. When the bonus is made, the play is over. This pattern earns eight points. Example is shown in FIG. 5U.

Figure 5V:
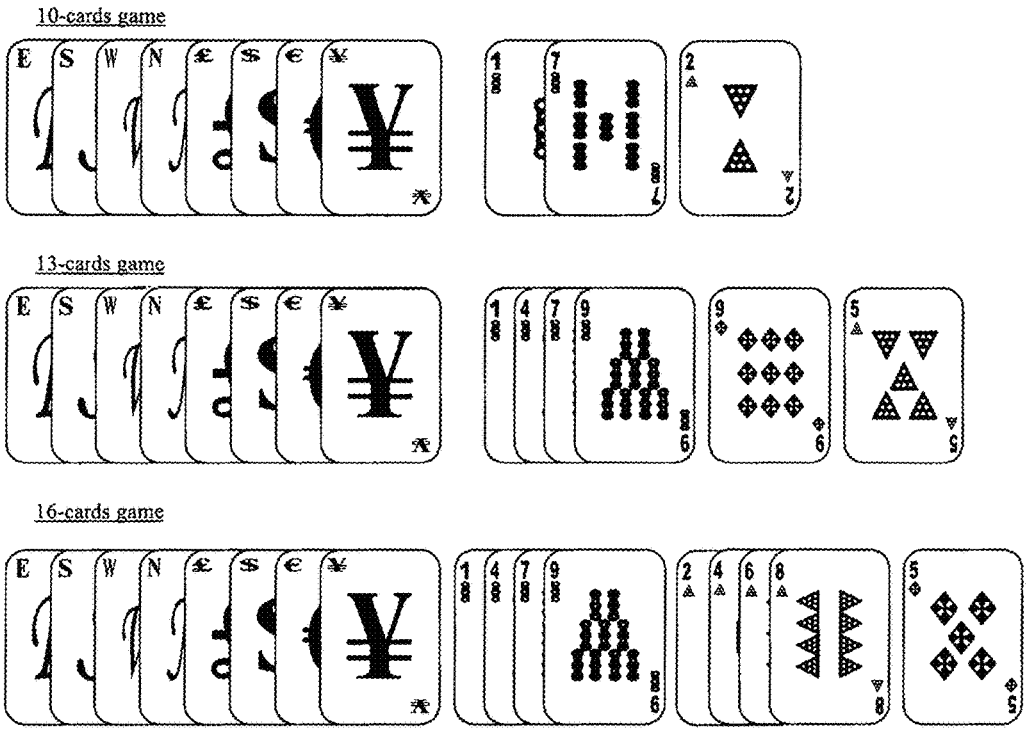
FIG. 5V illustrates the examples of the No-neighbor bonus player may base on to declare a win.

(10) "No-neighbor" bonus, which happens when a player holds eight different Character-category cards and the other cards (3 cards in 10-cards game, 6 cards in 13-cards game, and 9 cards in 16-cards game) on hand are Shape-category and inconsecutive. When the bonus is made, the play is over. This pattern earns eight points. Examples are shown in FIG. 5V.

(11) "8-Bonus-cards" bonus, which happens when a player gets all eight Bonus-category cards by distribution from dealer and/or by drawing from the Opportunity Deck. When the bonus is made, the play is over. This pattern earns eight points.

Figure 5W:
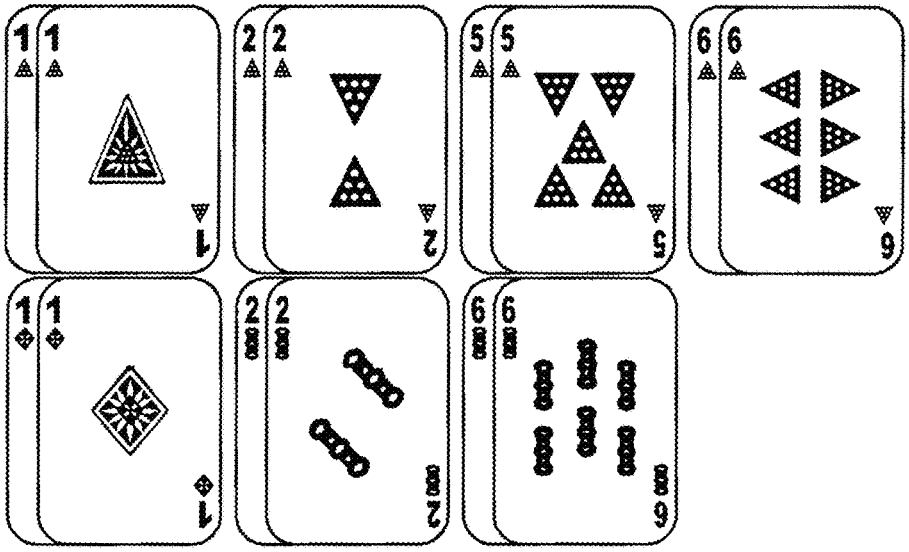
FIG. 5W illustrates the examples of the 7-pairs bonus player may base on to declare a win.
Figure 5W:
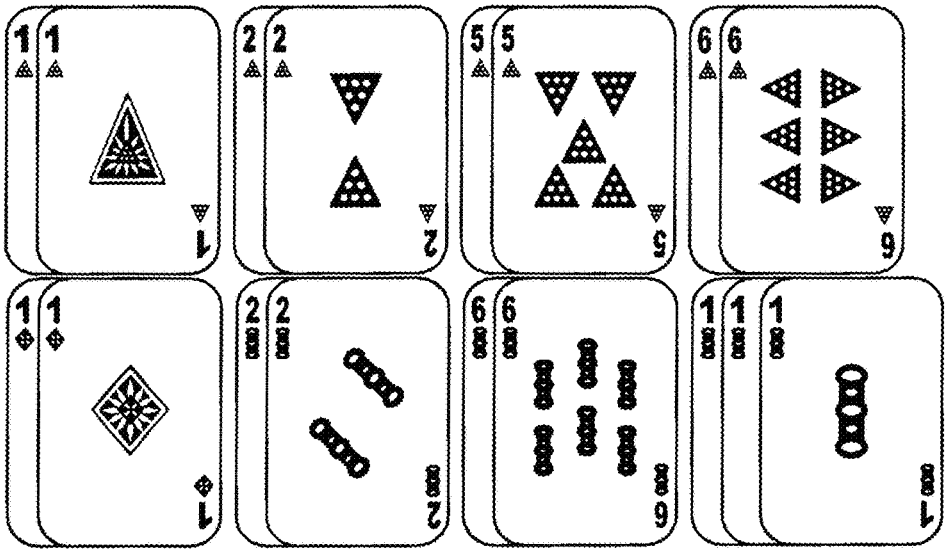

(12) "7-pairs" bonus (not for 10-cards game), which happens when on-hand cards comprise of seven pairs in 13-cards game or when on-hand cards comprise of seven pairs and one meld in 16-cards game. When the bonus is made, the play is over. This pattern earns eight points. Example is shown in FIG. 5W.

IV. Procedure of Playing the Game

FIG. 7 illustrates the general procedure of playing the game. FIG. 7A illustrates the procedure of the pre-game determination. Before starting the game, players pre-determine which rank, type, and level of the game will be engaged, how many rounds wilt be played, what is the base pay (e.g. 3 points) for each play (if chips or coins are used, determine how to use), how many joker cards will be included if players want to play wildcards, and if there is any additional pattern, point, and/or rules they want to play with. For example, if players want to play at high level, they need to determine the minimum points required to declare a win.

FIG. 7B illustrates the procedure of the pre-game setup. To determine the seating of each player and the round starter, each player randomly choose his/her seat, and players designate a player as a preparer. The preparer gets and shuffles four cards with the East, South, West, and North character features, turns the East side of the Position Indicator toward him/her, and rolls dices to determine "East" position, which is the side of the Position Indicator that includes a number matching the sum of the dices. Then, the preparer turns the East side of the Position Indicator toward the player at "East" position. The player at "East" position firstly draws a card, and then, in counter-clockwise order, each of the other players draws a card. By the card drawn and the Position Indicator, each player takes his/her own seat. The player, who draws "East" card and sits on the East position, collects the Round Indicator, the Position Indicator, dices, and all playing cards to act as the round starter and the first dealer.

FIG. 7C illustrates the dealer's job. Before players start playing, dealer needs to perform the dealer's job, which includes preparation, player position determination, distribution of initial playing cards, and replenishment of Bonus-category cards. Preparation includes turning the Round Indicator to correct position if the dealer is the round starter, shuffling the cards, and placing the shuffled cards face-down in the Public Zone of the playing table. Player position determination comprises the steps of turning the "East" side of the Position Indicator toward dealer, rolling dices to determine "East" position, finding "East" position that is the side of the Position Indicator including a number matching the sum of dices, and turning the "East" side of the Position Indicator toward the player at "East" position. By the Position Indicator, each player can learn his/her player position and bonus number of the play.

Before distributing initial playing cards, dealer should place a cut card (usually a joker card if not used in the game) between the shuffled cards and the player with East position, request the player with East position cut the deck by placing a chunk of cards on top of the cut card, and then put the other chunk of cards on top to complete a cut action. Then, dealer takes out the cards necessary to setup the Frozen Deck in the Public Zone, and places the Position Indicator on top of the Frozen Deck in correct position. After that, starting from himself/herself, dealer dispenses, in counter-clockwise order, four cards to each player four times (for 16-cards game), three times plus additional one card (for 13-cards game), or two times plus additional two cards (for 10-cards game), so each player initially has 16 cards, 13 cards, or 10 cards on hand. After the distribution of initial playing cards, dealer puts the rest of the cards as the Opportunity Deck in the Public Zone to let players draw cards during the play. Afterward, dealer reveals in-hand Bonus-category card(s) in the Bonus Zone to replenish card(s) from the Opportunity Deck, and requests, in counter-clockwise order, other players do the same replenishment work. After dealer completes the dealer's job, a play is officially started when dealer performs a "draw" action, (see FIG. 7D) which is taking a card from the Opportunity Deck.

In a play, players are trying to take alternative actions to successfully declare a win. Except the "draw" action, it is mandated that a player must orally make other players informed that an action is taken. For examples: (1) when a player performs a "match", "eat", or "quad" action, he/she must say "match", "eat", or "quad", respectively; (2) when a player performs a "discard" action, he/she must say the name of the card discarded; (3) when a player displays a Bonus-category card to perform a "draw" action, he/she must say "replenish"; and (4) when a player performs a "declare a win" action by a card he/she draws from the Opportunity Deck or by a card taken from other player, he/she must say "Bingo" or "Done".

FIG. 7D illustrates the flow of a play with alternative actions, which in fact comprises conditional looping steps. The first action of playing is always a draw action by dealer. A "draw" action is that a player takes a card from the Opportunity Deck, and it happens when a player becomes the next player, which is the player on the right-hand side of another player who discards a card, or when a player needs to replenish a card after performing a quad action or displaying a Bonus-category card. After performing a "draw" action and based on the card taken in, the drawer can perform "declare a win", "quad", "display Bonus-category card" or "discard" action: (1) The "declare a win" action happens when the drawer uses the taken-in card to accomplish a complete hand earning points above predetermined minimum requirement or to form a special pattern of on-hand cards, which can be based on to declare a win. The drawer reveals the card in his/her Playing Zone, says "Bingo", and then reveals all in-hand cards in the Playing Zone and all cards of the concealed quadruplet identical meld(s) displayed in the Display Zone. When a card is drawn and put together with other in-hand cards, the player cannot declare a win because it could be an illegal procedure. For example, the player just did Pass-a-win, which means a player is able to but does not declare a win by a card discarded. When a player does Pass-a-win, it is prohibited that he/she declares a win before he/she draws and discards a card; (2) The "quad" action happens when the drawer forms a quadruplet identical meld, either by adding a fourth identical card to a triplet identical meld in his/her Display Zone or by displaying four concealed identical cards in the Display Zone. The drawer says "quad", adds the fourth identical card or places a concealed quadruplet identical meld in the Display Zone, and draws another card from the Opportunity Deck; (3) The "display Bonus-category card" action happens when the drawn card is a Bonus-category card. The drawer reveals the card in the Bonus Zone, says "replenish", and draws another card from the Opportunity Deck; (4) The "discard" action happens when the drawer cannot do any other action. The drawer simply places a card in the Discard Zone.

When a player discards a card, his/her action stops, and other players' possible actions can be, in priority, "declare a win", "match", "eat", or "draw" action: (1) The "declare a win" action happens when a player may use the discarded card to accomplish a complete hand earning points above predetermined minimum requirement or to form a special pattern of on-hand cards, which can be based on to declare a win. The player says "Done", takes the card to his/her Playing Zone, and reveals all in-hand cards in the Playing Zone and all cards of the concealed quadruplet identical meld(s) displayed in the Display Zone; (2) The "match" action happens when a player wants to use the discarded card to form a triplet identical meld. The player says "match", takes the discarded card to the Display Zone, reveals two identical in-hand cards to form the triplet identical meld in his/her Display Zone, and discards a card in his/her Discard Zone. Nevertheless, before discarding a card, the player can perform a "quad" action if he/she is able and intends to. If a player does Pass-a-match, which means the player is able to but does not match a card discarded, it is prohibited that he/she matches a card with same marking before he/she draws and discards a card; (3) The "eat" action happens when the discarded card can be used to form a straight meld by the next player, which is the player on the right-hand side of the player discarding the card. The next player says "eat", takes the discarded card to his/her Display Zone, reveals two in-hand cards to form a straight meld with the discarded card in the Display Zone, and discards a card. Nevertheless, before discarding a card, the player can perform a "quad" action if he/she is able and intends to. It is important to know that only the next player can perform an "eat" action, and a "match" action has priority than an "eat" action. That is, when next player wants to "eat" and another player wants to "match", the player performing "match" action can have the card discarded; (4) The "draw" action happens when there is no player can do any other action. The next player takes a card from the Opportunity Deck.

Additionally, a "rob" action is to declare a win by robbing a card, which a player reveals for drawing another card. The player who performs a rob action says "Done", takes the revealed card to his/her Playing Zone, and reveals all in-hand cards in the Playing Zone and all cards of the concealed quadruplet identical meld(s) displayed in the Display Zone. When a rob action happens at the time a player performs a "quad" action, it is called "Quad-rob"; when a rob action happens at the high-level play and at the time a player displays a Bonus-category card, it is called "Bonus-rob". Moreover, because each play can have one winner only, the winner of a play may be determined by the priority of drawing a card when there are more than one player simultaneously declaring a win. Another words, after a card discarded or revealed, the player who may, in counter-clockwise order, draw a card before another player has the priority to declare a win. The situation is called "Vie".

What is claimed is:

1. A method of playing a card game for four players, comprising the steps of:

providing a deck consisting of 148 total cards comprising shape category cards, character category cards and bonus category cards;

the shape category cards comprising three suits including a diamond suit having cards ranked from 1 to 9, a delta suit having cards ranked from 1 to 9, and a stick suit having cards ranked from 1 to 9, each rank of the three suits in the shape category cards having four identical cards wherein each suit consisting of 36 cards for a total of 108 cards in the shape category cards;

the character category cards comprising two suits, a position suit and a money suit, the position suit having cards featuring four player positions of East, West, North and South, each player position card having four identical cards, wherein the position suit consisting of 16 cards, the money suit cards having cards featuring four kinds of currency of Pound, US dollar, Euro dollar and Japanese Yen, each kind of currency having four identical cards, wherein the money suit consisting of 16 cards, for a total of 32 cards in the character category cards;

the bonus category cards comprising two suits, a season suit and a fruit suit, the season suit consisting of four cards representing four different seasons of spring, summer, autumn and winter, assigning each season suit card a number from 1 to 4, the fruit suit consisting four cards representing four different fruits of orange, apple, pineapple and grape, assigning each fruit suit card a number from 1 to 4, for a total of 8 cards in the bonus category cards;

providing three 6-sided dice;

providing a four-sided table;

providing a square position indicator, each side of the position indicator having a representation of a position of East, West, North and South thereon, and each side of the position indicator having four different numbers selected from number 3 to 18 resulting from the possible numbers resulting from the roll of three 6-sided dice;

providing a square round indicator having a front and a back, the front of the round indicator depicting East, South, West, and North rounds, the back of the round indicator depicting Pound, US dollar, Euro dollar and Japanese Yen rounds;

each of the four players randomly choosing a side to sit on the four-sided table and assigning a dealer;

shuffling the deck of playing cards;

the dealer forming a Frozen deck by taking out cards from the deck and placing the Frozen deck at the center of the table;

rolling the three dice to determine East position that is the side of the of the position indicator including a number that is the same as the sum of the rolled three dice, placing the position indicator on top of the Frozen deck and turning the East side of the position indicator toward the player at East position;

dealing sixteen cards from the shuffled deck to each player;

forming an Opportunity deck by placing the remaining cards not dealt to the players in the center of the table adjacent to the Frozen deck;

assigning bonus numbers to each player using the dice; drawing sixteen cards from the Opportunity Deck as an anti-cheating insurance; allowing each player to take turns counterclockwise to draw a card from the Opportunity Deck in attempts to match cards into sets of either two or three identical or three consecutive cards within their pile of cards; discarding an unwanted one from their pile, carefully trying to avoid discarding a card that leads to another player's win; allowing other players to take discarded cards that match with theirs; ending the game once a player has transformed their originally dealt cards to five sets of three identical or consecutive and one pair of identical cards; and calculating the win or loss sums for each player.

2. The method according to claim 1, further comprising the step of:

allowing a player to have four identical cards, resulting in an additional draw.

3. The method according to claim 1, further comprising the step of:

allowing a player to immediately take a discarded card when it leads to a consecutive set only when the card is discarded by the player to their left.

4. The method according to claim 1, further comprising the step of:

allowing a player to immediately take a discarded card when it leads to an identical set whenever the card is discarded; allowing for the flow of the game to proceed to the right of the player who took the discarded card.

5. The method according to claim 1, further comprising the step of:

allowing a player to immediately take a discarded card when it leads to them winning and thus ending the game.

6. The method according to claim 1, further comprising the step of:

requiring players who discard cards that lead to another player's win to pay the amount owed; requiring players to strategize on other players' potential cards based on the cards displayed and how to best avoid paying.

7. The method according to claim 1, further comprising the step of:

allowing players to win by themselves through their draw in the Opportunity Deck, which will then require all players to pay.

8. The method according to claim 1, further comprising the step of:

providing a bonus to a player having bonus cards that correspond to their bonus numbers.

9. The method according to claim 1, further comprising the step of:

allowing players to play the game by originally dealing only 10 or 13 cards in order to require less strategy; a 10-card deal would require three sets of three identical or consecutive cards and a pair; a 13-card deal would require four sets of three identical or consecutive cards and a pair.

10. The method according to claim 1, further comprising the step of:

allowing a tie with no sums exchanged due to the exhaustion of the Opportunity Deck without a winner.

11. The method according to claim 1, further comprising the step of:

preventing players from prematurely or inaccurately declaring a win by requiring a payment to the other players and prohibiting from that round of play.

12. The method according to claim 1, further comprising the step of:

preventing players from incorrectly drawing or discarding cards by prohibiting the player from winning.

* * * * *